US005794554A

United States Patent [19]

Akahane et al.

[11] Patent Number: 5,794,554

[45] Date of Patent: Aug. 18, 1998

[54] SEWING MACHINE WITH MEANS FOR SYNCHRONIZING DRIVE OF NEEDLE AND LOOP TAKER MOTORS

[75] Inventors: Kohichi Akahane, Nagoya; Takashi Kondo, Obushi; Masaki Shimizu, Toyoake; Yoshikazu Kurono, Hazu-gun; Fumiaki Asano, Nagoya, all of Japan

[73] Assignee: Brother Kogyo Kabushiki Kaisha, Nagoya, Japan

[21] Appl. No.: 752,285

[22] Filed: Nov. 19, 1996

[30] Foreign Application Priority Data

Nov. 20, 1995 [JP] Japan ..... 7-328095

[51] Int. Cl.[6] ..... D05B 19/00

[52] U.S. Cl. ..... 112/470.01; 112/220; 112/221; 112/275

[58] Field of Search ..... 112/470.01, 470.04, 112/220, 221, 275, 277, 475.05

[56] References Cited

U.S. PATENT DOCUMENTS

| | | | |
|---|---|---|---|
| 4,688,498 | 8/1987 | Carlson | 112/475.05 X |
| 5,057,757 | 10/1991 | Orii | 112/277 X |
| 5,078,067 | 1/1992 | Nakashima | 112/277 X |
| 5,458,075 | 10/1995 | Tice et al. | 112/221 X |
| 5,474,001 | 12/1995 | Tajima et al. | 112/220 X |
| 5,505,150 | 4/1996 | James et al. | 112/275 X |

FOREIGN PATENT DOCUMENTS

| | | |
|---|---|---|
| B2-60-21750 | 5/1985 | Japan . |
| Y2-61-15816 | 5/1986 | Japan . |
| A-3-234291 | 10/1991 | Japan . |
| A-4-51991 | 2/1992 | Japan . |

*Primary Examiner*—Peter Nerbun
*Attorney, Agent, or Firm*—Oliff & Berridge, PLC

[57] ABSTRACT

A sewing machine including a head portion including a needle bar, the needle bar being for mounting a needle threaded with a needle thread; a principal shaft; a sewing machine motor for driving the needle bar via the principal shaft; a bed portion including a loop taker for taking a thread loop of the needle thread in cooperative operation with the needle; a loop taker drive shaft connected to move in association with the loop taker; a drive motor for driving the loop taker drive shaft independently of the principal shaft; a first detection unit for detecting a rotation condition of the principal shaft and outputting a first detection signal accordingly; a second detection unit for detecting a rotation condition of the loop taker drive shaft and outputting a second detection signal accordingly; and a synchronization control unit for controlling at least one of the drive motor and the sewing machine motor based on the first detection signal from the first detection unit and the second detection signal from the second detection unit so that the loop taker and the principal shaft rotate in synchronization.

17 Claims, 56 Drawing Sheets

FIG. 23

143a

| STITCH NUMBER | SEWING PITCH (mm) | MEETING SPEED (%) | MEETING POSITION (°) | X-DIRECTION POSITION | Y-DIRECTION POSITION |
|---|---|---|---|---|---|
| 00 | 20 | 0 | 1.0 | 0 | 0 |
| 01 | 20 | 10 | 1.0 | 10 | 10 |
| 02 | 25 | 10 | 0 | 12 | 12 |
| ⋮ | ⋮ | ⋮ | ⋮ | ⋮ | ⋮ |
| N | 20 | −10 | −2.0 | 200 | 250 |

FIG. 24

143b

| ROTATIONAL POSITION OF REFERENCE SHAFT (°) | PHASE OFFSET ADJUSTMENT AMOUNT (°) |
|---|---|
| 0 | 1 |
| 1 | 1 |
| 2 | 2 |
| ⋮ | ⋮ |
| 359 | 1 |

ROTATIONAL POSITION OF SHUTTLE
(PRESENT POSITION OF LOOP SEIZING BEAK
WHEN ONE CYCLE OF SHUTTLE SHAFT IS 360° )

ROTATIONAL POSITION OF SHUTTLE
(PRESENT POSITION OF LOOP SEIZING BEAK
WHEN ONE CYCLE OF SHUTTLE SHAFT IS 360° )

SEWING MACHINE WITH MEANS FOR SYNCHRONIZING DRIVE OF NEEDLE AND LOOP TAKER MOTORS

BACKGROUND OF THE INVENTION

1. Field of the Invention

The present invention relates to a sewing machine including a head portion for mounting a needle and a bed portion for mounting a shuttle or other type of loop taker for seizing a thread loop in cooperation with the needle.

2. Description of the Related Art

Conventionally, there has been known a sewing machine including a bed portion, a column portion protruding upward from the bed portion, an arm portion protruding horizontally from the upper end of the column portion, and a head portion attached to the opposite end of the arm portion from the column portion and in confrontation with the bed portion. A principal shaft for driving the head portion via a sewing machine motor is disposed within the arm portion. A needle bar, and consequently the needle attached to the needle bar, and levers in the head portion are vertically driven by drive force from the principal shaft. A shuttle rotated by a lower shaft and for taking the thread loop in cooperation with the needle is disposed within the bed portion. Drive force for rotating the lower shaft is also provided from the principal shaft. Because the needle and the shuttle must be operated in synchronization, the lower shaft is connected to the principal shaft and driven by drive force from the principal shaft.

Japanese Patent Application Publication No. SHO-60-21750 describes a sewing machine provided with a needle drive motor for driving the sewing needle and a shuttle drive motor for driving the shuttle independently from the needle drive motor. The needle drive motor and the shuttle drive motor are controlled to operate in synchronization so that operation of the sewing needle and the shuttle is synchronized. This sewing machine is capable of sewing a series of stitches perfectly.

Japanese Utility Application Publication No. SHO-61-158816 describes a similar sewing machine provided with a needle drive motor and a shuttle drive motor controlled to operate in synchronization to prevent skipping stitches and to enhance the tightness of stitches. Japanese Patent Application (Kokai) No. HEI-3-234291 describes a sewing machine including a sewing machine motor for driving the sewing machine needle via the principal shaft and a shuttle drive motor, which is different from the sewing machine motor, for driving the shuttle independently from the sewing machine motor. Further, a rotary encoder for detecting the rotational amount of the sewing machine principal shaft is also provided. A movement control means is provided for rotating the shuttle drive motor by an amount corresponding to an amount that the principal shaft is rotated by hand. This configuration enhances synchronization between the operations of the sewing needle and the shuttle.

Japanese Patent Application (Kokai) No. HEI-4-51991 describes a multi-head type embroidery sewing machine wherein a needle bar drive mechanism, a lever drive mechanism, a cloth pressure foot drive mechanism, and a shuttle driven mechanism are all drive independently to increase versatility with respect to the different feel of the embroidery.

In order to synchronize rotation of the principal shaft and the shuttle drive shaft, it is necessary to detect reference positions for the principal shaft and the shuttle drive shaft and rotational angles from which the principal shaft and the shuttle drive shaft are shifted from their respective reference positions. Conventionally, rotary encoders have been provided to both the principal shaft and to the shuttle drive shaft and detection signals outputted from the rotary encoders used to control synchronization between the principal shaft and the shuttle drive shaft.

SUMMARY OF THE INVENTION

In this way, the rotational position and rotational speed of the principal shaft and of the shuttle drive shaft can be detected and synchronously controlled based on the detection signals from the rotary encoders. It is conceivable to provide both the shuttle and its drive motor for driving the shuttle in a compact unitized shuttle module. However, in this case, it is difficult to attach the rotary encoder to the shuttle drive shaft. Inclusion of the rotary encoders also places restrictions on the configuration of the shuttle module so that freedom of design is limited. Although, a fair amount of space is available in the vicinity of the principal shaft so that the rotary encoder for the principal shaft can be easily incorporated to the principal shaft, incorporation of the rotary encoder nevertheless restricts freedom of design. Although, the pulses from both of the encoders are set as equal, this also restricts selection of the rotary encoder, servomotor, and the like.

When a servomotor is used as the drive motor for driving the shuttle, because a rotary encoder is already housed within the servomotor, providing a separate rotary encoder to the shuttle drive shaft would be wasteful. When the rotational angles of the shuttle drive shaft and the servomotor have a one-to-one correspondence, the rotational position and the rotational angle of the shuttle drive shaft can be easily detected based on the detection signal from the rotary encoder of the servomotor. However, when the relationship of the rotation angles are not a one-to-one correspondence, the detection signal from the rotary encoder of the servomotor is insufficient to accurately detect the rotational position of the shuttle drive shaft.

It is an objective of the present invention to overcome the above-described problems and enable freedom of design of the drive system in the sewing machine and enable the rotary encoder in the servomotor to be utilized for detecting the rotational angle and the rotational speed of the shuttle.

To achieve these objectives, a sewing machine according to the present invention includes a head portion including a needle bar for mounting a needle threaded with a needle thread; a principal shaft; a sewing machine motor for driving the needle bar via the principal shaft; a bed portion including a loop taker for taking a thread loop of the needle thread in cooperative operation with the needle; a loop taker drive shaft connected to move in association with the loop taker; a drive motor for driving the loop taker drive shaft independently of the principal shaft; a first detection unit for detecting a rotation condition of the principal shaft and outputting a first detection signal accordingly; a second detection unit for detecting a rotation condition of the loop taker drive shaft and outputting a second detection signal accordingly; and a synchronization control unit for controlling at least one of the drive motor and the sewing machine motor based on the first detection signal from the first detection unit and the second detection signal from the second detection unit so that the loop taker and the principal shaft rotate in synchronization.

According to another aspect of the embodiment, the first detection unit detects an origin position of the principal shaft and a reference position and a rotational angle of the sewing machine motor and outputs the first detection signal accordingly; and the second detection unit detects an origin position of the loop taker drive shaft and a reference position and a rotational angle of the drive motor and outputs the second detection signal accordingly.

With this configuration, the relative positional relationship between the principal shaft and the sewing machine motor can be established based on the origin position of the principal shaft detected by the first detection means and on the rotational angle and the reference position of the sewing machine motor. Further, the relative positional relationship between the shuttle drive shaft and its drive motor can be established based on the origin position of the shuttle drive shaft detected by the second detection means and on the reference position and rotational angle of the shuttle drive motor. Assuming that the positional relationship between the origin position of the principal shaft and the origin position of the shuttle drive shaft is predetermined, then a CPU of the sewing machine can use the detection signals from the first and second detection means to control at least one of the sewing machine motor and the drive motor to rotate the shuttle and the principal shaft in synchronization.

When the detection means is a switch or similar component for detecting origin position of both the principal shaft and the shuttle drive shaft, then there is no need to add a rotary encoder for detecting reference position and rotational angle of the principal shaft and the shuttle drive shaft.

Furthermore, when the positional shift between the principal shaft and the shuttle drive shaft is determined using coordinates representing the respective shafts, then the type of motor and the type of rotary encoder used in the sewing machine motor and the shuttle drive motor can be different. Therefore, the drive system for driving the principal shaft and the shuttle drive shaft can be designed with great freedom. Further, when a servomotor is used for the sewing machine motor or for the shuttle drive motor, the rotary encoder of the servomotor can be used so that a further separate rotary encoder need not to be provided.

Detection related to the principal shaft can be performed with a simple configuration by providing an origin sensor for detecting the origin position of the principal shaft and an encoder for detecting the reference position and rotational angle of the sewing machine motor. Also, the pulse number and the like of the encoder can be set freely.

Detection of the shuttle drive shaft can be performed using a mechanism having a simple configuration of an origin sensor for detecting the origin position of the shuttle drive shaft and an encoder for detecting the reference position and the rotational angle of the drive motor. The pulse number from the encoder can be freely set.

When the sewing machine motor is driven using a servomotor, the rotary encoder provided in the servomotor can be used to detect the reference position and the rotational angle of the sewing machine motor. When the sewing machine motor is a pulse motor, the control information for controlling the pulse motor can be used for detecting the rotational angle and reference position of the sewing machine motor.

When the relative position between the principal shaft and the shuttle drive shaft is controlled based on the detection signals from the two encoders and the detection signals from the two origin position sensors, meeting timing when the loop seizing beak of the shuttle meets the needle can be adjusted, and also, minute adjustment can be made in the rotational speed of the shuttle before and after the meeting time.

BRIEF DESCRIPTION OF THE DRAWINGS

FIG. 23 is a schematic view showing data stored in a meeting condition memory;

FIG. 24 is a schematic view showing data stored in an offset adjustment amount memory;

DETAILED DESCRIPTION OF THE PREFERRED EMBODIMENTS

Figure 1:
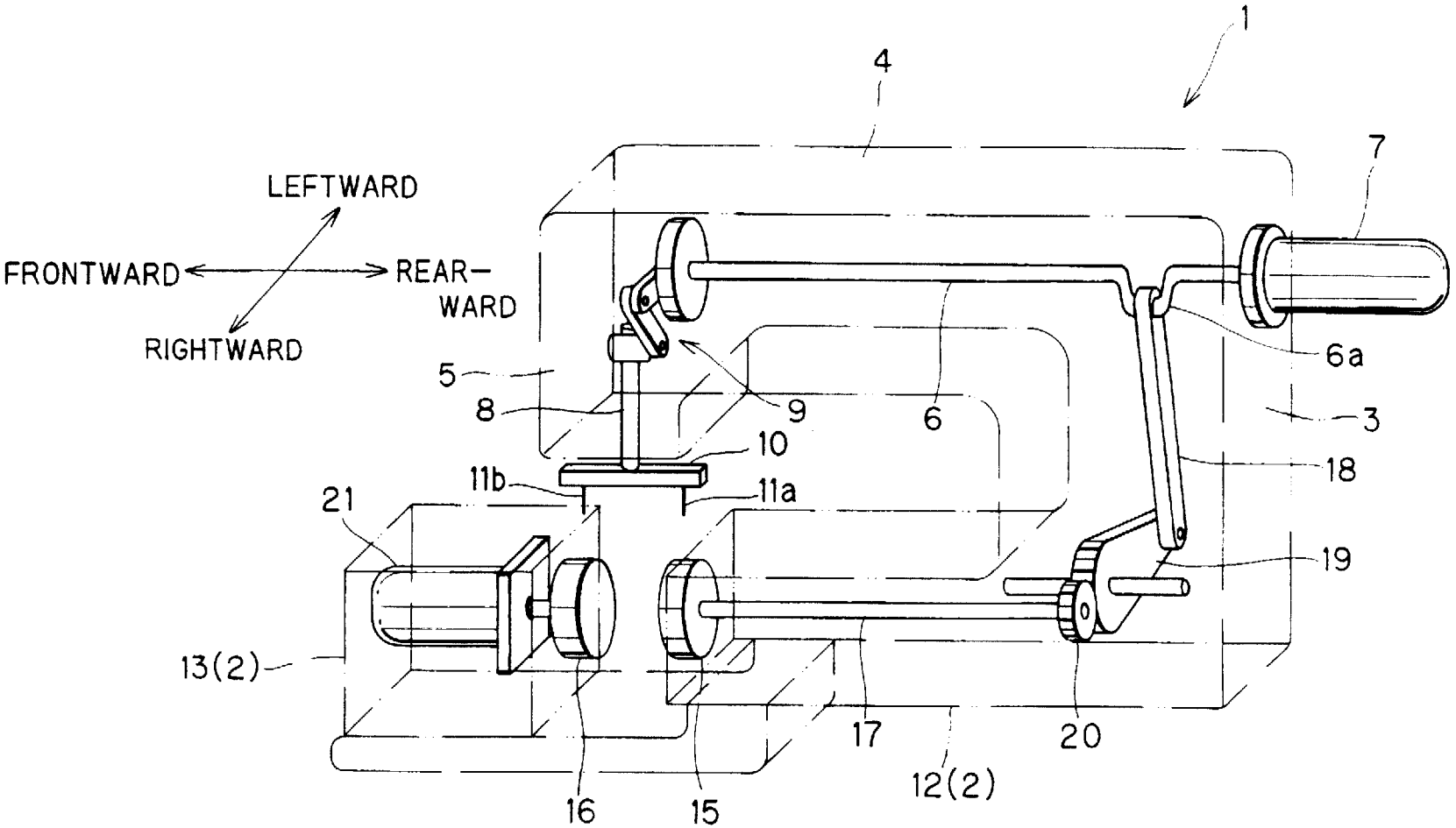
FIG. 1 is a perspective view partially in phantom schematically showing a two-needle sewing machine according to a first embodiment of the present invention.

A sewing machine according to a first embodiment of the present invention will be described while referring to the accompanying drawings wherein like parts and components are designated by the same reference numerals to avoid duplicating description.

FIG. 1 is a perspective view partially in phantom showing a two-needle sewing machine 1 according to the first embodiment. The two-needle sewing machine is for simultaneously stitching in a close stitch both ends of trouser belt loops. The sewing machine 1 includes a bed portion 2; a column portion 3 extending upward from one end of the bed portion 2; an arm portion 4 extending horizontally, that is, in parallel with the bed portion 2, from the upper end of the column portion 3; and a head portion 5 at the end of the arm portion 4 opposite the end thereof connected to the column portion. A principal shaft 6 is disposed within the arm portion 4. A sewing motor 7, such as an induction motor, for driving the principal shaft 6 is provided protruding outward from the upper portion of the column portion 3. A needle bar crank mechanism 9 connected to the principal shaft 6 and to a vertically disposed needle bar 8 is disposed in the head portion 5. With this configuration, when the sewing machine motor 7 drives the principal shaft 6, the needle bar 8 is driven up and down via the needle bar crank mechanism 9. A needle support body 10 having a horizontal posture is attached to the lower tip of the needle bar 8. A pair of sewing needles 11*a*, 11*b* are connected to either tip of the needle support body 10. The sewing needle 11*b* is attached so that its position can be adjusted in frontward and rearward directions indicated by arrows in FIG. 1.

The bed portion 2 includes a bed portion body 12 and a shuttle module 13 disposed separated from the bed portion body 12 by a predetermined gap. A rotation shuttle 15 is provided to the bed portion body 12. A rotation shuttle 16 is provided to the shuttle module 13 at a position confronting the rotation shuttle 15. The oscillating shuttles 15, 16 are for catching thread loops. A thread bobbin is provided internally to each of the oscillating shuttles 15, 16. A shuttle shaft 17 for driving the oscillating shuttle 15 by drive power of the principal shaft 6 is disposed with a horizontal posture internally to the bed portion body 12. A crank rod 18 is connected to a crank portion 6*a* of the principal shaft 6. A sector gear 19 is connected to the crank rod 18. A gear 20 attached to the right tip of the shuttle shaft 17 as viewed in FIG. 1 is meshingly engaged with the sector gear 19 and reciprocally rotatably driven by the principal shaft 6 via the crank rod 18 and the sector gear 19. With this configuration, the oscillating shuttle 15 is driven in synchronization with vertical movement of the needle bar 8 in the same manner as in conventional sewing machines.

The shuttle module 13 includes the oscillating shuttle 16 and a servomotor 21 for driving the half rotation shuttle 16 independently from the principal shaft 6. The shuttle module 13 includes a mechanism enabling shifting of its position between a usage position, in which it is used, to a retracted position rotated horizontally from the usage position by a predetermined pivoting angle. It should be noted that the half rotation shuttle 16 is further from the oscillating shuttle 15 and the head portion 5 in the retracted position than in the usage position. The shuttle module 13 is also configured so that its position can be manually adjusted forward and rearward in order to adjust the gap between the shuttles 15, 16 according to the changes in the distance between the sewing needles 11*a*, 11*b* and in order to adjust the positional relationship between the sewing needle 11*b* and the loop seizing beak of the oscillating shuttle 16. Detailed description of the configuration of the shuttle module 16 will be provided later.

Figure 2:
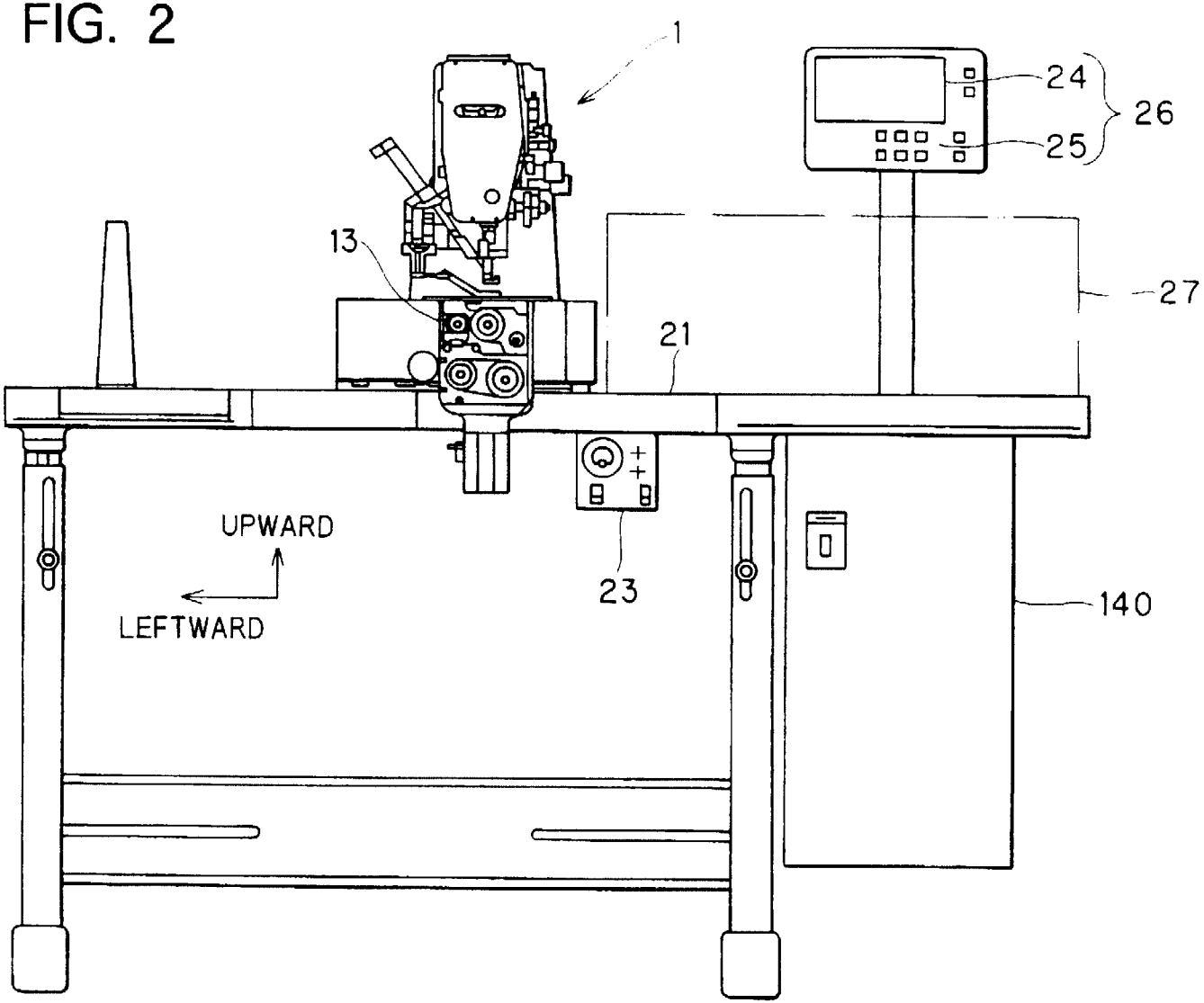
FIG. 2 is a front view showing a sewing system including the two-needle sewing machine of FIG. 1.
Figure 3:
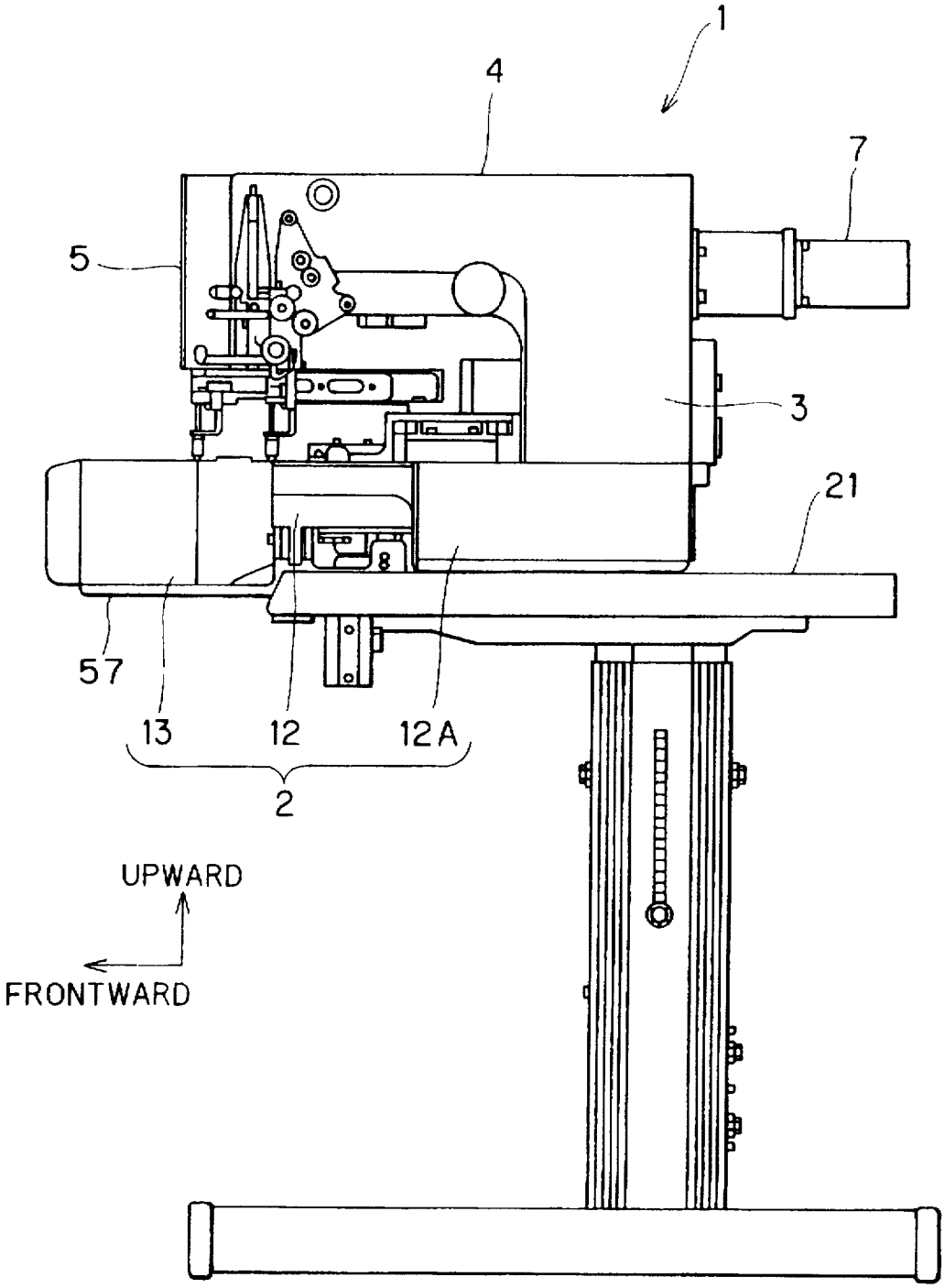
FIG. 3 is a view from a right side of the sewing system.

First, a brief explanation of the overall configuration of the two-needle sewing machine 1 will be provided while referring to FIGS. 2 and on. FIG. 2 is a front view of the two-needle sewing machine 1 mounted on a work table 21. FIG. 3 is a view from the right side of FIG. 2.

As shown in FIGS. 2 and 3, the two-needle sewing machine 1 is mounted in the center portion of the work table 21. A control unit 140 and a manual operation unit 23 are attached to the undersurface of the work table 21. An operation panel 26 having a liquid crystal display 24 and an operation portion 25 is disposed with an upright posture to the right edge of the work table 21. A supply unit 27 for supplying a continuous material for forming belt loops is provided adjacent to the operation panel 26 on top of the work table 21. Further explanation of the supply unit 27 will be omitted.

Next, a brief explanation for a cloth feed mechanism 30 will be provided while referring to FIGS. 4 through 9.

Figure 4:
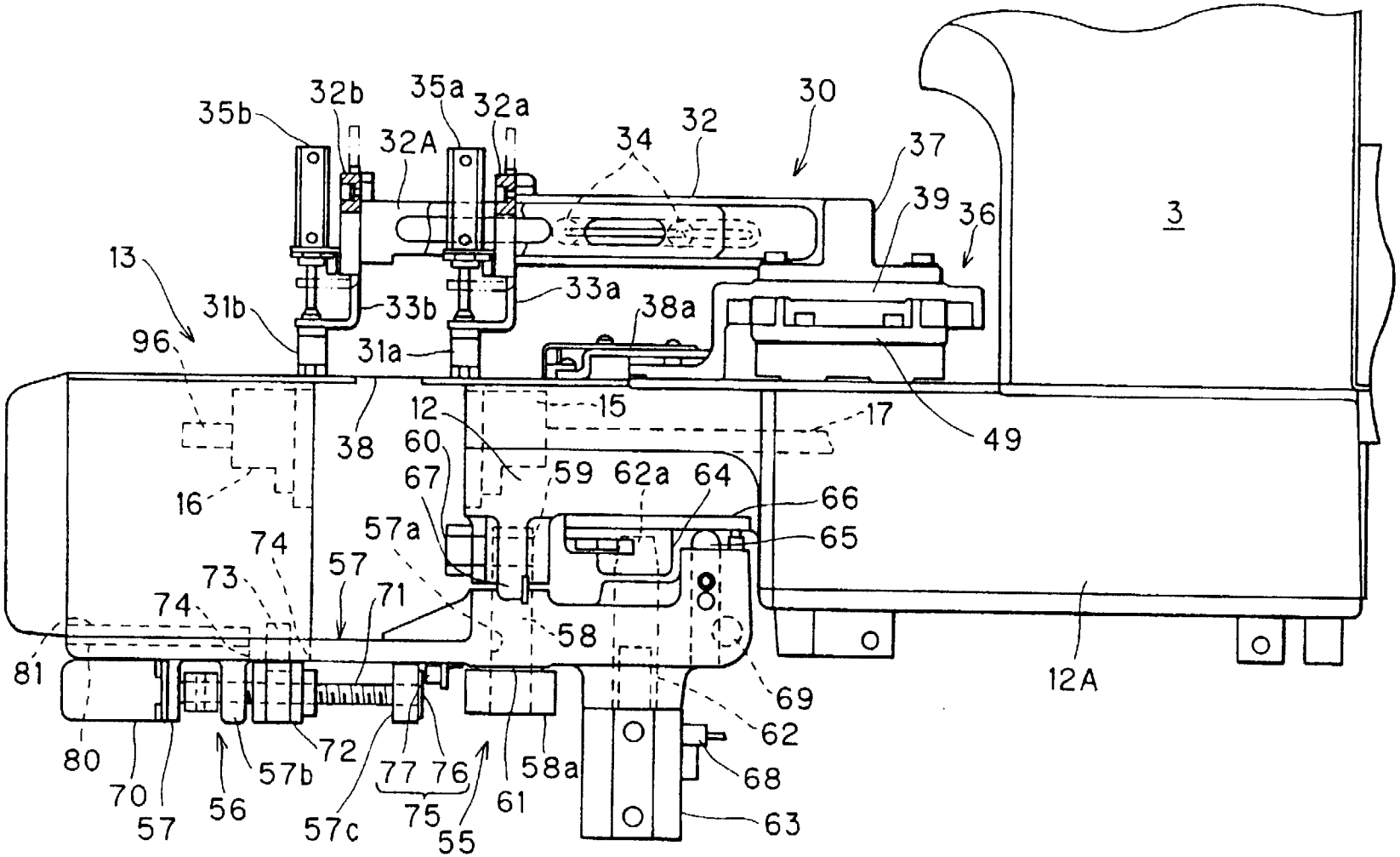
FIG. 4 is an enlarged view partially in phantom showing a cloth feed mechanism and a bed portion of the two-needle sewing machine, the bed portion including a shuttle module.
Figure 5:
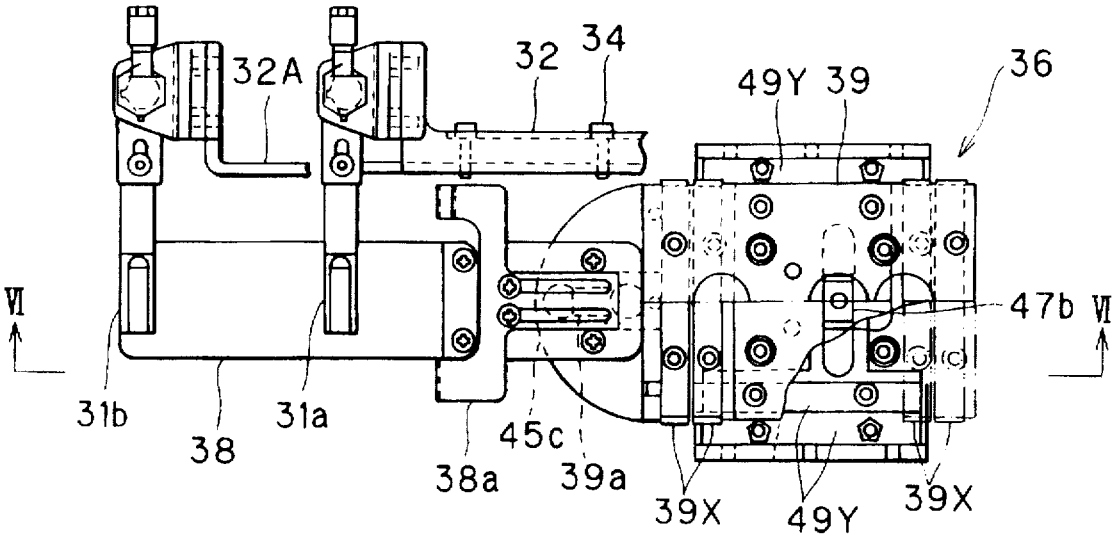
FIG. 5 is a plan view showing the bed portion and the cloth feed mechanism.
Figure 6:
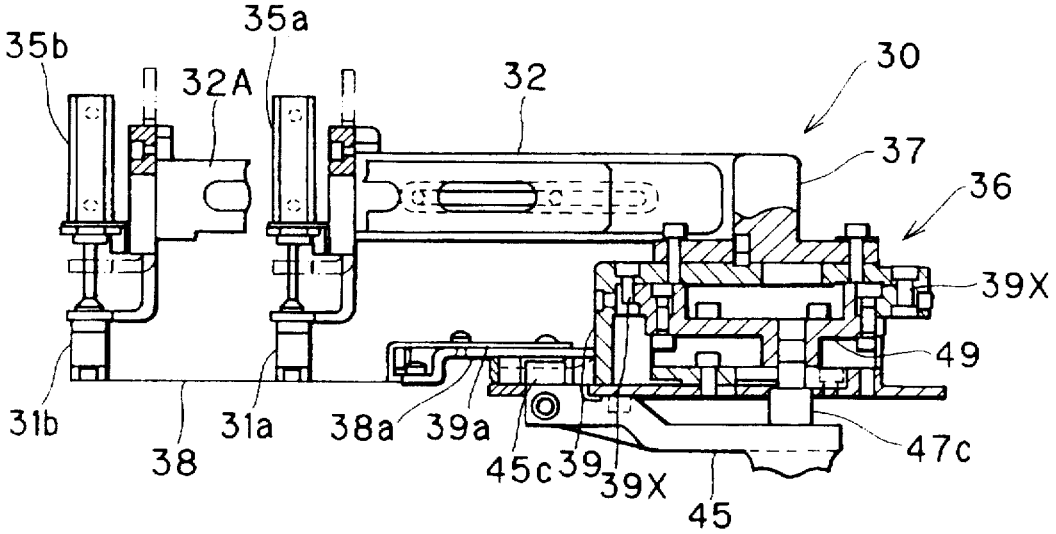
FIG. 6 is a side view partially in cross-section taken along line VI–VI of FIG. 5.

As shown in FIGS. 4 through 6, cloth pressure feet 31*a*, 31*b* are disposed at positions corresponding to those of the sewing needles 11*a*, 11*b*. The cloth pressure foot 31*a* is supported by an L-shaped plate 33*a* attached to a vertical guide portion 32*a* at the front tip of a support arm 32. The cloth pressure foot 31*b* is supported on an L-shaped plate 33*b* attached to a vertical guide portion 32*b* at the front tip of a movable support arm 32A, which is engaged with the support arm 32 so as to be freely slidable frontward and rearward. The movable support arm 32A is releasingly fixed to the support arm 32 by two screws 34, each having a knob. The L-shaped plate 33*a* fixed to the cloth pressure foot 31*a* is driven vertically by an air cylinder 35*a*, which is mounted to the vertical guide 32*a* so as to be freely slidable in the vertical direction. The L-shaped plate 32*b* fixed to the cloth pressure foot 31*b* is driven vertically by an air cylinder 35*b*, which is mounted to the vertical guide portion 32*b* so as to be freely slidable in the vertical direction. The support arm 32 is fixed to a connection member 37 of an XY feed mechanism 36. The connection member 37 is fixed to a feed operation body 39. The air cylinders 35*a*, 35*b* are driven and controlled by the control unit 140.

A cloth reception plate 38 extends beneath the cloth pressure feet 31*a*, 31*b* in order to sandwich a workpiece cloth between itself and cloth pressure feet 31*a*, 31*b*. The cloth reception plate 38 is driven by the XY feed mechanism 36 to feed the cloth independently in the X direction, that is, rightward and leftward, and in the Y direction, that is, rearward and forward. The cloth reception plate 38 is fixed to the feed operation body 39 via a support plate 38*a*. With this configuration, the cloth reception plate 38 operates integrally with the cloth pressure feet 31*a*, 31*b* to feed the workpiece cloth while it is sandwiched between the cloth reception plate 38 and the cloth pressure feet 31*a*, 31*b*.

The XY feed mechanism 36 including the front/rear feed operation member 39 and a left/right feed operation member 49 will next be described while referring to FIGS. 5 through 9. A θ-axis servomotor 41 for supplying drive force to drive the front/rear feed operation member 39 and an R axis servomotor 43 for supplying drive force to drive the left/right feed operation member 49 are disposed within a case 40 of a bed portion base 12A of the bed portion 12. The θ-axis servomotor 41 drives a spiral cam shaft 42 and the R axis servomotor 43 drives a spiral cam shaft 44. A small ring 45*b* at one tip of an L-shaped swing arm 45 is meshingly engaged with the spiral cam shaft 42. A base portion 45*a* at the pivotable center of the swing arm 45 is pivotably rotatably fitted to the upper tip of a support shaft 46. A bridge 45*c* at the other tip of the swing arm 45 is meshingly engaged with a narrow engagement hole 39*a* extending frontward and rearward in the feed operation body 39. The base tip of a swing arm 47 is pivotably rotatably fitted on a support shaft 48. A small ring 47*a* positioned at the center of the swing arm 47 is meshingly engaged with the spiral cam shaft 44. A bridge 47*b* at the leftward most tip of the swing arm 47 is meshingly engaged with a cylindrical engagement hole 49*a* extending leftward and rightward through the feed operation body 49. A shaft portion 47*c* below the bridge 47*b* is connected to the base portion 45*a*.

The front/rear feed operation member 49 is supported so as to be freely slidable in the frontward and rearward directions by a slide unit 49Y with respect to the base member 50. The left/right feed operation member 39 is supported so as to be freely slidable in the leftward and rightward directions by a slide unit 39X with respect to the front/rear feed operation member 49.

With this configuration, the front/rear feed operation member 49 can be fed frontward and rearward by drive of the R axis servomotor 43 as transmitted via the spiral cam shaft 44, the swing arm 47, and the slide unit 49Y. The front/rear feed operation member 39 can be fed leftward and rightward by drive of the θ-axis servomotor 41 as transmitted via the spiral cam shaft 42, the swing arm 47, and the slide unit 39X. However, strictly speaking, feed in the X direction and feed in the Y direction are performed via both motors 41, 43. With this configuration, feed amount in the X direction and the Y direction can be precisely controlled by controlling rotational amount and direction of the motors 41, 43 using the control unit 140. It should be noted that the above-described cloth feed mechanism 30 is similar to existing mechanisms.

Next, the shuttle module 13 will be explained.

First, an explanation will be provided for a position switching mechanism 55 for switching the position of the shuttle module 13 and a minute movement mechanism 56 for moving the shuttle module 13 slightly frontward and rearward.

Figure 7:
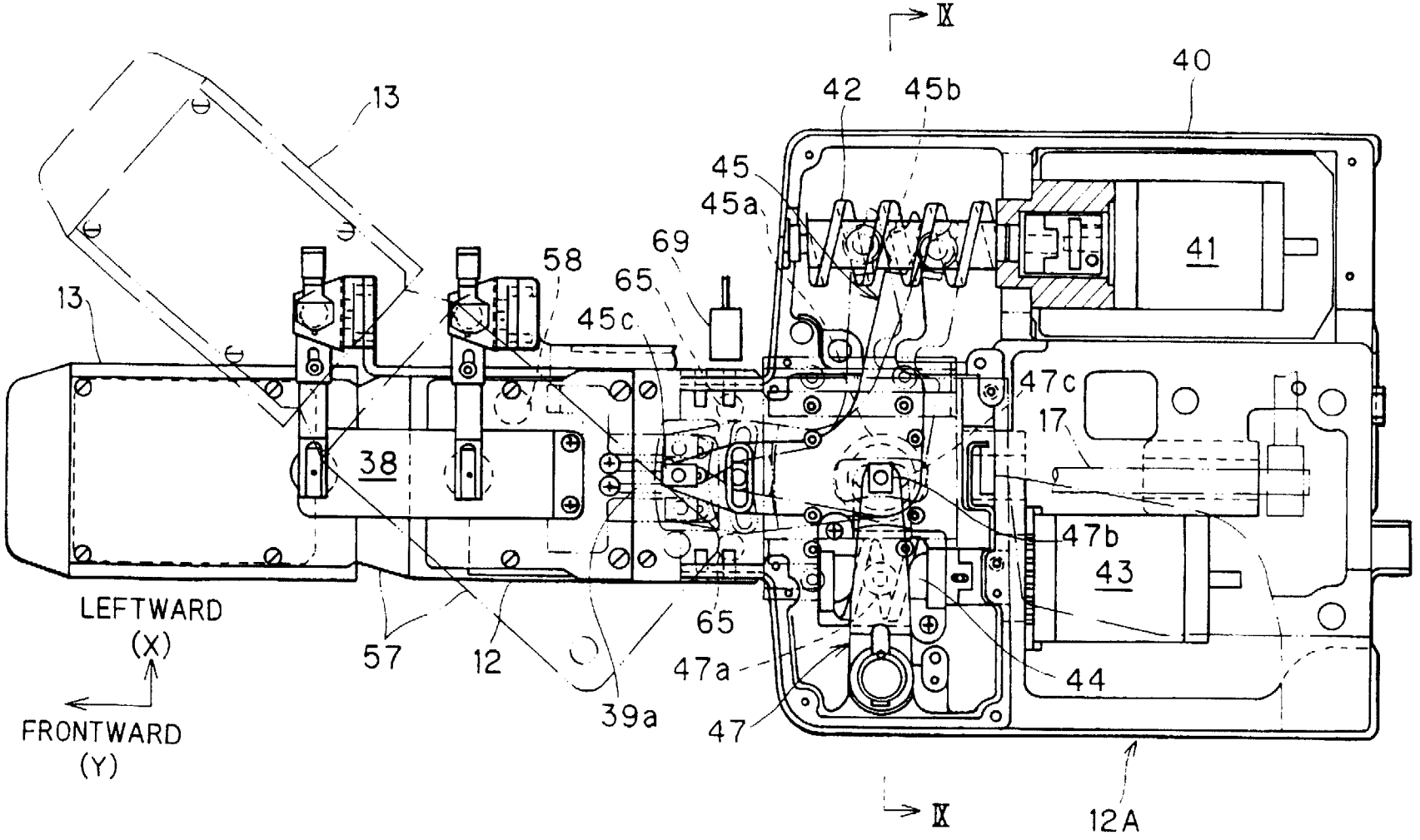
FIG. 7 is a plan view showing the drive system of the cloth feed mechanism and positional change possible by the bed portion.
Figure 8:
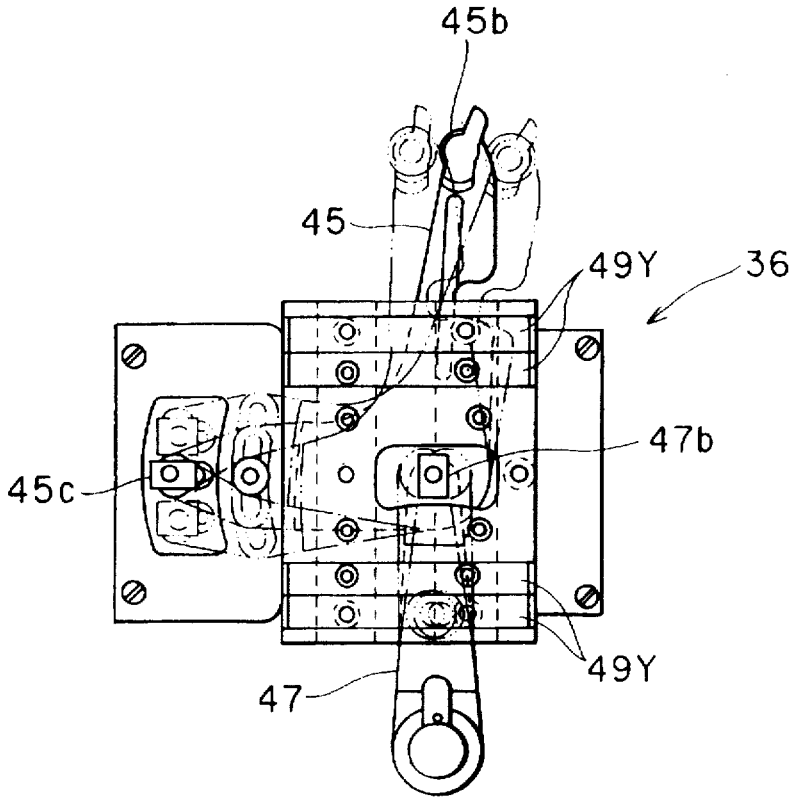
FIG. 8 is a plan view showing a swing arm and other components of the cloth feed mechanism.
Figure 9:
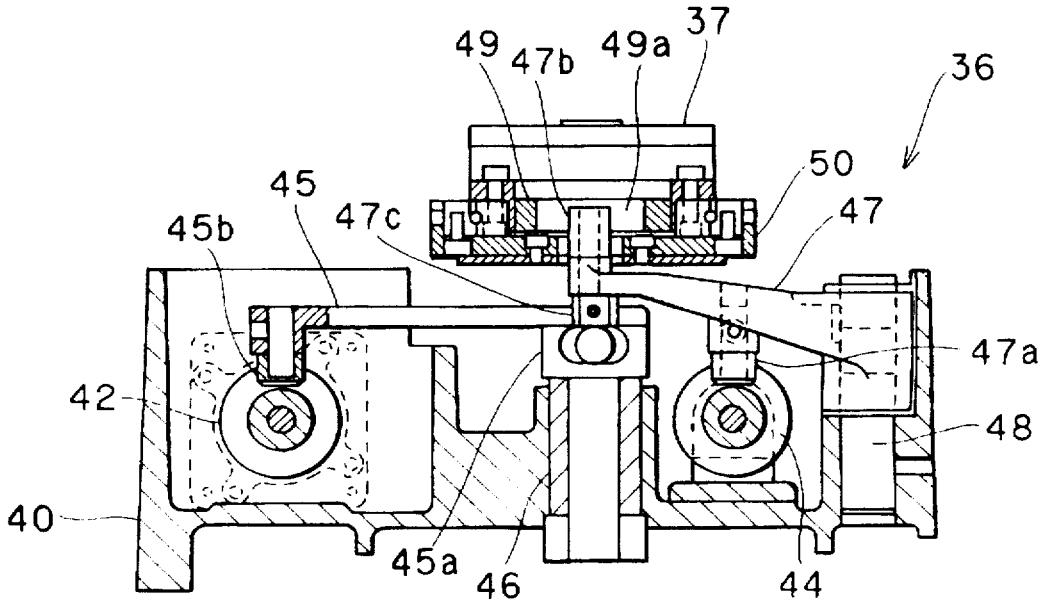
FIG. 9 is a cross-sectional view taken along line IX–IX of FIG. 7.
Figure 10:
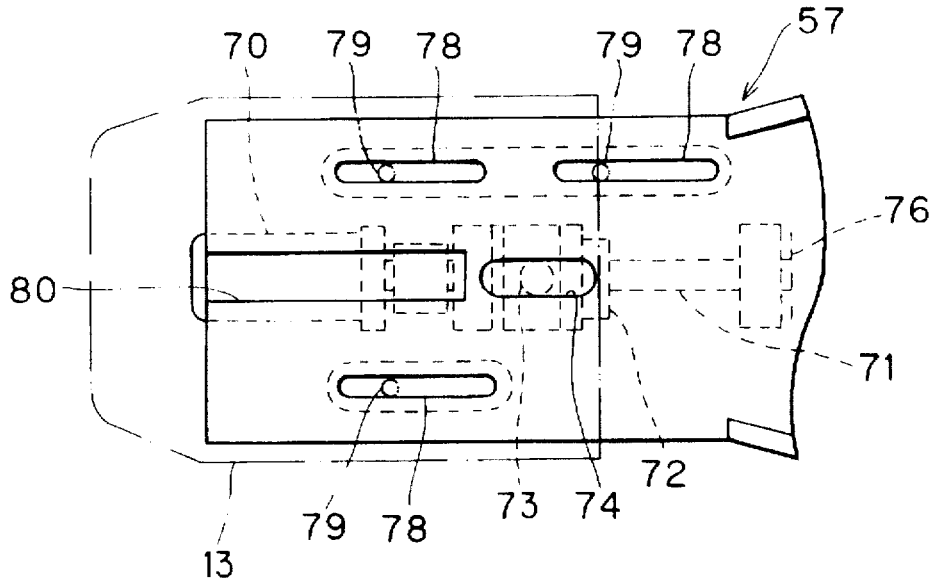
FIG. 10 is a plan view showing a pivot frame for enabling positional change of the bed portion shown in FIG. 7.

As shown in FIGS. 4, 7, and 10, the shuttle module 13 is formed in a substantially parallelepiped block shape. A pivot frame 57 extends horizontally from the lower side of the bed portion 12 and is attached at its upper front surface to the shuttle module 13. An upright pivot shaft 58 having a head portion 58*a* for supporting the pivot frame 57 passes through a support hole 57*a* opened in the pivot frame 57 and into a hole 59 formed near the front left edge of the bed body 12. The support shaft 58 is formed with a hole in which is fitted a taper screw portion at the tip of a horizontal bolt 60 disposed between the head portion 58*a* of the support shaft 58 and the pivot frame 57. A low friction bearing 61 is provided for enabling the pivot frame 57 to pivot horizontally around the support shaft 58. The pivot frame 57 can be pivoted between a usage position shown by a solid line in FIG. 7 and a retracted position pivoted horizontally approximately 45 degrees from the usage position as shown by a chain line in FIG. 7.

A lock pin 62 for locking the shuttle module 13 in the usage position is driven vertically by an air cylinder 63 so that a tapered engagement portion 62*a* at the upper tip of the lock pin 62 engages in the engagement hole of a boss portion 64 of the bed body 12. A pair of left and right pressing members 65 abutting the lower surface of a bearing plate 66 are provided to the rear tip of the pivot frame 57. When the shuttle module 13 is to be switched from the usage position to the retracted position, the lock pin 62 is lowered by the air cylinder 63 and the shuttle module 13 is manually pivoted horizontally into the retracted position. The pressing members 65 follow the lower surface of the bearing plate 66 until the shuttle module 13 is switched into the retracted position. It should be noted that a stopper 67 is provided for stopping the shuttle module 13 in the usage position. Although, the shuttle module 13 is configured to be manually moved into the retracted position in the present embodiment, a spring member or an air cylinder can be provided to automatically switch the shuttle module 13 into the retracted position.

A proximity switch 68 for detecting the position of the lock pin 62 turns off when the lock pin 62 is pulled out of the engagement hole of the boss portion 64. A proximity switch 69 for detecting the position of the shuttle module 13 turns on when the shuttle module 13 is switched to the usage position. Detection signals from the switches 68, 69 are supplied to the control unit 140. Switching the shuttle module 13 to the retracted position exposes the forward portion of the half rotation shuttle 15 and the rear portion of the oscillating shuttle 16. Therefore, operations such as exchanging the bobbins within the oscillating shuttles 15, 16 and removing tangled needle and bobbin threads can be easily and efficiently executed.

Next, an explanation will be provided for the minute movement mechanism 56 for moving the shuttle module 13 slightly frontward and rearward in order to adjust the distance between the half rotation shuttles 15, 16 in coordination with adjustment in distance between the sewing needles 11*a*, 11*b* and for adjusting minute positional changes between the loop seizing beak of the half rotation shuttle 16 and the sewing needle 11*b*.

As shown in FIG. 4, to the lower surface of the pivot frame 57 is provided: a shuttle interval adjustment pulse motor 70; a ball screw shaft 71 driven frontward and rearward by the pulse motor 70; and a ball screw nut 72 in screwing engagement with the ball screw shaft 71. The pulse motor 70 is fixed to a bracket 57*d* of the pivot frame 57. The ball screw shaft 71 is rotatably supported on a pair of brackets 57*b*, 57*c* of the pivot frame 57. A slot 74 elongated frontward and rearward is formed in the pivot frame 57. A pin member 73 fixed to the lower tip of the shuttle module 13 passes through the slot 74 and engages in an engagement hole of the ball screw nut 72 so that rotating movement of the ball screw nut 72 is restricted. The pin member 73 also connects the ball screw nut 72 with the shuttle module 13 so that these move frontward and rearward together.

With this configuration, the shuttle module 13 can be moved slightly forward or rearward via the pin member 73 by loosening two screw members 79, which are for fixing the shuttle module 13 to the pivot frame 57 in a manner to be described later with reference to FIG. 10, and by driving the ball screw shaft 71 by the pulse motor 70 so that the ball screw nut 72 moves slightly rearward or forward. A disc plate 76 of an origin detection unit 75 is fixed to the front tip of the ball screw shaft 71. An optical or electromagnetic origin sensor 77 for detecting small slits formed in the disc plate 76 is attached to the pivot frame 57. The detection signal from the origin sensor 77 is supplied to the control unit 140 so that the control unit 140 can control the pulse motor 70.

FIG. 10 is a plan view showing essential portions of the pivot frame 57 with the shuttle module 13 removed. Elongated slits 78 extending frontward and rearward are formed through the pivot frame 57. The screw members 79 extend downward through the elongated slit 78 and are screwingly engaged with the lower tip of the shuttle module 13. As mentioned above, the shuttle module 13 is fixed to the pivot frame 57 by the screw members 79, and by loosening the screw members 79, the shuttle module 13 can be moved slightly frontward and rearward. The shuttle module 13 can be removed from the pivot frame 57 by removing the screw members 79 entirely.

Figure 14:
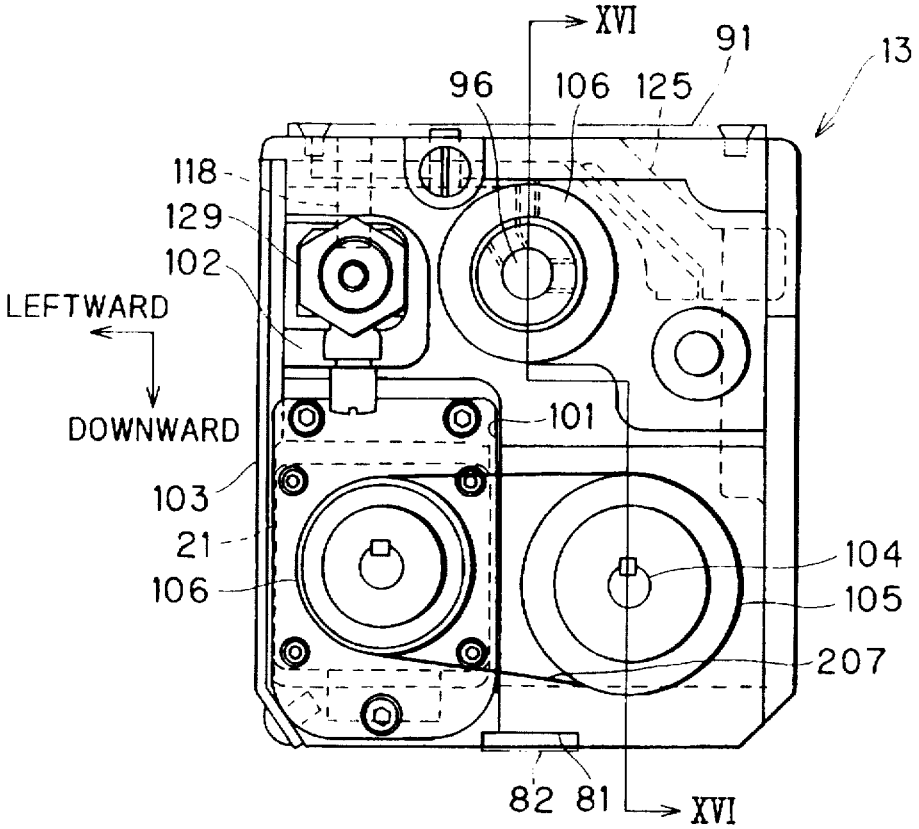
FIG. 14 is a front view partially in phantom showing the shuttle module.

Further, as shown in FIG. 14, a shallow key groove 80 is formed extending frontward and rearward in the upper surface of the pivot frame 57 and a shallow key groove 81 opposing the key groove 80 is formed extending frontward and rearward direction in the lower tip surface of the shuttle module 13. A common key member 82 is mounted in these key grooves 81, 82 in order to prevent the shuttle module 13 from shifting leftward and rightward with respect to the pivot frame 57.

Next, a brief explanation will be provided for mechanisms within the shuttle module 13.

As shown in FIGS. 11 through 17, the shuttle module 13 includes a housing 90; a needle plate 91 attached by screws to the upper surface of the housing 90; the half rotation shuttle 16; a servomotor 21 for driving the oscillating shuttle 16 via a drive transmission system; a thread cutting mechanism 93 for cutting the needle thread and the bobbin thread; a lubrication supply mechanism 130; and an origin sensor 95 for detecting origin position of a drive shaft of a drive transmission system. A shuttle shaft 96 extends frontward and rearward through the shuttle module 13. The oscillating shuttle 16 is disposed in the vicinity of the upper tip of the shuttle module 13 and includes a driver 97 driven by the shuttle shaft 96; a middle shuttle 98 driven by the driver 97 and having a loop seizing beak 98*a* at its tip; a bobbin case 99 within the middle shuttle 98; and a large shuttle body 100.

Figure 15:
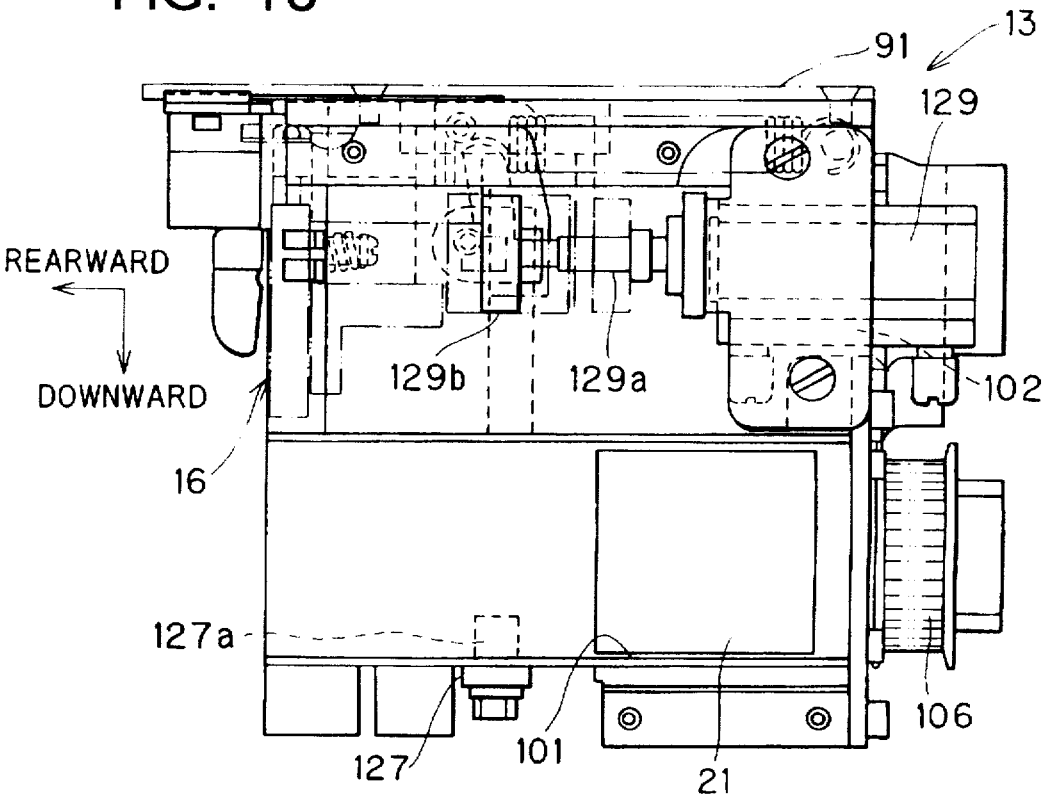
FIG. 15 is a left-side view partially in phantom showing the shuttle module.

As can be best seen in FIGS. 14 and 15, a motor housing indentation 101 is formed in the lower left side of the housing 90. A cylinder housing indentation 102 is formed in the upper left side of the housing 91 above the motor housing indentation 101. The servomotor 21 is disposed with a horizontal posture in the motor housing indentation 101. A cover plate 103 covers the left side surface of the motor housing indentation 101 and the cylinder housing indentation 102.

Figure 16:
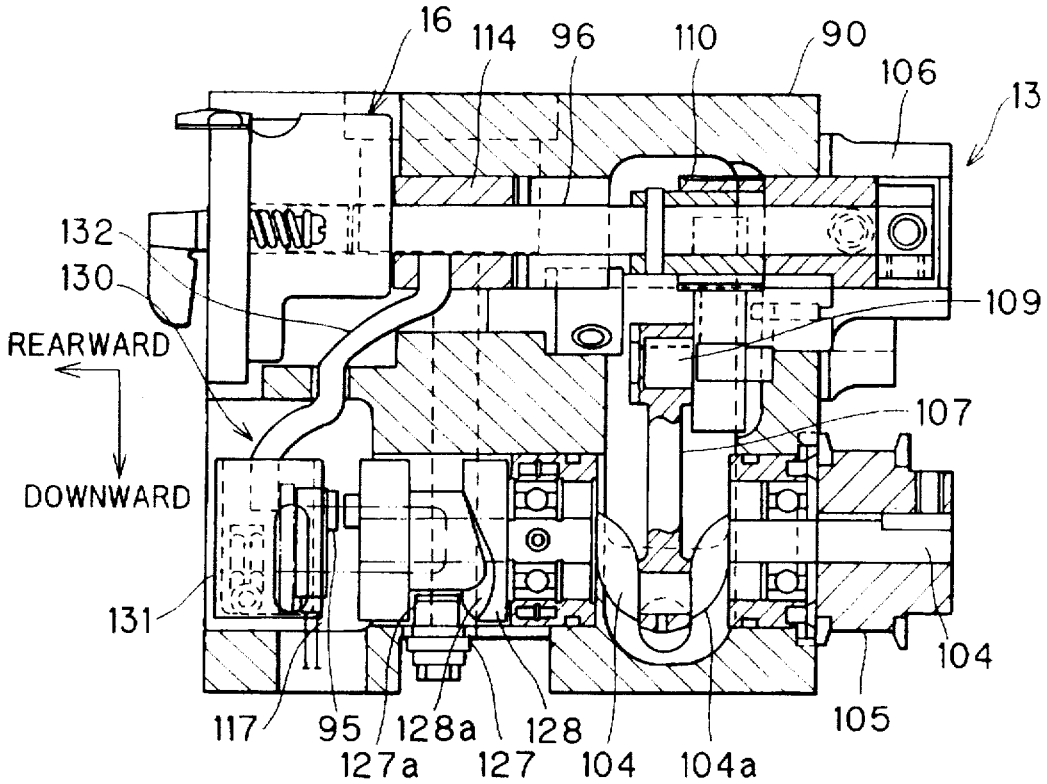
FIG. 16 is a cross-sectional view taken along line XVI–XVI of FIG. 14.
Figure 17:
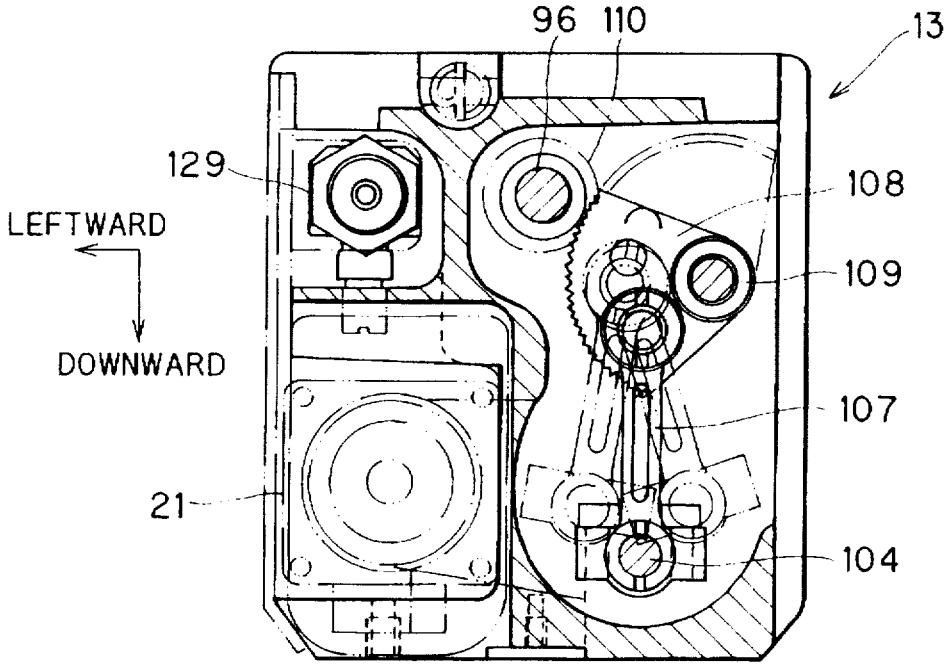
FIG. 17 is a cross-sectional view taken along line XVII–XVII of FIG. 11.

As best seen in FIG. 16, a drive shaft 104 extends through the lower portion of the shuttle module 13 from the front to the rear of the shuttle module 13. A pulley 105 attached to the front tip of the drive shaft 104 and a pulley 106 fixed to the output shaft of the servomotor 21 are connected to move in association by a timing belt 106. As best seen in FIGS. 16 and 17, a sector gear 108 is reciprocally swingably driven around a shaft 109 by a crank rod 107 connected to move in association with a crank portion 104*a* of a drive shaft 104. A gear member 110 disposed on the shuttle shaft 96 is meshingly engaged with the sector gear 108. With this configuration, rotation of the drive shaft 104 drives the sector gear 108 to reciprocally pivot. The gear member 110 integrally reciprocally rotates with pivoting movement of the sector gear 108 so that the driver 97 of the half rotation shuttle 16 is driven to reciprocally rotate.

Figure 12:
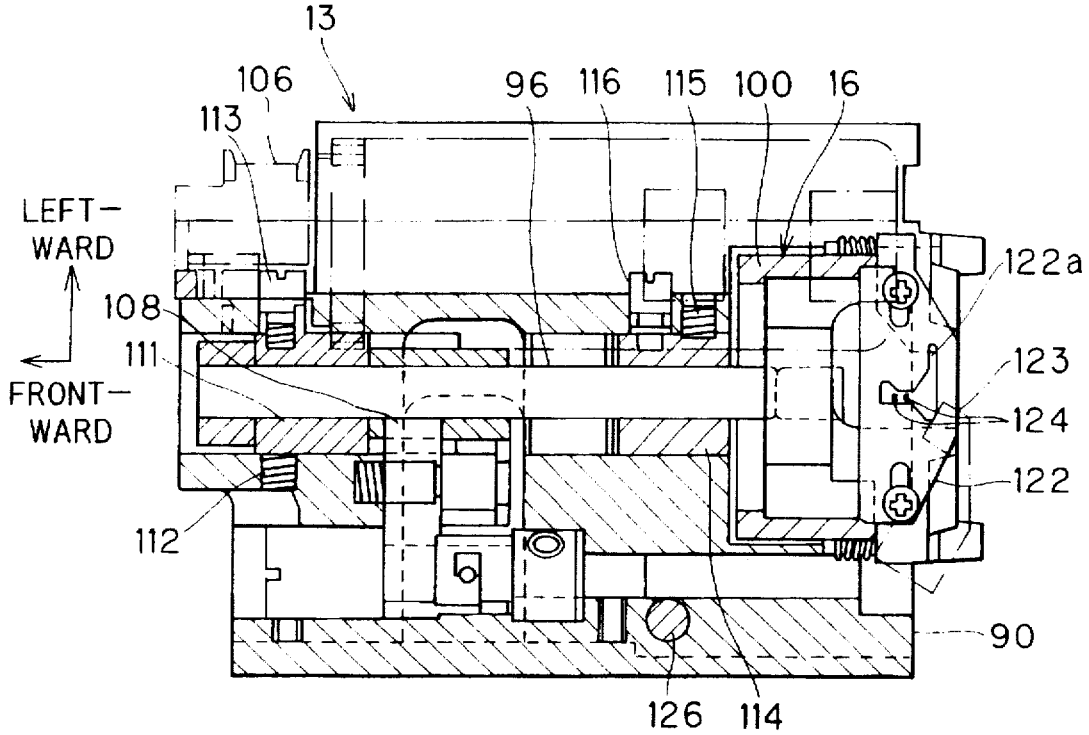
FIG. 12 is a cross-sectional view taken along line XII–XII of FIG. 13.

As shown in FIG. 12, the position of the shuttle shaft 96 in its axial direction is set by a collar 111, that is detachably mounted with the shuttle shaft 96 and that is fixed to the housing 90 by a screw 112. In addition, an eccentric screw 113 is provided to enable minute adjustment in the axial position of the shuttle shaft 96. By loosening the screw 112, the axial position of the shuttle shaft 96 can be adjusted by rotating the eccentric screw 113. A sleeve body 114 fitted around the shuttle shaft 96 is attached to the shuttle body 100 and fixed to the housing 90 by a screw 115. An eccentric screw 116 is provided to enable minute adjustment in the axial position of the large shuttle body 100. By loosening the screw 115, the axial position of the large shuttle body 100 can be adjusted by rotating the eccentric screw 116.

Figure 11:
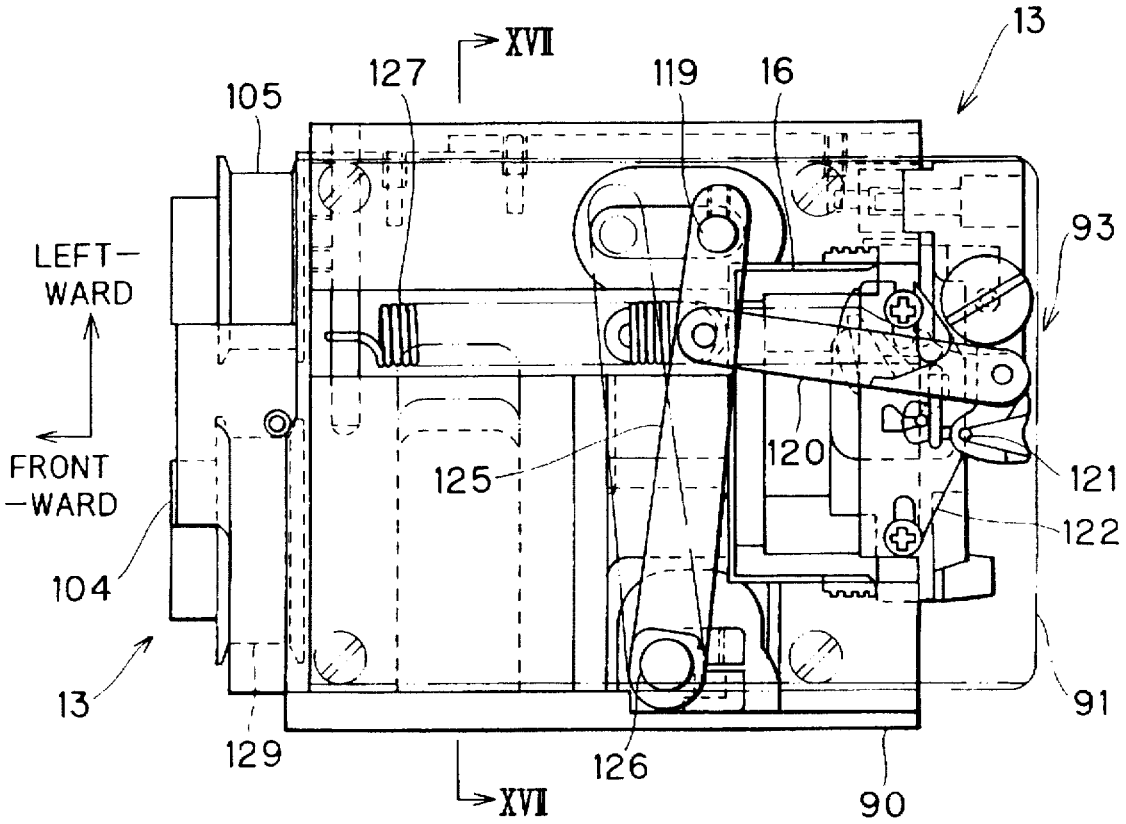
FIG. 11 is a plan view showing the shuttle module of the bed portion.

As shown in FIGS. 11 and 12, the thread cutting mechanism 93 includes: a mobile blade 121 of a mobile blade member 120 disposed below the needle plate 91; a fixed blade 123 fixed to the lower surface of the needle plate 91; and a thread guide plate 122 disposed beneath the blades 121, 123. The needle and bobbin threads 124 extending downward from the workpiece cloth through a guide hole 122*a* of the thread guide plate 122 and a needle hole of the needle plate 91 are cut by cooperative operation of the mobile blade 121, the fixed blade 123, and the thread guide plate 122. The front tip of the mobile blade member 120 is connected to a midway portion of a link plate 125. A right tip of the link plate 125 is freely rotatably connected to the housing 90 via a connection rod 126. The link plate 125 is swingable between a release position indicated by the solid line in FIG. 11 and an operation position indicated by a two-dot chain line in FIG. 11.

Figure 13:
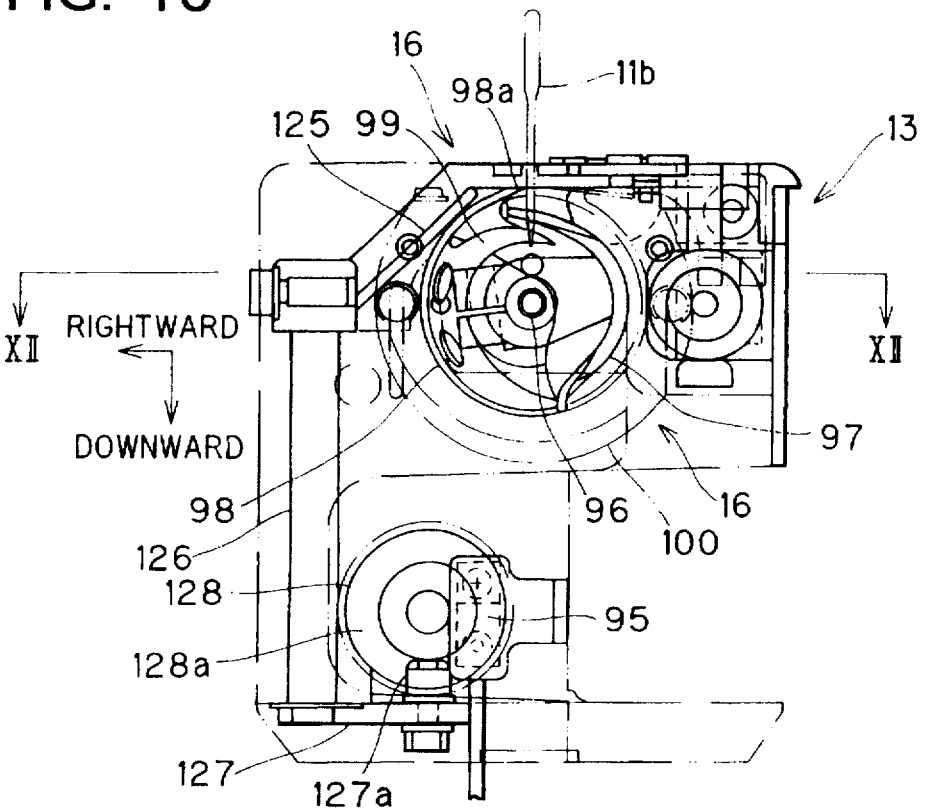
FIG. 13 is a rear view partially in phantom showing the shuttle module.

The link plate 125 is urged into the operation position by a pulling spring 127. From this condition, the link plate 125 is driven by drive force of the drive shaft 104 to cut the threads at a predetermined timing. The drive force of the drive shaft 104 is transmitted to the link plate 125 by the following configuration. As best seen in FIG. 13, the upper tip of the connection rod 126 is fixed to the right tip of the link plate 125. The lower tip of the connection rod 126 is fixed to the right tip of an arm member 127. A cam engagement ring 127*a* at the left tip of the arm member 127 is capable of abutting a cam surface 128*a* of a cam body 128 attached to the drive shaft 104.

The link plate 125 is switched from its release position to its operation position by an air cylinder 129 disposed in the cylinder housing indentation 102. As best shown in FIGS. 11 and 15, a rod 119 is connected to the left tip of the link plate 125 and depends downward. A nut member 129*b* at the tip of a rod 129*a* of the cylinder 129 presses against the rod 119 in order to maintain the link plate 125 in its release position. At a predetermined thread cut timing, the urging force of the air cylinder 129 is released, whereupon the link plate 125 is switched into its operation position by urging force of the pulling spring 127. Then, as shown in FIGS. 13 and 16, the cam engagement ring 127*a* abuts the cam surface 128*a* so that the link plate 125 operates according to the shape of the cam surface 128*a* via the connection rod 126, to cut the thread. Directly afterward, the air cylinder 129 is switched so that the link plate 125 returns to its released position. Although not shown in the drawings, a thread cutting valve of an air supply system for supplying air to the air cylinder 129 is controlled by the control unit 140. If for some reason, movement of the shuttle is stopped directly before a thread is to be cut, the link plate 125 is returned to its release position by the air cylinder 129 so that the thread cutting process is terminated. It should be noted that a solenoid can be used instead of the air cylinder 129.

Next, an explanation will be provided for the lubrication supply mechanism 130. As shown in FIG. 16, an oil tank 131 is provided in an indentation portion 117 formed in the housing 90 at the front side of the drive shaft 104. A wick 132 for supplying oil from the oil tank 131 to sliding portions between the sleeve body 114 and the shuttle shaft 96 extends from the oil tank 131 to a hole formed in the sleeve body 114.

The following is an explanation of operations of the two-needle sewing machine 1. The oscillating shuttle 16, the servomotor 21 for driving the oscillating shuttle 16 independently from the principal shaft 6, and the drive transmission system are formed into a unit in the shuttle module 13. Because the shuttle module 13 is detachably provided to the two-needle sewing machine 1, the drive system can be simplified and made more compact than if the oscillating shuttle 16 were driven by the principal shaft 6. The oscillating shuttle 15 which is nearest the column portion 3 of the two-needle sewing machine 1 is configured to be driven by drive force of the principal shaft 6. Therefore, the oscillating shuttle 15 can be driven by a drive system using a relatively simple configuration. Also, a servomotor need not be provided for the oscillating shuttle 15 so that the two-needle sewing machine 1 is less expensive to produce.

When the shuttle module 13 is switched from its usage position, which is at a 45 degree angle horizontal from its retracted position, the front portion of the oscillating shuttle 15 and the rear portion of the oscillating shuttle 16 are exposed so that the replacement of the bobbins in the oscillating shuttles 15, 16 and removal of tangled threads can be more efficiently performed.

Further, the minute movement mechanism 56 for moving the shuttle module 13 slightly frontward and rearward enables the position of the oscillating shuttle 15 to be automatically minutely adjusted frontward and rearward. As a result, adjustment of the distance between the two shuttles can be easily adjusted to match adjustments in the distance between the needles. Also, the positional relationship between the sewing needle **11*b* and the loop seizing beak 98*a* of the oscillating shuttle 15 can be adjusted by the minute movement mechanism 56. Because the shuttle module 13 is provided in an integral unit, assembly of the sewing machine and its operation can be performed more efficiently. When one of the mechanisms or components in the shuttle module 13 becomes defective or breaks down, the shuttle module 13 can be easily detached from the pivot frame 57 and repaired. Also, the shuttle module 13** can be used with a variety of different types of sewing machines so that design and production costs of each of the different types of sewing machines can be reduced.

Because the thread cutting mechanism 93 is in the shuttle module 13, the thread can be automatically cut by operating the air cylinder 129 by commands from the control unit 140. As a result, sewing operations can be more efficiently performed. Also, because the oil supply mechanism 130 has a simple configuration for supplying oil to the sliding portions of the shuttle shaft 91 within the shuttle module 13, there is no need to manually oil the sliding portions. Oil will never run out so that high reliability can be maintained.

Figure 20:
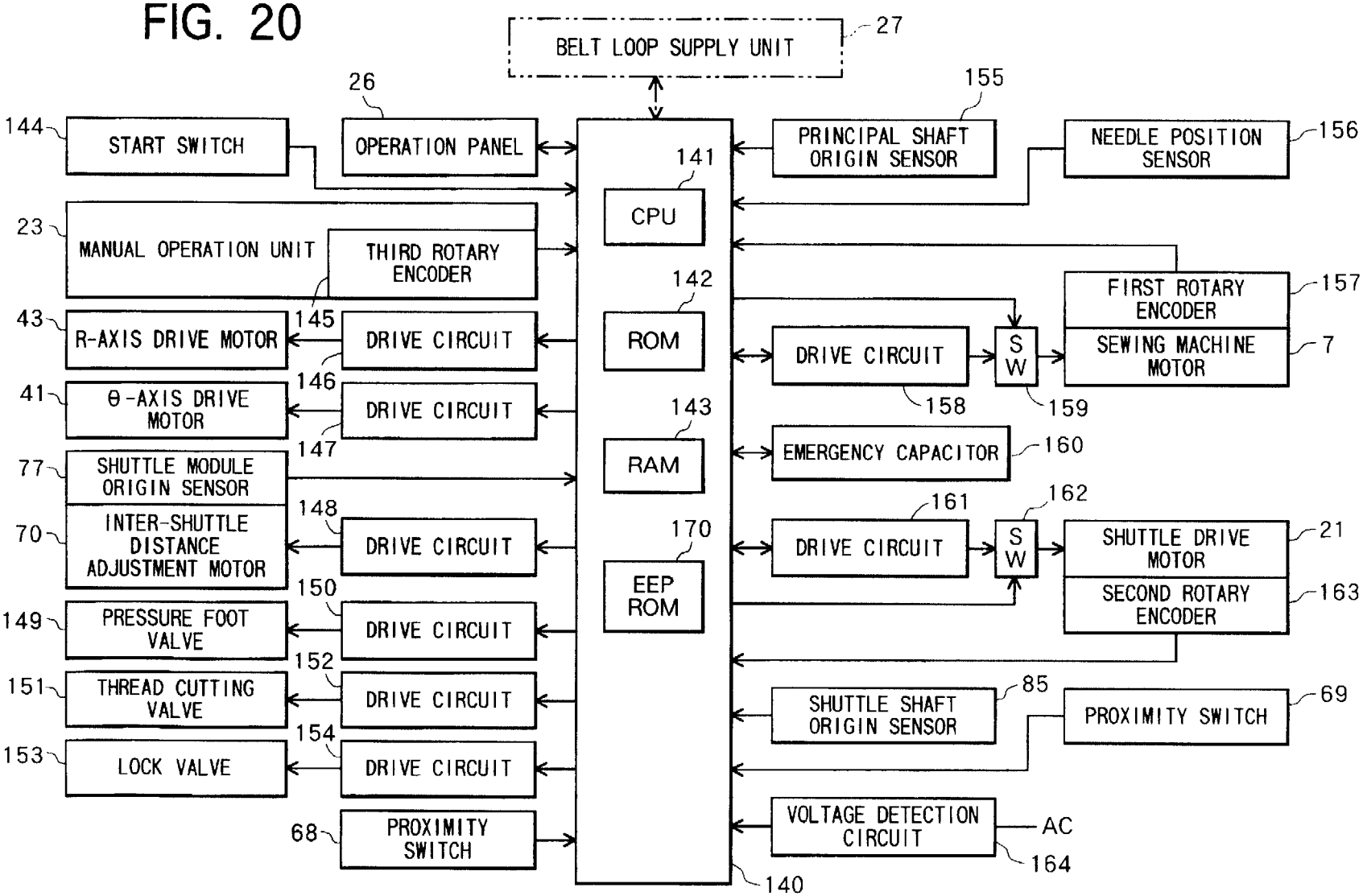
FIG. 20 is a block diagram schematically showing a control system of the two-needle sewing machine of the first embodiment.

Next, an explanation will be provided for the essential portions of the control system provided in the control unit 22 of the two-needle sewing machine 1 while referring the block diagram in FIG. 20.

The control unit 140 of the two-needle sewing machine 1 includes a macro computer having a CPU 141, a ROM 142, a RAM 143, and an EEPROM 170. Although, not shown in the drawings, the control unit 140 also includes an input interface and an output interface connected to the micro computer via a data bus or other type of bus. A variety of components are connected to the input interface of the control unit 140 including a start switch 141; an operation pedal 26; a third rotary encoder 145 of a manual operation unit 23; an origin sensor 77 provided to an inter-shuttle distance adjustment motor 70; a proximity switch 68 for detecting a release position of the lock pin 63; a principal shaft origin sensor 155; a needle position sensor 156; a first rotary encoder 157 provided to the sewing machine motor 7; a second rotary encoder 163 provided to the shuttle drive motor 21; a shuttle shaft origin sensor 85; a proximity switch 69 for detecting position of the pivot frame 57; and a voltage detection circuit 164 for detecting the voltage of an AC source. Signals from those components are supplied to the input interface.

The output interface supplies drive signals and drive pulse signals to the control unit 140 from a variety of components including the operation panel 26; a drive circuit 146 for driving the R-axis drive motor 43; a drive circuit 147 for driving the θ-axis drive motor 41; a drive circuit 148 for driving the inter-shuttle distance adjustment motor 70; a drive circuit 150 for driving a pressing valve 149 for operating the pressing operations of the air cylinders **35*a*, 35*b*; a drive circuit 152 for driving a thread cutting valve 151, which drives the thread cutting cylinder 129; a drive circuit 154 for driving a lock valve 153, which is for driving the air cylinder 63; a drive circuit 158 for driving the sewing machine motor 7; and a drive circuit 161 for driving the shuttle drive motor 21. A switch 159 is provided for interrupting drive current between the sewing machine motor 7 and the drive circuit 154. In the same manner, a switch 162 is provided between the shuttle drive motor 21 and the drive circuit 161. In this embodiment, the R axis drive motor 43 and the θ-axis drive motor 41 are stepping motors; the sewing motor 7 and the shuttle drive motor 21 are AC servomotors; and the inter-shuttle distance adjustment motor 70** is a pulse motor.

Figure 21:
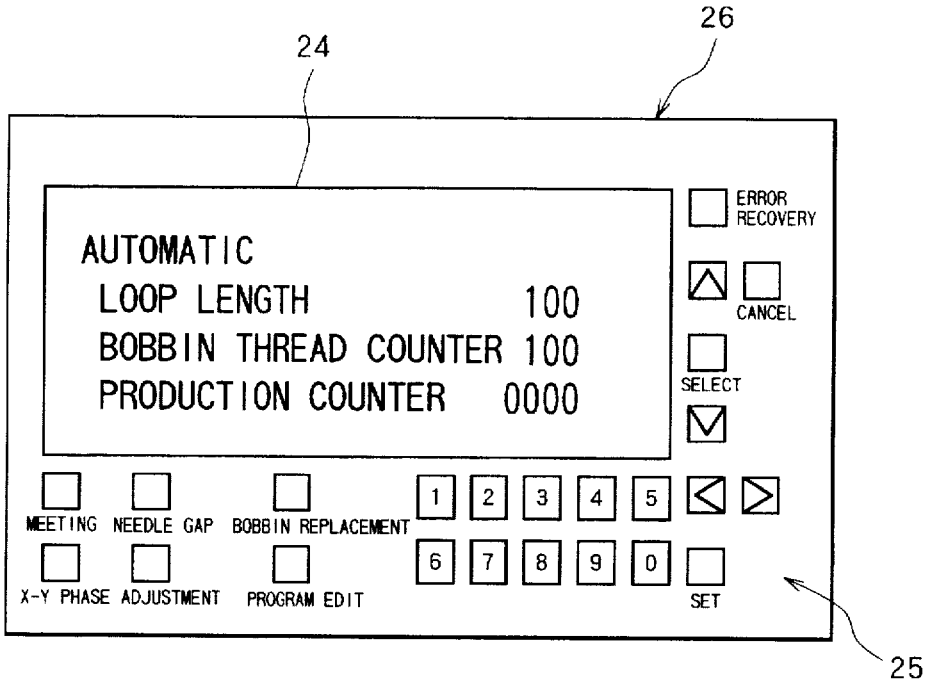
FIG. 21 is a plan view showing an operation panel of the two-needle sewing machine.

As shown in FIG. 21, the operation panel 26 is provided with a large liquid crystal display 24 and a plurality of function switches 25, such as numerical keys for numbers 0 to 9, a meeting switch, an inter-needle distance adjustment switch, a bobbin replacement switch, an X-Y phase adjustment switch, a program edit switch, for displaying on the display 24 a variety of setting screens for setting a variety of setting data.

Figure 22:
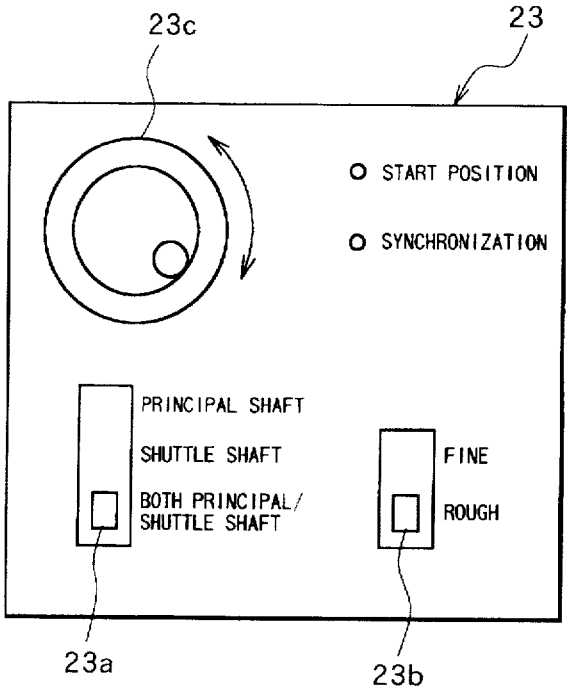
FIG. 22 is a plan view showing a manual operation unit.
Figure 25:
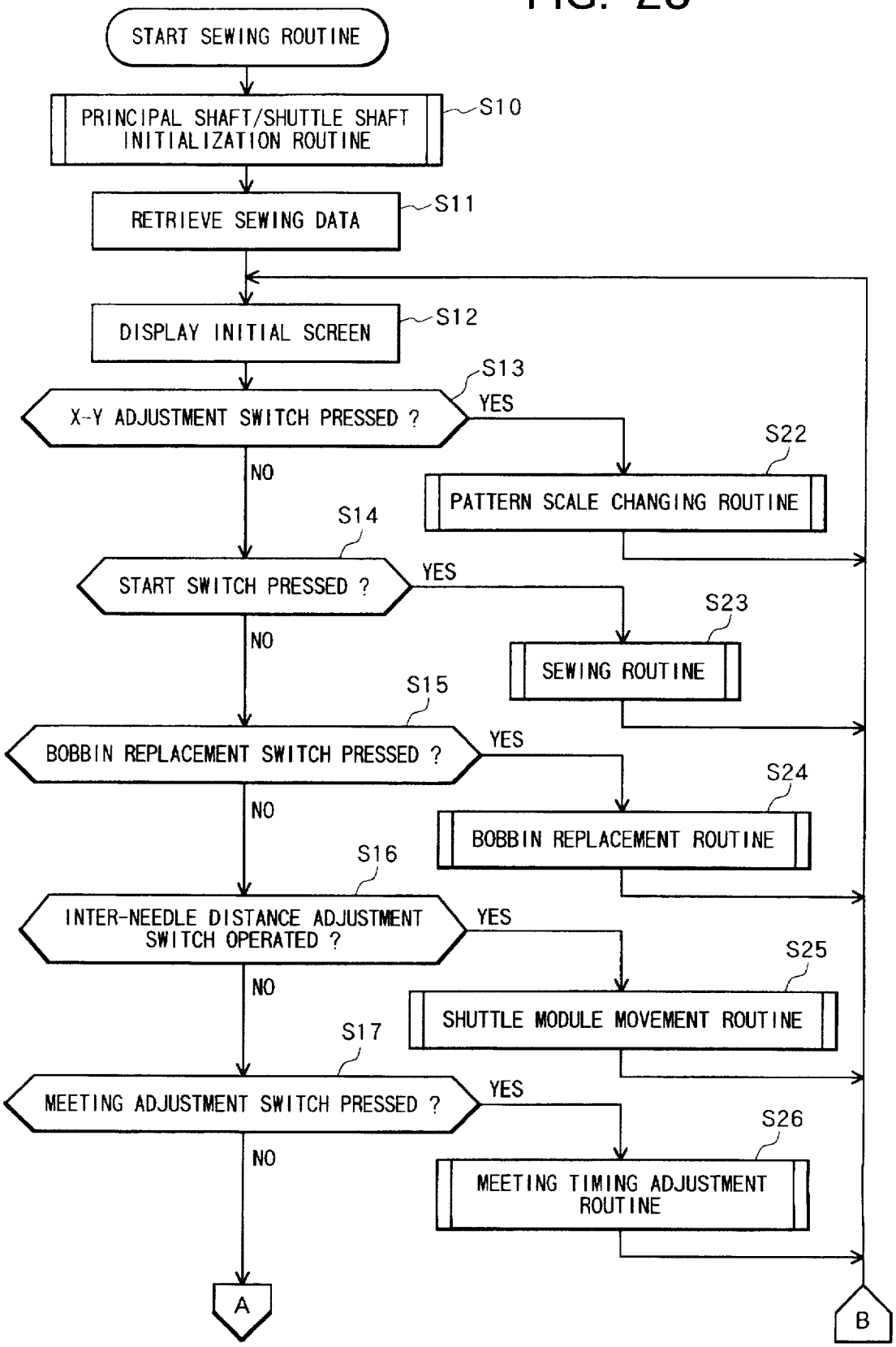
FIG. 25 is a flowchart representing part of a sewing routine according to the present invention.
Figure 26:
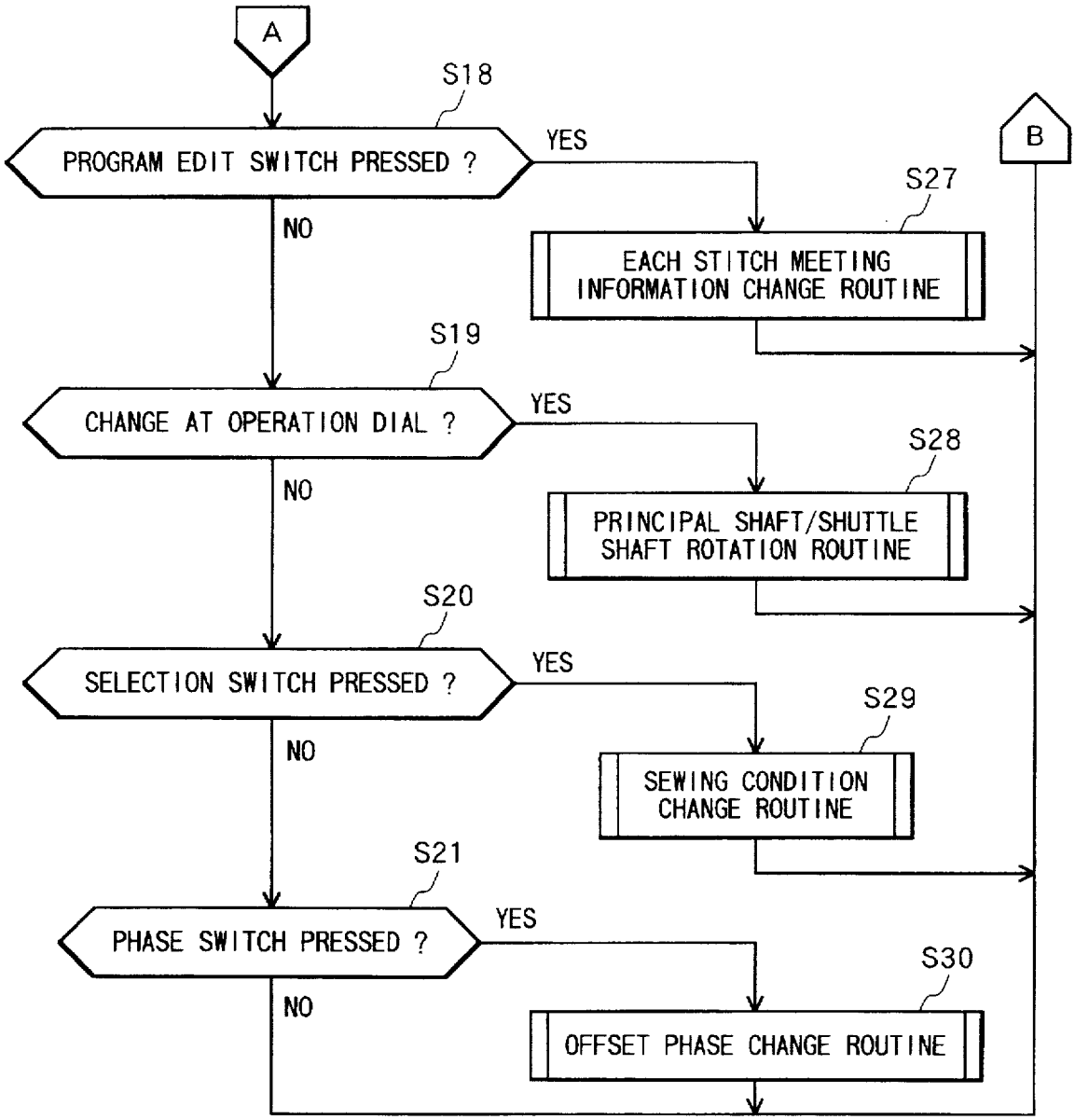
FIG. 26 is a flowchart representing a remainder of the sewing routine.

Next, the manual operation unit 23 will be briefly described while referring to FIG. 22. The manual operation unit 23 is used when sewing operations are stopped to manually pivot either simultaneously or selectively, the sewing machine motor 7, that is, the principal shaft 6, and the shuttle drive motor 21, that is, the shuttle drive shaft 104. The manual operation unit 23 is provided with a drive shaft switching switch **23*a*, an operation sensitivity switch 23*b*, and an operation dial 23*c*. The drive shaft switching switch 23*a* sets the mode to that for driving the sewing machine 7 when switched to the principal shaft position, to that for driving the shuttle drive motor 23 when switched to the shuttle shaft position, and to that for simultaneously driving the sewing machine motor 7 and the shuttle drive motor 21** when switched to the principal/shuttle shaft position.

When the operation dial **23*c* is rotated clockwise, either or both of the motors 7, 21, depending on the setting of the drive shaft switching switch 23*a*, is driven to rotate clockwise. Contrarily, when the operation dial 23*c* is rotated counterclockwise, either or both of the motors 7, 21, depending on the setting of the drive shaft switching switch 23*a* is driven to rotate counterclockwise. The amount that the motors 7, 21 are driven by rotating the operation dial 23*c* depends on the setting of the operation sensitivity switch 23*b*. When the operation sensitivity switch 23*b* is switched to rough, a large operation command value will be outputted for each unit operation amount of the operation dial 23*c*. On the other hand, when the operation sensitivity switch 23*b* is set to fine, a smaller operation command value will be outputted for each unit operation amount of the operation dial 23*c*. The third rotary encoder 145 is attached to the operation dial 23*c* to enable this switch from fine to rough. The third rotary encoder 145 outputs an encoder signal formed from a plurality of pulses according to the operation amount of the operation dial 23*c*. It should be noted that the same function performed by the operation dial 23*c*** can instead be performed by a combination of switches.

Figure 40:
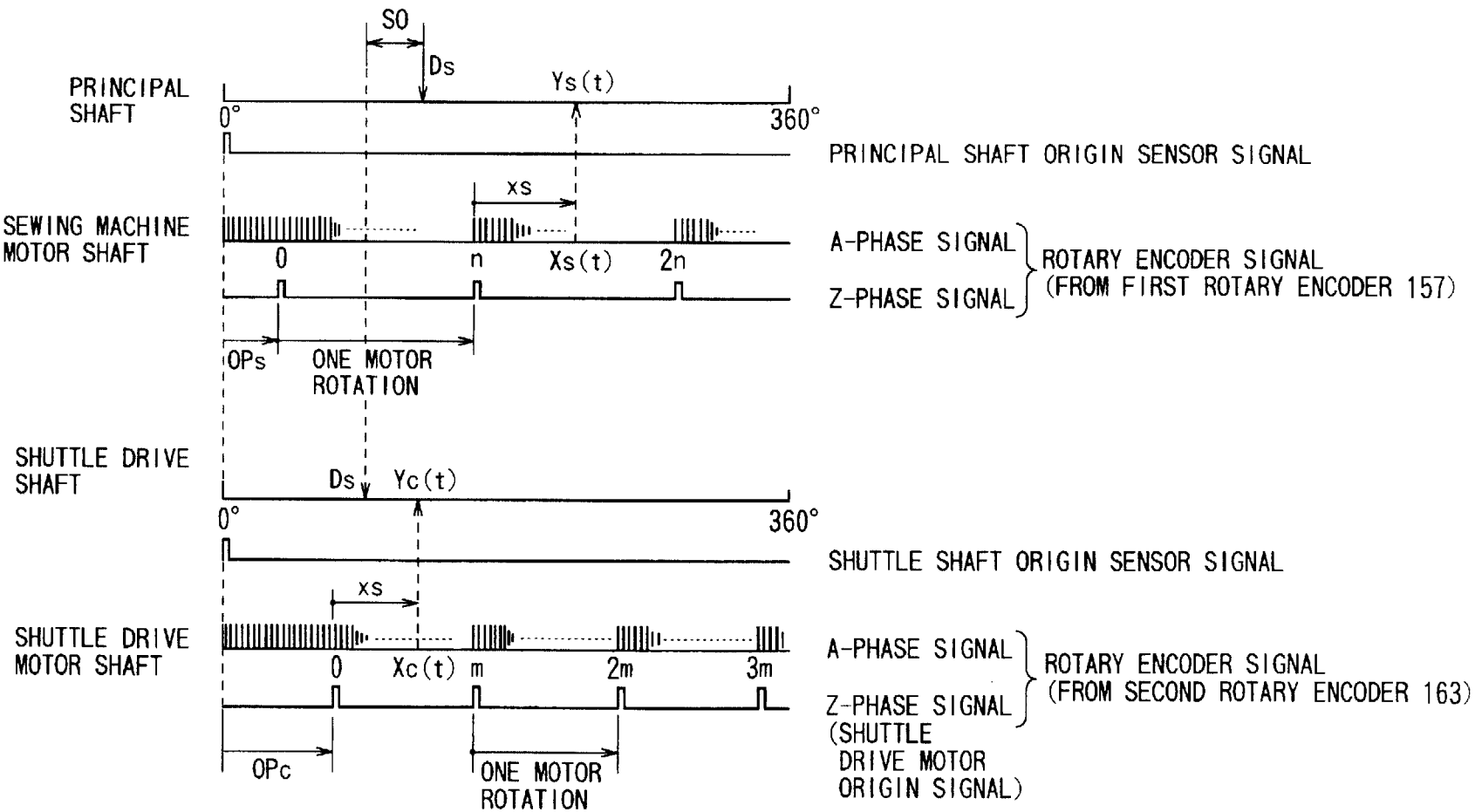
FIG. 40 is a timing chart showing relationship between rotational angles of the principal shaft and the shuttle shaft and corresponding encoder signals.

Next, the needle position sensor 126 will be described. The needle position sensor 126 is a sensor for optically detecting the needle stop phase, that is, the present position of the needle and whether the needle bar 8 is traveling toward the upper dead center position or traveling toward the lower dead center position. The needle position sensor 126 detects a half circle-shaped needle bar detection plate (not shown in the drawings) attached to the principal shaft 6. For example, when the needle bar 8 is traveling from the upper dead center position to the lower dead center position, the needle position sensor 126 outputs a low level needle position signal. Next, is an explanation for the principal shaft origin sensor 155. As shown in FIG. 40, the principal shaft origin sensor 155 outputs a principal shaft origin signal, such as a pulse signal, upon detecting the origin position of the principal shaft 7. For example, the rotational position of 0 degrees corresponds to the uppermost position of the needle.

Next is an explanation for the shuttle shaft origin sensor 85. As shown in FIG. 40, the shuttle shaft origin sensor 85 outputs a shuttle shaft origin signal, such as a pulse signal, upon detecting the origin position of the shuttle shaft 96, or more accurately the origin position of a shuttle drive shaft 104 connected to the shuttle shaft 96. For example, a rotational position of 0 degrees corresponds to the uppermost position of the needle. Next, the first rotary encoder 157 will be described. As shown in FIG. 40, the first rotary encoder 157 outputs a rotary encoder signal formed from a Z-phase signal and an A-phase signal. The Z-phase signal is a pulse signal serving as a motor origin signal to indicate each single rotation of the sewing machine motor 7. The A-phase signal is a clock pulse signal also outputted in accordance with rotation of the sewing machine motor 7. Next is an explanation for the second rotary encoder 163. The second rotary encoder 163 also outputs a rotary encoder signal formed from a Z-phase signal and an A-phase signal. Again, the Z-phase signal is a pulse signal serving as a motor origin signal for indicating each single rotation of the shuttle drive motor 21. The A-phase signal is a clock pulse signal outputted in accordance with rotation of the shuttle drive motor 21.

An emergency capacitor 160, which is constantly being recharged, is connected to the control unit 140. The emergency capacitor 160 has a large capacity and serves as an emergency power source. When the voltage detection circuit 164 detects a power stoppage or a voltage drop in power from the AC power source equal to or greater than a predetermined value, then the emergency capacitor 160 supplies power for the driving motors to the drive circuit 158, 161 and, of course, to the control unit 140. For this purpose, conversion units for converting direct current supplied from the emergency capacitor 160 into alternating current with a predetermined frequency are provided to each of the drive circuit 158, 161. The emergency capacitor 160 has a capacity sufficient for driving the sewing machine motor 7 and the shuttle drive motor 21 for a predetermined duration of time, such as one to ten seconds.

The ROM 142 stores a variety of sewing machine data, a variety of control programs for controlling the two-needle sewing machine 1, and a control program for controlling sewing in a manner unique to the present invention as will be described later. The RAM 143 includes a meeting condition memory **143*a*, an offset adjustment amount memory 143*b***, a meeting timing memory, and a variety of other work memories, buffers, and counters.

As shown in FIG. 23, the meeting condition memory **143*a* stores meeting rotation speeds and meeting rotation positions in correspondence for each of a plurality of stitches included in the sewing data. The meeting rotation speeds shown in FIG. 23 are shown as a ratio comparing the rotational speed of the oscillating shuttle 16 with a reference rotational speed i.e., rotational speed default value, and indicate an amount the rotational speed of the oscillating shuttle 16 is faster or slower than the reference rotational speed when the loop seizing beak 98*a* of the oscillating shuttle 16 meets the sewing needle. Similarly, the meeting rotational positions shown in FIG. 23 indicate an amount the position of the oscillating shuttle 16 is advanced or delayed from a reference rotation position, that is, a rotation position default value, when the loop seizing beak 98*a*** meets the sewing needle.

As shown in FIG. 24, the offset adjustment amount memory **143*b* stores phase offset adjustment amounts for adjusting the amount that the phase of the shuttle 16 is offset from the principal shaft 6 at each one degree rotation position of one 360 degree cycle of the principal shaft 6, one full cycle rotation of the principal shaft 6 resulting in one stitch or one sewing operation. The phase offset adjustment amounts shown in FIG. 24 indicate an amount that the phase of the shuttle 16 is advanced or delayed from a reference phase offset i.e., a reference phase default value for the half rotation shuttle 16**.

The default values for the meeting rotation speed and the meeting rotation position are preset and stored in the meeting condition memory **143*a*. The reference position default values are preset and stored in the offset adjustment memory 143*b*. Further, although not shown in the drawings, each meeting rotational position is set in the meeting timing memory. The meeting rotational positions stored in the meeting timing memory are determined by actually driving the principal shaft 6 and the shuttle shaft 21. The content of these memories is stored in the EEPROM 170 so that when the power is turned on, a predetermined region of the RAM 143** is developed and can be rewritten by a user.

Next, the sewing control routine performed by the control unit 140 of the two-needle sewing machine 1 will be explained based on flowcharts shown in FIGS. 25 through 39. It should be noted that Si (i=10, 11, 12 . . . i) refers to an individual step in the routine.

Figure 27:
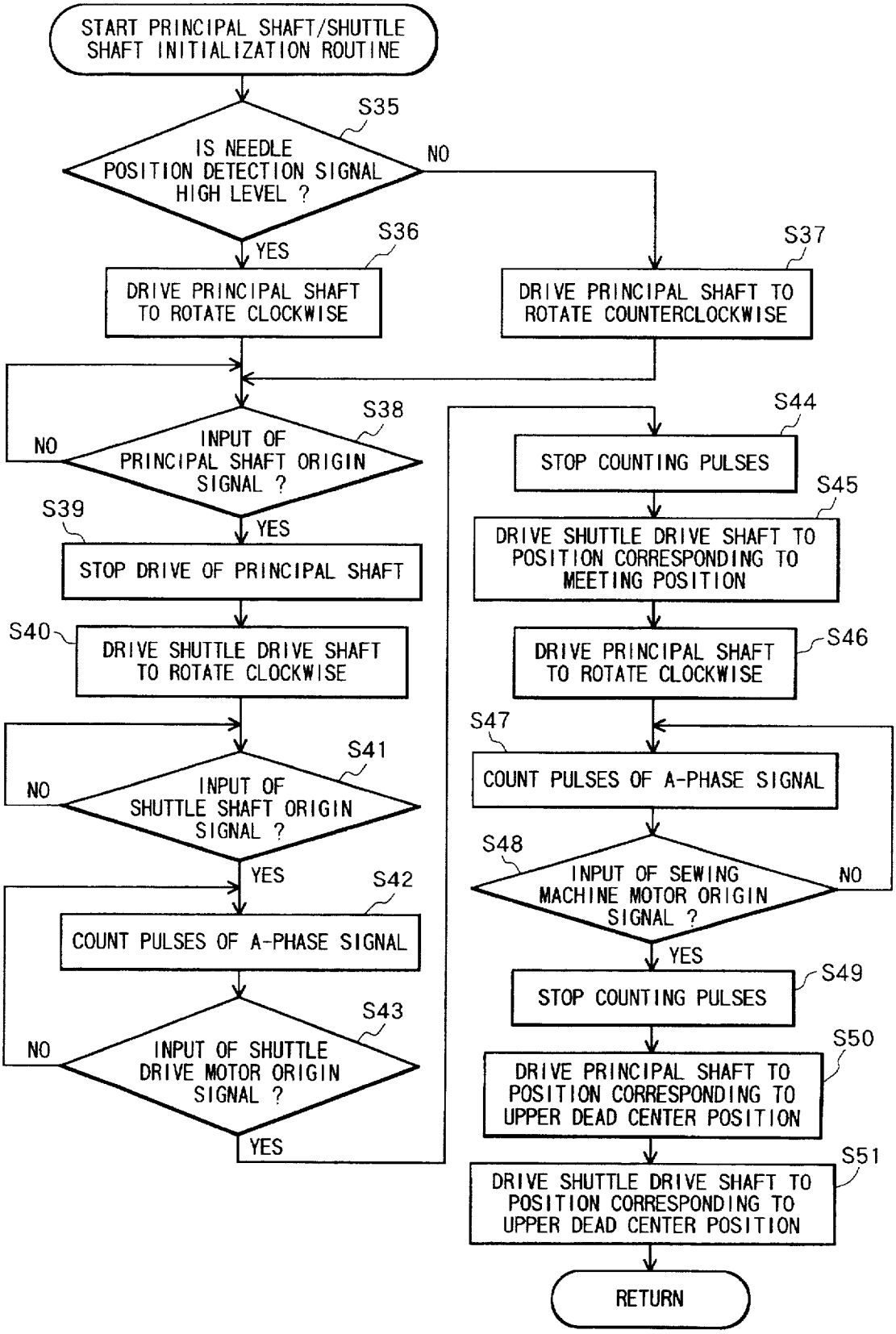
FIG. 27 is a flowchart representing a principal shaft/shuttle shaft initialization routine of the sewing routine.

This routine is started when the power of the two-needle sewing machine 1 is turned on. At this point, a principal shaft/shuttle shaft initialization routine represented by the flowchart in FIG. 27 is executed in S10 to rotate the principal shaft 6 and the shuttle shaft 96 to predetermined initial positions, that is, to their upper dead center positions in this embodiment. When the principal shaft/shuttle shaft initialization routine is started, whether or not the needle position signal from the needle position sensor 156 is at a high level, that is, whether or not the needle bar 8 is traveling from the lower dead center position toward the upper dead center position, is determined in S35. If so (S35:YES), then the sewing machine motor 7 is driven in S36 to rotate clockwise at a low speed so as to drive the principal shaft 6. Then, in S38, it is determined whether or not the needle bar has moved to approximately the upper dead center position directly, that is, without first moving to the lower dead center position, so that the principal shaft origin signal from the principal shaft origin sensor 155 has been inputted. If so (S38:YES), then the counterclockwise rotation of the principal shaft 6 is stopped in S39.

On the other hand, when the needle position signal is at its low level, in other words, when the needle bar 8 is moving toward the lower dead center position from the upper dead center position (S35:NO), then the sewing machine motor 7 is driven in S37 to rotate counterclockwise at a slow speed so as to drive the principal shaft 6 counterclockwise. Then again, when the needle bar 8 moves to approximately the upper dead center position so that the principal shaft origin signal from the principal shaft origin sensor 155 is inputted (S38:YES), then the counterclockwise rotation of the principal shaft 6 is stopped in S39.

Then, the shuttle drive motor 21 is driven to rotate the shuttle drive shaft 104 clockwise at a low speed in S40. When the shuttle shaft origin signal is inputted (S41:YES), the pulses of the A-phase signal are counted in S42 until it is determined in S43 that the motor origin signal, i.e., the Z-phase signal, is inputted from the second rotary encoder 163.

When the shuttle drive motor origin signal is inputted (S43:YES), counting of the pulses in the A-phase signal is stopped in S44. Once the shuttle drive motor origin signal is inputted, the actual position in the shuttle drive motor 21 can be determined according to the count of the A-phase signal. Next, in S45, the shuttle drive motor 21 drives the drive shaft 104 until its rotational position corresponds to a predetermined meeting position where the loop seizing beak 98*a* meets the sewing needle 11*b*. Because the sewing machine motor 7 is driven either clockwise or counterclockwise to move the needle bar 8 to approximately the upper dead center position in S36 through S38, the loop seizing beak 98*a* and the sewing needle 11*b* will not collide, or interfere, with each other. Next, the principal shaft 6 is driven to rotate in the clockwise direction in S46. Again, the pulses of the A-phase signal are counted in S47 until the sewing machine motor origin signal Z-phase signal is detected in S48 as being inputted from the first rotary encoder 157.

When the sewing machine motor origin signal is inputted (S48:YES), then counting of the pulses of the A-phase signal is stopped in S49. Next, the principal shaft is further driven to a position corresponding to the upper dead center position, that is, the needle upper stop position. Then, the drive shaft 104 is driven in S51 to rotate clockwise until it reaches a position corresponding to the upper dead center position. This ends this principal shaft/shuttle drive shaft initialization routine and the program returns to S11 of the sewing routine. In other words, at this point, the needle bar 8 has been initialized to the upper dead center position and the oscillating shuttle 16 has also been initialized to a position corresponding to the upper dead center position.

Figure 28:
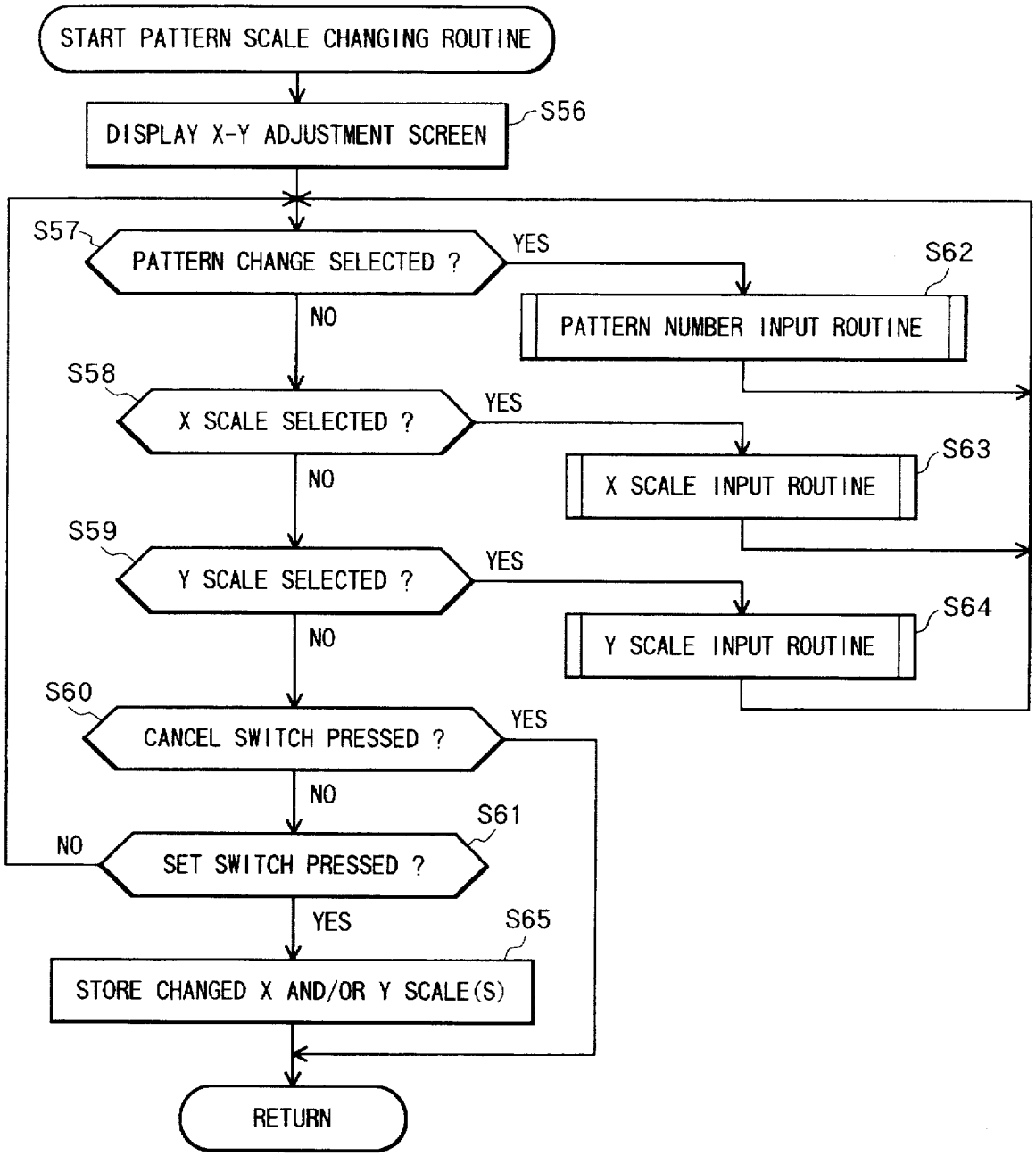
FIG. 28 is a flowchart representing a pattern scale changing routine of the sewing routine.

Next, in S11 of the sewing routine, indicated sewing data is retrieved from the ROM 142 and, in S12, displayed as an initial screen of the display 24. For example, as shown in FIG. 21, a screen indicating a variety of data for automatically sewing, such as data on a loop length and on a bobbin thread counter, are displayed on the display 24. Next, when the X-Y adjustment switch is operated (S13:YES), a pattern scale changing routine represented by the flowchart in FIG. 28 is executed in S22. When this routine is started, first, the X-Y adjustment screen shown in FIG. 53 is displayed in S56.

Figure 53:
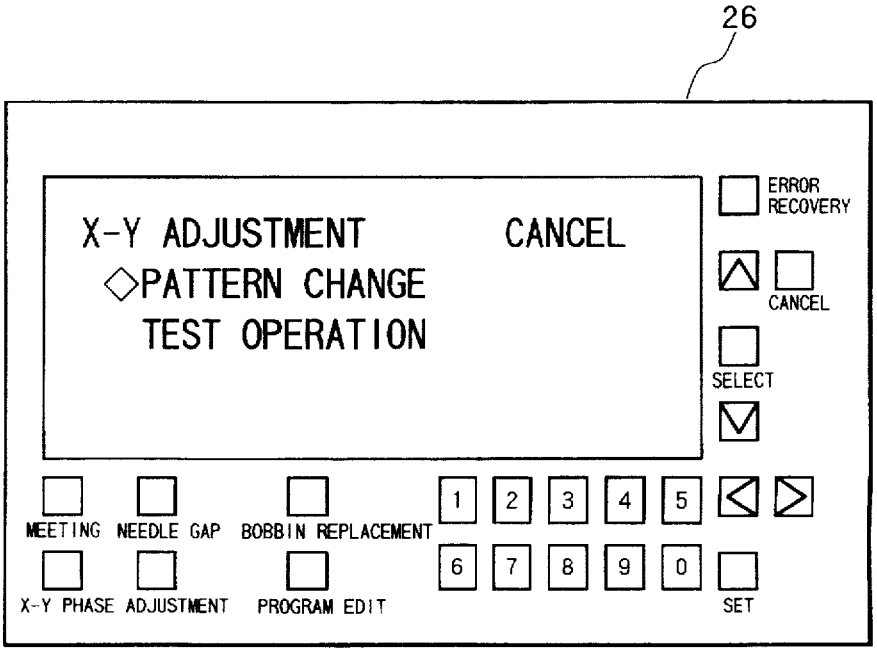
FIG. 53 is a plan view showing the operation panel displaying an example of an X-Y adjustment screen.
Figure 54:
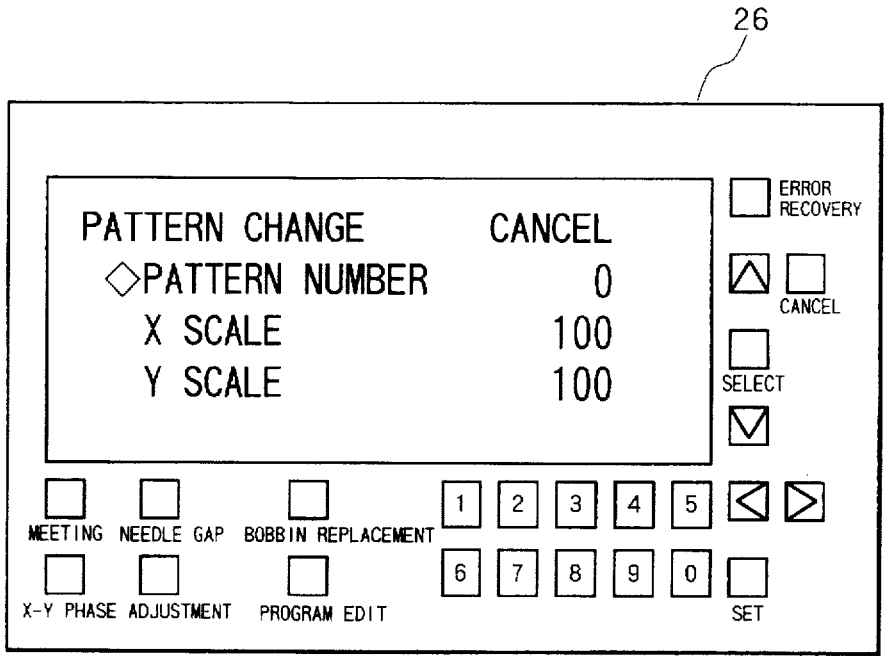
FIG. 54 is a plan view showing the operation panel displaying an example of a pattern change screen.

When pattern change is selected using the block-shaped cursor shown in FIG. 53 (S57:YES), then the setting screen shown in FIG. 54 is displayed and a pattern number input routine for inputting a desired pattern number is executed in S62. Then, the program returns to S57. When the X scale is selected using the block cursor (S57:YES, S58:NO), then the input process for inputting the X scale using the numeric keys is executed in S63 and the program returns to S57. The X scale is the rate at which the pattern to be sewn is to be enlarged or reduced in the X direction. When the Y scale is selected using the block cursor (S57–S58:NO, S59:YES), then the input process for inputting the Y scale using the numeric keys is executed in S64 and afterward the program returns to S57. The Y scale is the rate at which the pattern to be sewn is to be enlarged or reduced in the Y direction. When the cancel switch is operated (S57–S59:NO, S60:YES), then this routine is terminated and the program returns to S12 of the sewing routine. However, when the set switch is operated (S57–S60:NO, S61:YES), then the changed X scale, Y scale data, or both are rewritten in place of the original data and stored in S65.

Figure 29:
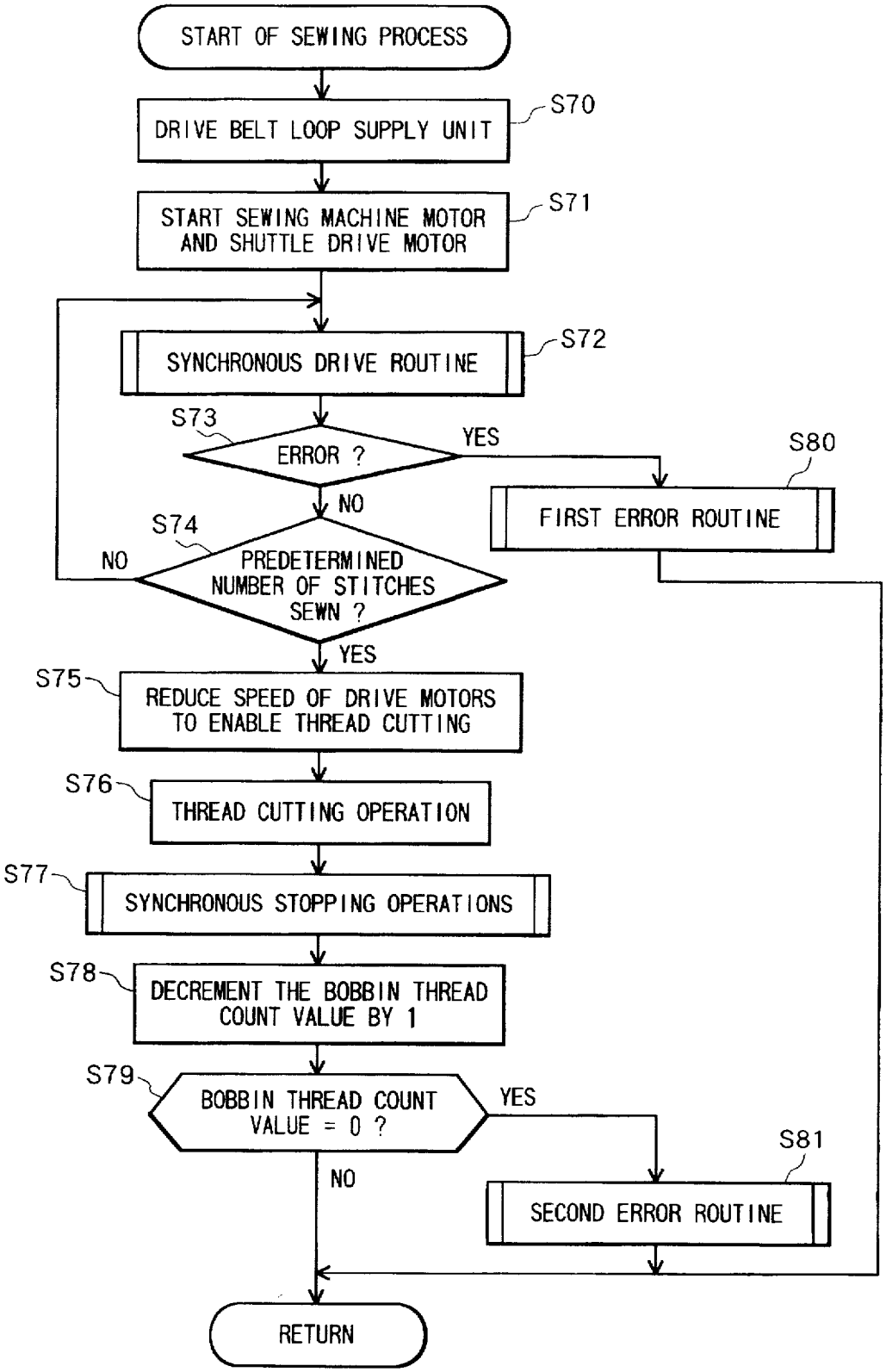
FIG. 29 is a flowchart representing a sewing process of the sewing routine.

When, in the sewing routine, the start switch is operated (S13:NO, S14:YES), then a sewing process represented by the flowchart in FIG. 29 is executed in S23.

Figure 30:
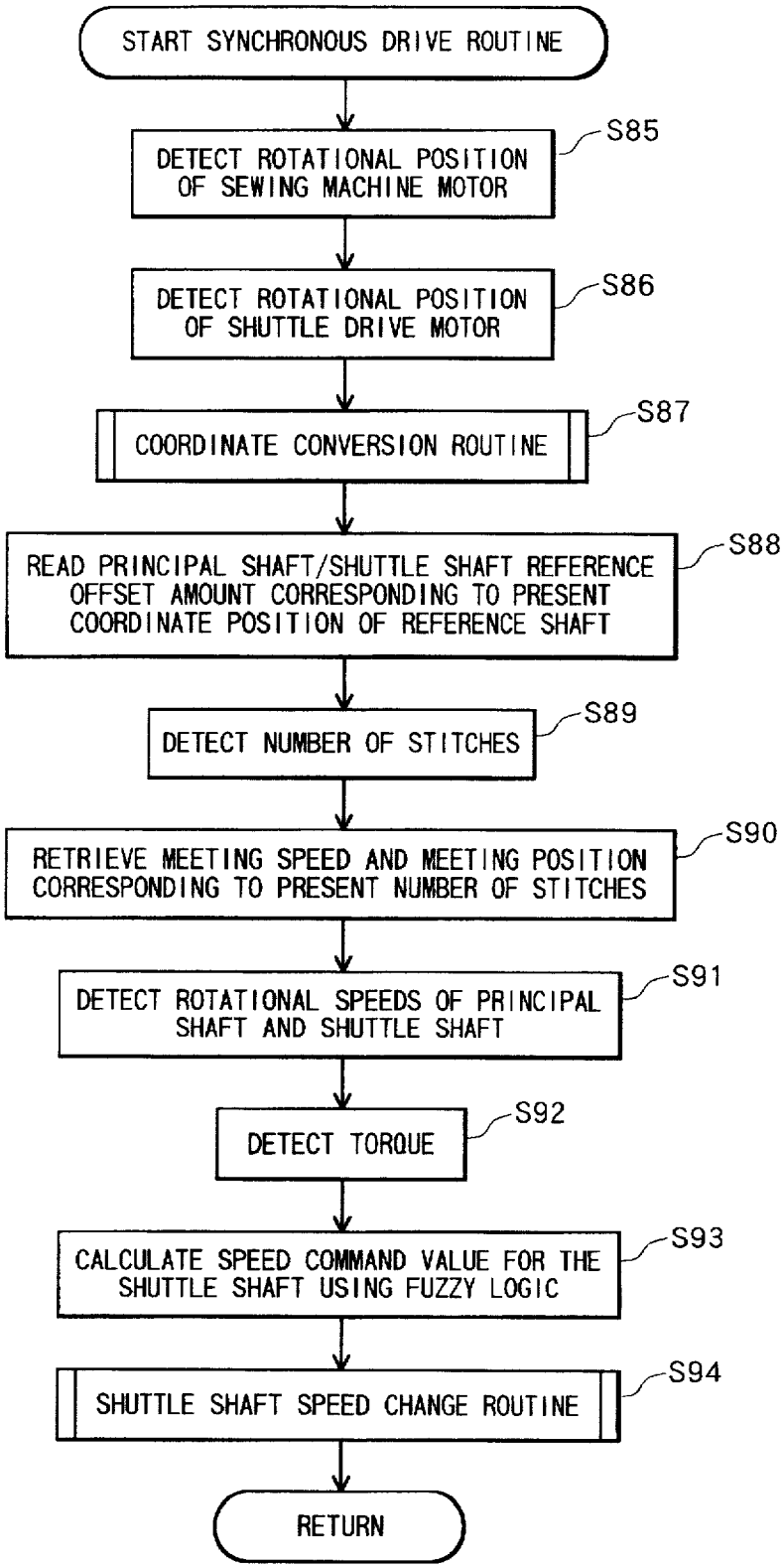
FIG. 30 is a flowchart representing a synchronous drive routine of the sewing process.

At start of this process, the belt loop supply unit 27 is driven in S70. Then, operation of the sewing machine motor 7 and the shuttle drive motor 21 is started in S71. Next, in S72, a synchronous drive routine represented by the flowchart in FIG. 30 is executed for controlling synchronously drive of the principal shaft 6 and the drive shaft 14.

At the start of this routine, the present rotational position of the sewing motor 7 is detected in S85 based on the Z-phase signal and on a count value obtained by counting pulses of the A-phase signal from the first rotary encoder 157. Then in S86, the present rotational position of the drive shaft 104 is detected based of counter values obtained by the Z-phase signal and the A-phase signal from the second rotary encoder 163.

Next, a coordinate conversion routine is executed in S87 to determine the rotational position of the principal shaft 6 and the rotational position of the drive shaft 104 based on pulse count values obtained by counting the A-phase signals from the first and second rotary encoders 157, 163. In essence, during the coordinate conversion routine, the rotational position of the sewing machine motor 7 is converted into the rotational position of the principal shaft 6, and the rotational position of the shuttle drive shaft motor is converted into the rotational position of the drive shaft 104.

The coordinate conversion routine will be described while referring to FIG. 40. It will be assumed that the principal shaft 6, which is not controlled to rotate in synchronization, serves as the reference shaft and the drive shaft 104, which is controlled to rotate in synchronization, serves as the control shaft. Also, the sewing machine is configured so that each time the principal shaft 6 turns $\alpha$ times, the drive shaft 104 turns $\beta$ times. In other words, the principal shaft 6 and the drive shaft 10 do not rotate in a one-to-one correspondence.

Referring to FIG. 40, when time t is started (i.e., t=0) at the point that the machine motor origin signal (the Z-phase signal) is first inputted after input of the principal shaft origin sensor signal, then the rotational position Ys(t) of the principal shaft 6 can be detected based on a number of pulses Xs(t) counted from t=0. The number of pulses Xs(t) can be determined using the following formula:

$$Xs(t)=n\times Ns+xs$$

wherein:

n is the total number of pulses in the A-phase signal during one full turn of the sewing machine motor 7;

Ns is the number of full rotations of the sewing machine motor 7 from when t=0; and xs is the remaining number of pulses not already counted in a full rotation of the sewing machine motor 7.

In the example shown in FIG. 40, Xs(t)=n+xs because Ns equals one.

Similarly, when time t is started (i.e., t=0) at the point that the shuttle drive motor origin signal (the Z-phase signal) is first inputted after input of the shuttle shaft origin sensor signal, then the rotational position Yc(t) of the shuttle drive shaft 104 can be detected based on a number of pulses Xc(t) counted from t=0. The number of pulses Xc(t) can be determined using the following formula:

$$Xc(t)=m\times Nc+xc$$

wherein:

m is the total number of pulses in the A-phase signal during one full turn of the shuttle drive motor 21;

Nc is the number of full rotations of the shuttle drive motor 21 from when t=0; and xc is the remaining number of pulses not counted in a full rotation of the shuttle drive motor 21.

In the example shown in FIG. 40, Xc(t)=xc because Nc equals zero.

The rotational position Ys(t)of the principal shaft 6 can be represented by the following formula:

$$Ys(t)=(Ops+Xs(t))\times Ps=(Ops+n\times Ns+xs)\times Ps[deg]$$

wherein:

Ps (deg/pis) is a rotational degree of the principal shaft 6 corresponding to a single pulse of the A-phase signal from the first rotary encoder 157; and OPs is the number of pulses counted from when the principal shaft origin signal is first inputted until the initial sewing machine motor origin signal, that is, the Z-phase signal, is inputted.

Similarly, the rotational position Yc(t)of the shuttle drive shaft 21 can be represented by the following formula:

$$Yc(t)=(Opc+Xc(t))\times Pc=(Opc+m\times NC+xc)\times Pc[deg]$$

wherein:

Pc(deg/pis) is the rotational degree of the drive shaft 104 corresponding to a single pulse of the A-phase signal from the second rotary encoder 163; and OPc is the number of pulses counted from when the shuttle shaft origin signal is first inputted until the initial shuttle drive motor origin signal, that is, the Z-phase signal, is inputted.

Next, the principal shaft/shuttle shaft reference offset value for the present position of the principal shaft 6, which serves as the reference shaft, is retrieved in S88 from the offset adjustment amount memory **143*b* of the RAM 143. Then, the stitch number of the present stitch is detected in S89 and the meeting position and meeting speed data corresponding to the present number of stitches is retrieved in S90 from the meeting condition memory 143*a* of the RAM 143. Although the set values for the meeting speed and meeting position are preset for each number of stitches, the set values can rewritten in the meeting condition memory 143*a* and also stored in the EEPROM 170 during an each stitch meeting information change routine performed in S27** to be described later.

Next, in S91, the rotation speed of the principal shaft 6 is detected based on the A-phase signal from the first rotary encoder 157 and the rotational speed of the drive shaft 104 is detected based on the A-phase signal from the second rotary encoder 163. Values outputted from drive circuits 150,161 to the CPU 141 correspond to the drive current of the motors 7,21. Because the torque is proportional to the current of the motors 7,21, in S92, the torque of the sewing machine motor 7 is determined based on the drive current of the drive circuit 150 and the torque of the shuttle motor 21 is determined based on the drive current of the drive circuit 161. In S93, a speed command value to be sent to the shuttle shaft 96 is calculated by fuzzy logic.

Next, an explanation will be provided for calculation of the speed command value control executed using fuzzy logic. The reference offset amount SO can be represented by the following formula:

$$SO=(Ds-Dc)$$

wherein:

Ds is the reference meeting position of the principal shaft 6; and

Dc is the reference meeting position of the drive shaft 104.

Figure 41:
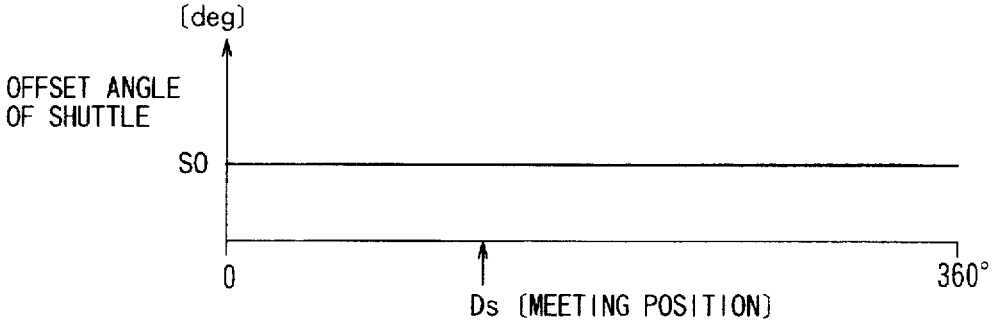
FIG. 41 is a graphical representation of a relationship between an offset angle of the shuttle and a rotational position of the shuttle when shuttle speed and position remain stable.

When the principal shaft 6 and the drive shaft 104 are being driven to rotate in synchronization, then they maintain their positional relationship as shown in FIG. 41. However, a shift amount Z between the principal shaft 6 and the drive shaft 104 at any particular time t can be represented by the following formula:

$$Z=|\,|Ys(t)-Yc(t)\,|-SO|\,[deg]$$

Figure 42:
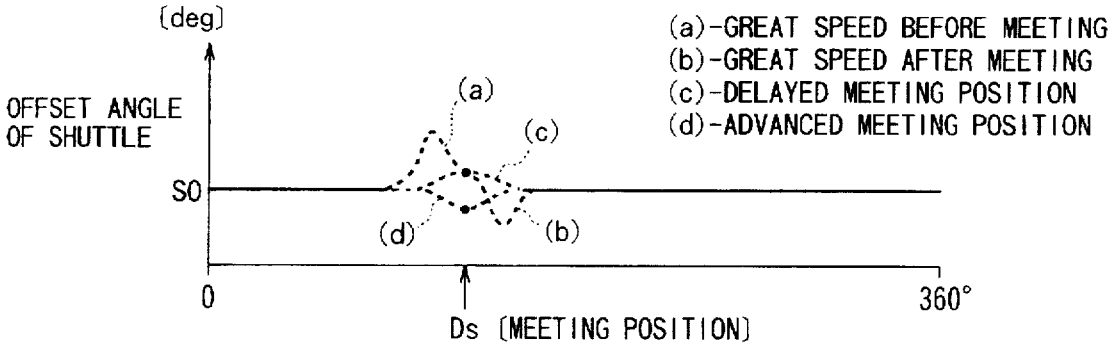
FIG. 42 is a graphical representation of the relationship between the offset angle and the rotational position of the shuttle when shuttle speed and position change.

For example, when SO, Ys(t)−Yc(t), Ys(t)−Yc(t)−SO are all greater than zero, then the rotational position of the shuttle shaft 96 is at a phase delayed by Z degrees from synchronous drive. That is to say, as shown in FIG. 42, the reference offset amount SO can be optionally changed at the shuttle shaft 96 side with respect to the reference meeting position of the principal shaft 6 by speeding up or delaying timing of the meeting at the rotation position or the meeting speed can be optionally changed.

Next, an explanation of the fuzzy control rules (1) through (6) stored preset in the ROM 142 and the like will be explained.

First, it will be assumed that the fuzzy set labels used in the fuzzy control rules are:

PB represents very large, near, or fast;

PS represents slightly large, near, or fast;

ZO represents zero;

NS represents slightly small, far, or slow; and

NB represents very small, far, or small.

The fuzzy control rules are:

(1) When the shift amount Z, that is, the rotational position of the drive shaft 104, that is, the shuttle shaft 96, is advanced (PS, PB), then the rotational speed of the shuttle shaft 96 is slowed down (NS, NB).

(2) When the rotational position of the shuttle shaft 96 is delayed (NS, NB), then the rotational speed of the shuttle shaft 96 is sped up (PS, PB).

(3) When the rotational position of the shuttle shaft 96 is slightly ahead (PS) and when the present rotational speed is very fast (PB), then the rotational speed of the shuttle shaft 96 is slowed down a slight amount (NS).

(4) When the rotational position of the shuttle shaft 96 is slightly delayed (NS) and the present rotational speed is very fast (PB), then the rotational speed of the shuttle shaft 96 is slowed down a slight amount (PS).

(5) When the rotational position of the shuttle shaft 96 is very advanced (PB) and the reference offset amount at the present rotational position of the shuttle shaft 96 is large (PB), then the rotational speed of the shuttle shaft 96 is greatly sped up (PB).

(6) When the rotational position of the shuttle shaft 96 is slightly delayed (NS), the present rotational position of the shuttle shaft 96 is very near the meeting position (ZO), and the set meeting speed is very fast (PB), then the rotational speed of the shuttle shaft 96 is greatly sped up (PB).

Next, membership functions M1 to M6 preset in the ROM 142 and the like for use with various physical amounts such as rotational speeds of the principal shaft 6 and the shuttle shaft 96 will be explained while referring to FIGS. 43 through 48.

Figure 43:
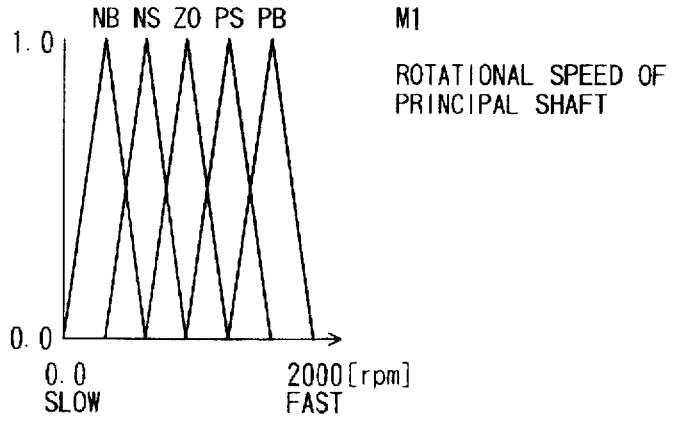
FIG. 43 is a graphical representation of a membership function relating to rotational speed of the principal shaft.
Figure 44:
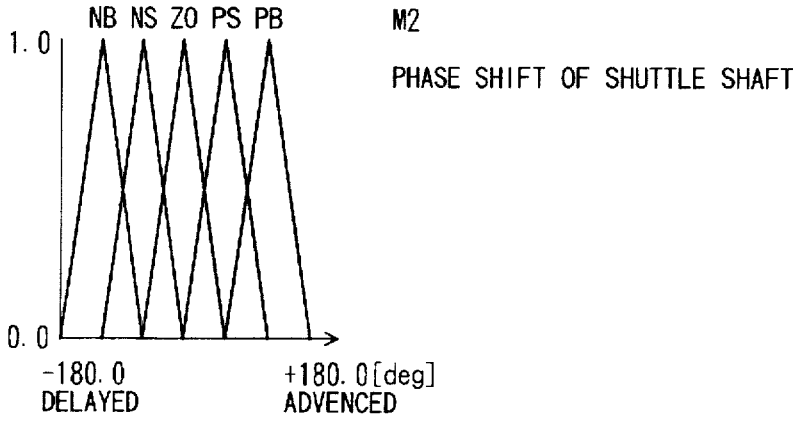
FIG. 44 is a graphical representation of a membership function relating to phase shift of the shuttle shaft.
Figure 45:
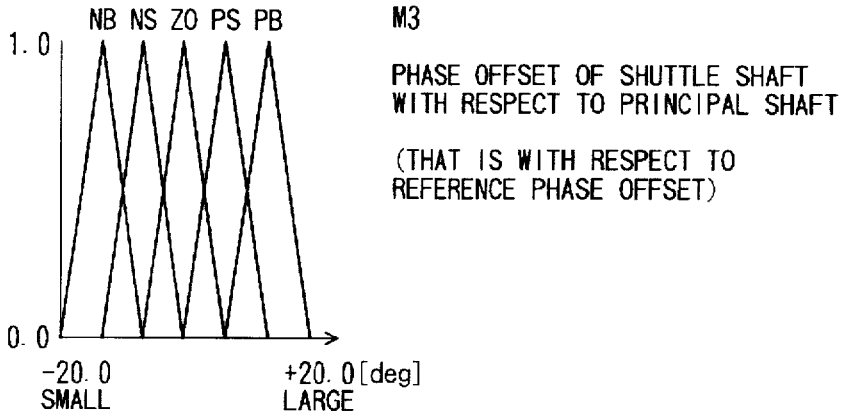
FIG. 45 is a graphical representation of a membership function relating to phase offset of the shuttle shaft with respect to the principal shaft.
Figure 46:
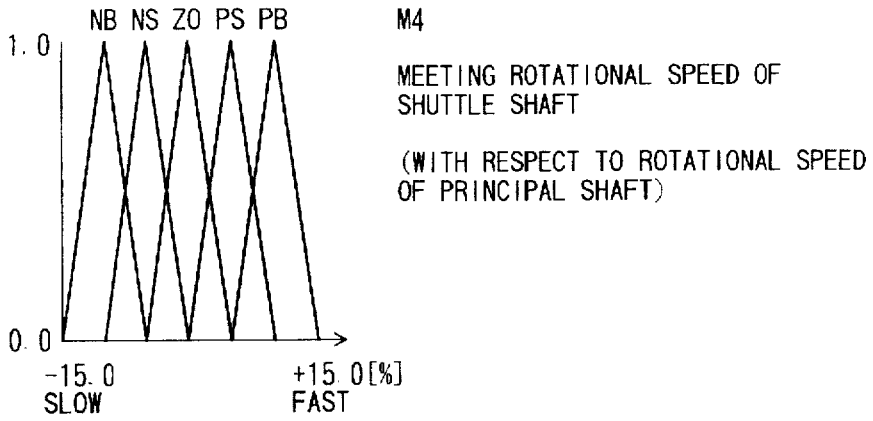
FIG. 46 is a graphical representation of a membership function relating to meeting rotational speed of the principal shaft.
Figure 47:
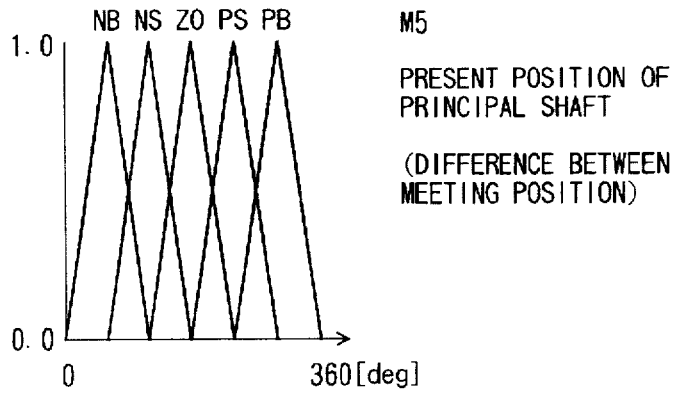
FIG. 47 is a graphical representation of a membership function relating to rotational speed of the principal shaft.
Figure 48:
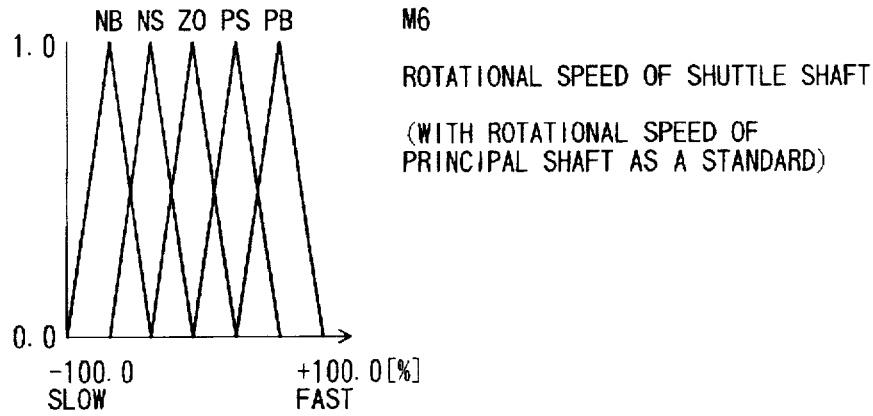
FIG. 48 is a graphical representation of a membership function relating to rotational speed of the shuttle shaft.

The membership function M1, which relates to the rotational speed of the principal shaft 6, is set as shown in FIG. 43. The membership function M2, which relates to the phase shift of the shuttle shaft 96, is set as shown in FIG. 44. The membership function M3, which relates to the phase offset of the shuttle shaft 96 with respect to the principal shaft 6, is set as shown in FIG. 45. The membership function M4, which relates to the meeting rotational speed of the shuttle shaft 96, is set as shown in FIG. 46. The membership function M5, which relates to the present position of the principal shaft 6, is set as shown in FIG. 47. The membership function M6, which relates to the rotational speed of the shuttle shaft 96, is set as shown in FIG. 48. Incidentally, the phase shift of the membership functions is the same as the rotational position (Z shift amount) of the fuzzy control rules.

Figure 49:
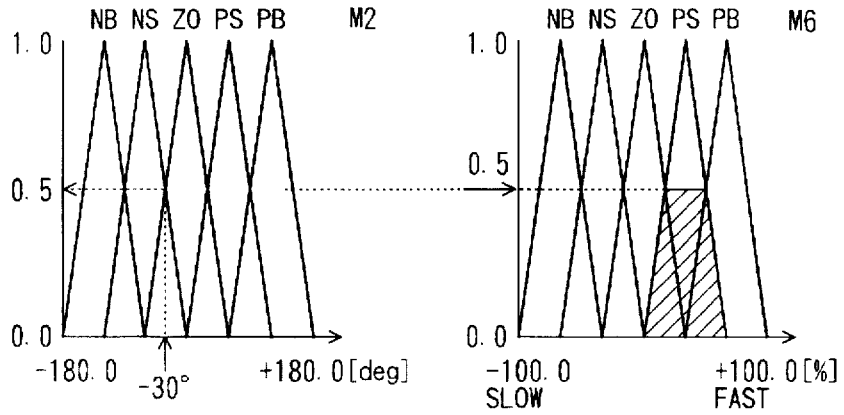
FIG. 49 is a graphical representation showing goodness of fit for the membership function relating to rotational speed of the shuttle shaft with respect to phase shift of the shuttle shaft.

Next, an example will be provided for when, at the second stitch, a delay of 30 degrees is generated at the shuttle shaft 96 (i.e., the controlled shaft), a phase shift of five degrees is generated between the meeting position of the shuttle shaft 96 and the principal shaft 6 (i.e., the reference shaft), and the present rotational speed of the principal shaft 6 is 1700 stitches per minute(spm). In this case, the fuzzy control rules (2), (4), and (6) apply. First, with respect to the fuzzy control rule (2), as shown in FIG. 49, a grade value of 0.5 is determined as corresponding to the −30 degrees delay in the phase shift of the shuttle shaft 96. The grade value 0.5 is then applied to the membership function M6, which relates to the rotational speed of the shuttle shaft 96, and the goodness of fit is determined as indicated by hashing in FIG. 49.

Figure 50:
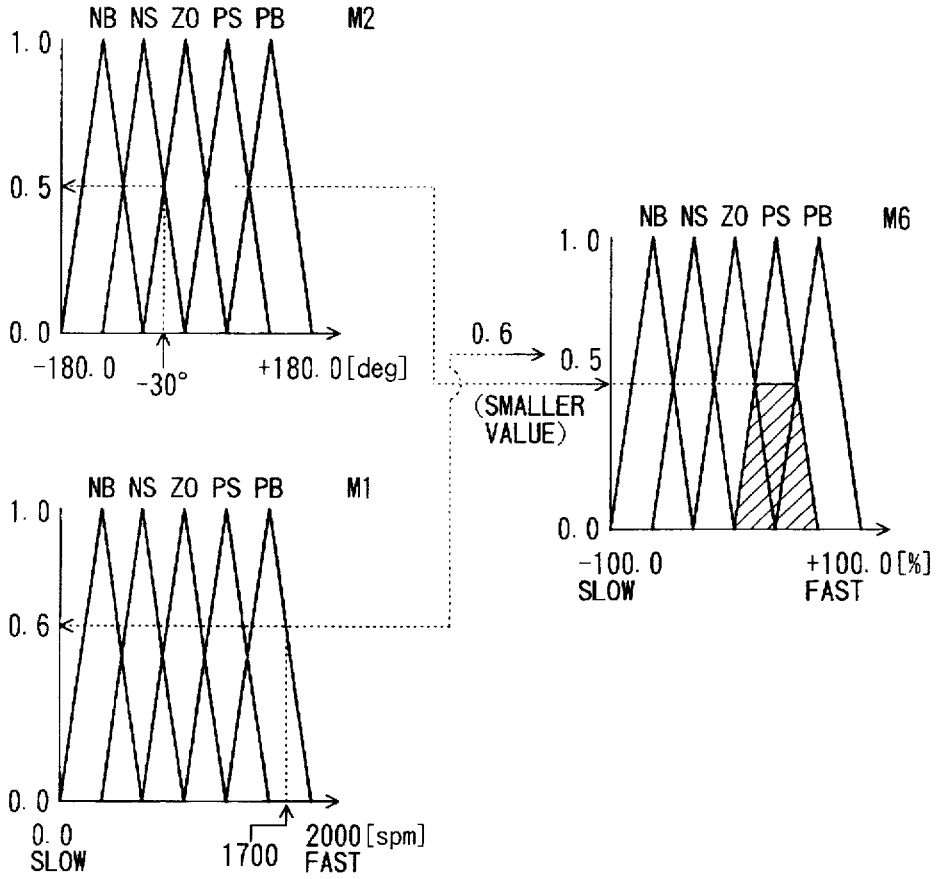
FIG. 50 is a graphical representation showing goodness of fit for the membership function relating to rotational speed of the shuttle shaft with reference to phase shift of the shuttle shaft and meeting rotational speed of the shuttle shaft.

Next, with respect to the fuzzy control rule (4), as shown in FIG. 50 the grade value 0.5 is again determined for the membership function M2 as corresponding to the −30 degree phase shift of the shuttle shaft 96. Also, a grade value 0.6 is determined for the membership function M1 as corresponding to the rotational speed of 1700 spm for the principal shaft 6 for the rotational speed of the principal shaft 6. The smaller of these two grade values, that is, 0.5, is next determined and applied to the membership function M6. The goodness of fit is then determined as indicated by hashing in FIG. 50.

Figure 51:
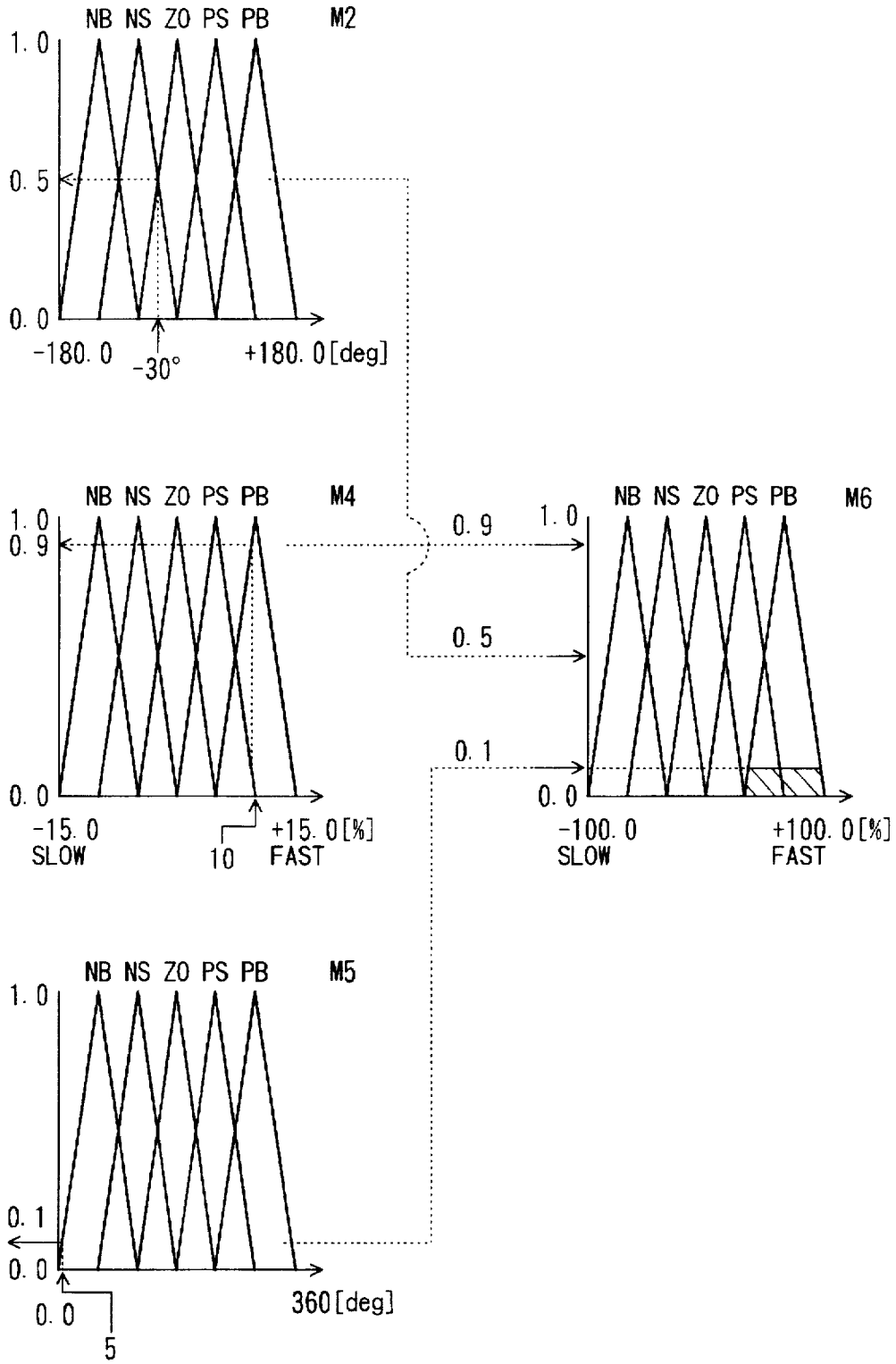
FIG. 51 is a graphical representation showing goodness of fit for the membership function relating to rotational speed of the shuttle shaft with reference to phase shift of the shuttle shaft and meeting rotational speed of the shuttle shaft.

With respect to the fuzzy control rule (6), as shown in FIG. 51 the grade value of 0.5 is again determined for the membership function M2 as corresponding to the −30 degree phase shift in the shuttle shaft 96. Then, a grade value 0.9 is determined for the membership function M2 as corresponding to the shuttle shaft 96 having a meeting speed which is excessively fast by 10 percent at the second stitch. Then, a grade value of 0.1 is determined for the membership function M5 as corresponding to the 5 degree phase shift in the position of the shuttle shaft 96. The smallest of these grade values, that is, 0.1 is determined and applied to the membership function M6. The goodness of fit is determined as indicated by the hashing in FIG. 51.

Figure 52:
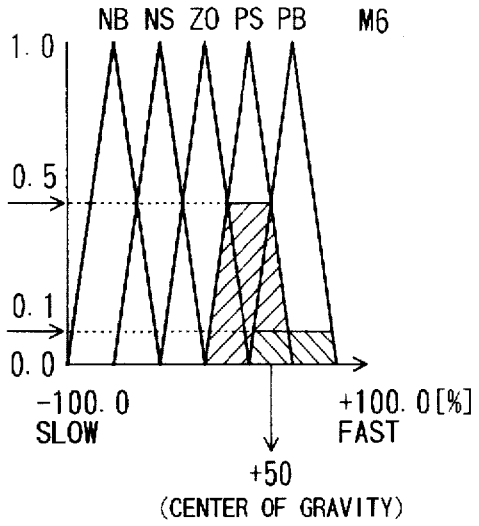
FIG. 52 is a graphical representation showing final value obtained for controlling speed of the shuttle shaft.

As shown in FIG. 52, the logical sum is determined for the goodness of fit of the membership function M6, which is indicated by the hashing in FIG. 49, the goodness of fit for the membership function M6, which is indicated by the hashing in FIG. 50, and the goodness of fit for the membership function M6, which is indicated by the hashing in FIG. 51. In this example, the value 50 is determined as the center of gravity of the logic sum. Therefore, the shuttle shaft 96 is controlled to speed up by 50 percent with respect to the present set speed of the main shaft 6. The membership functions are actually prestored in table form in the ROM 142 and developed in the RAM 143 when the power is turned on. During synchronization control, the speed control amount is deduced from the position corresponding to the present conditions. The content of the table developed in the RAM 143 can be rewritten appropriately to obtain the optimum results during synchronization control.

Next, the synchronization drive control routine proceeds to a shuttle shaft speed change routine in S94. During this routine, the shuttle drive motor 21 is controlled to change the rotational speed of the shuttle shaft 96 based on the speed change amount determined in S93. Afterward, this routine is ended and the program returns to S73 of the sewing routine. When no error is generated during the sewing routine (S73:NO) and a predetermined number of stitches have not yet been stitched (S74:NO), then S72 through S74 are repeated. When the predetermined number of stitches have been stitched so that the sewing processes are completed (S74:YES), then the speeds of the sewing machine motor 7 and the shuttle drive motor 21 are simultaneously reduced in S75 to speeds wherein thread cutting is possible. After thread cutting operations are executed in S76, braking operations are executed with respect to both motors 7, 21 and then, these motors 7, 21 are stopped in synchronization in S77.

Figure 38:
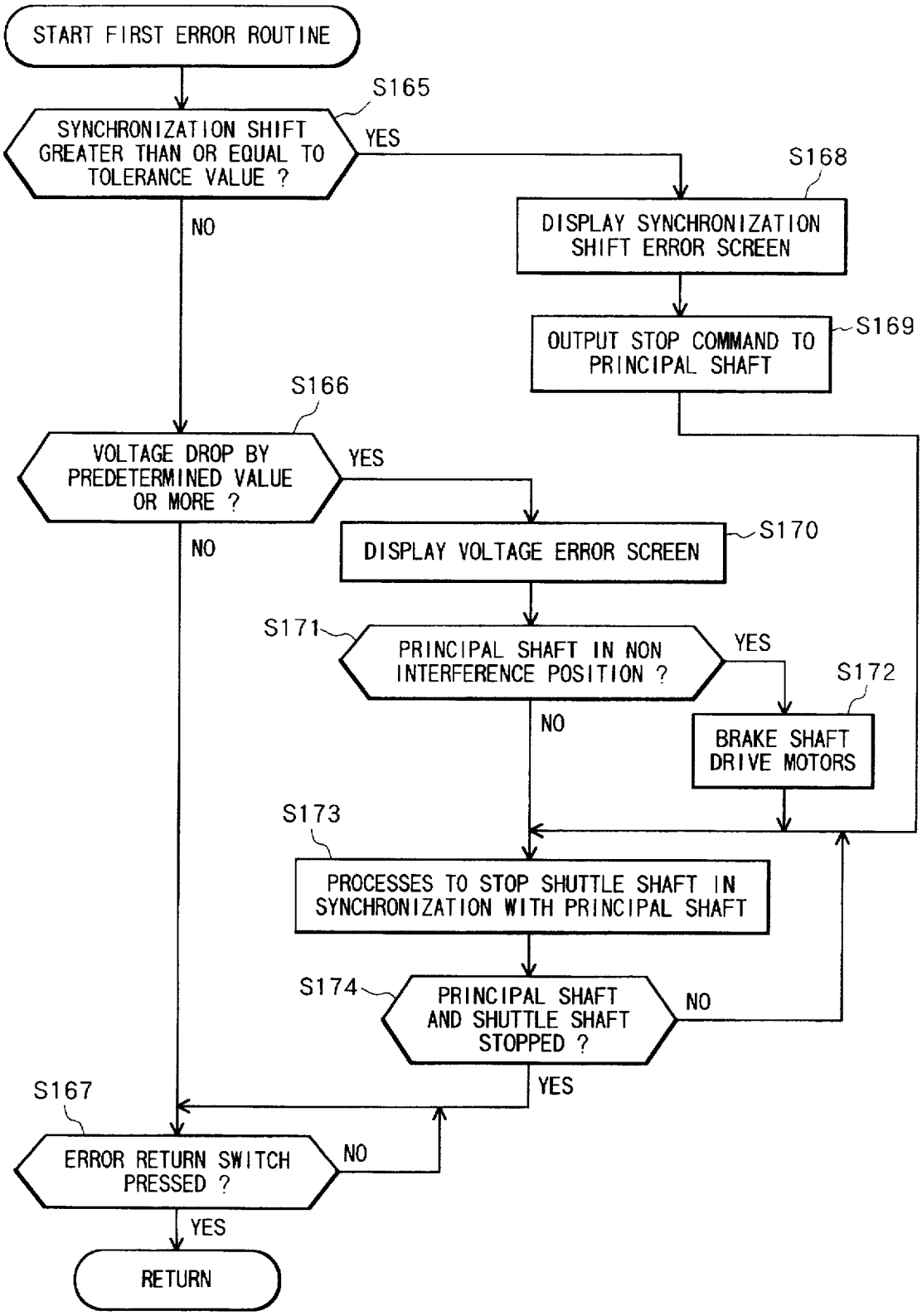
FIG. 38 is a flowchart representing a first error routine of the sewing process.
Figure 55:
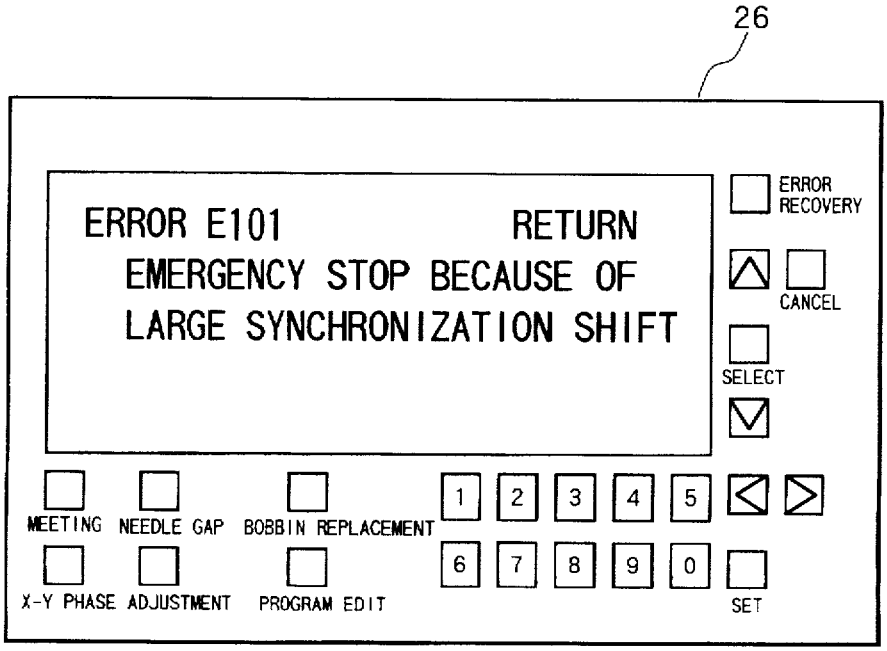
FIG. 55 is a plan view showing the operation panel displaying an example of an error display screen.

Next, the bobbin thread count value is decremented by one in S78. When the bobbin thread count value has not reached an initial value of 0, that is, when sewing processes can be continued (S79:NO), this routine is ended and the program returns to S12 of the sewing routine. On the other hand, when an error is generated during the sewing routine (S73:YES), then a first error routine represented by the flowchart in FIG. 38 is executed in S80. At the start of the first error routine, whether or not a synchronization shift equal to or greater than a tolerance value has generated is determined in S165 based on a synchronization shift amount prestored in the ROM 143. If so (S165:YES), then the synchronization shift error screen shown in FIG. 55 is displayed in S168. Next, a stop command is outputted in S169 to stop the principal shaft 6. In S173, processes are performed to stop the shuttle shaft 96 in synchronization with the principal shaft 6. Once both the principal shaft 6 and the shuttle shaft 96 are stopped (S174:YES) and also, the error recovery switch is operated (S167:YES), this routine is ended and the program returns to S12 of the sewing routine.

On the other hand, when it is determined, based on a voltage signal of the voltage detection circuit 164, that the power voltage has dropped by an amount equal to or greater than a predetermined value (S165:NO, S166:YES), then an error screen indicating that the voltage level has dropped is displayed on the display 24 while power is supplied from the emergency capacitor 160 in S170. When the needle bar 11*b* and the loop seizing beak 98*a* are in a non-interference position where they will not collide with each other (S171:YES), then braking operations are executed on the sewing machine motor 7 and on the shuttle drive motor 21 in S172. Afterward, S173 through S174 are again executed as described above. When the error recover switch has been operated (S167:YES), then the program returns to S12 of the sewing routine. Total power failures can also be detected by detecting whether the power voltage drops by a predetermined voltage or more.

Figure 31:
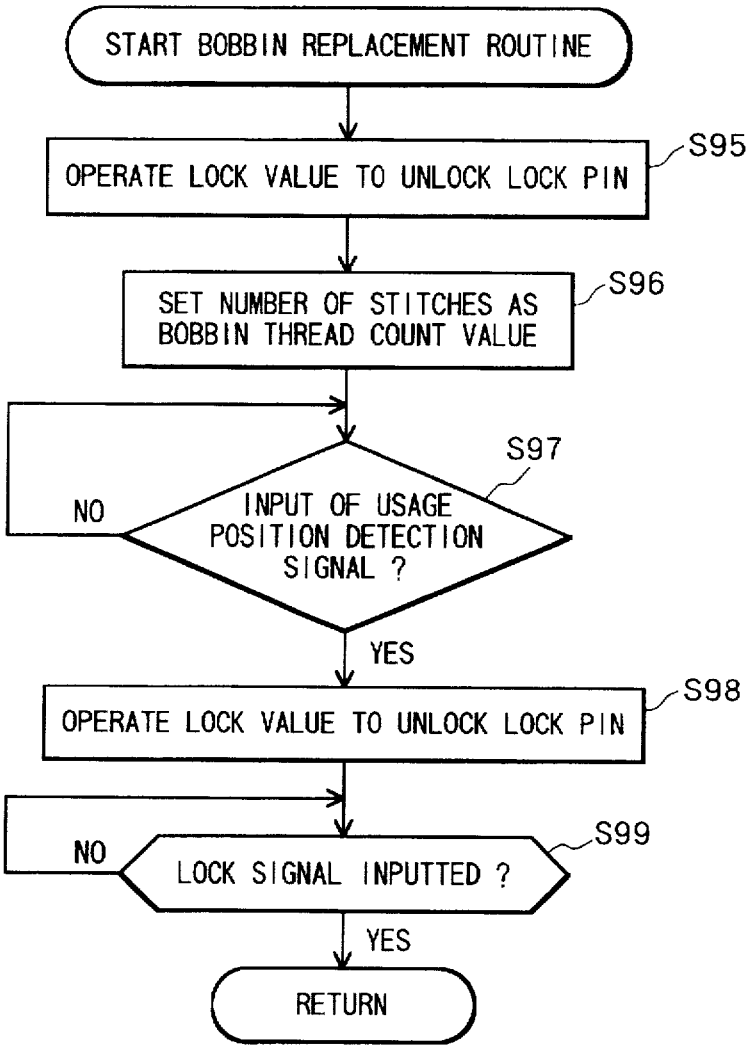
FIG. 31 is a flowchart representing a bobbin replacement routine of the sewing routine.
Figure 39:
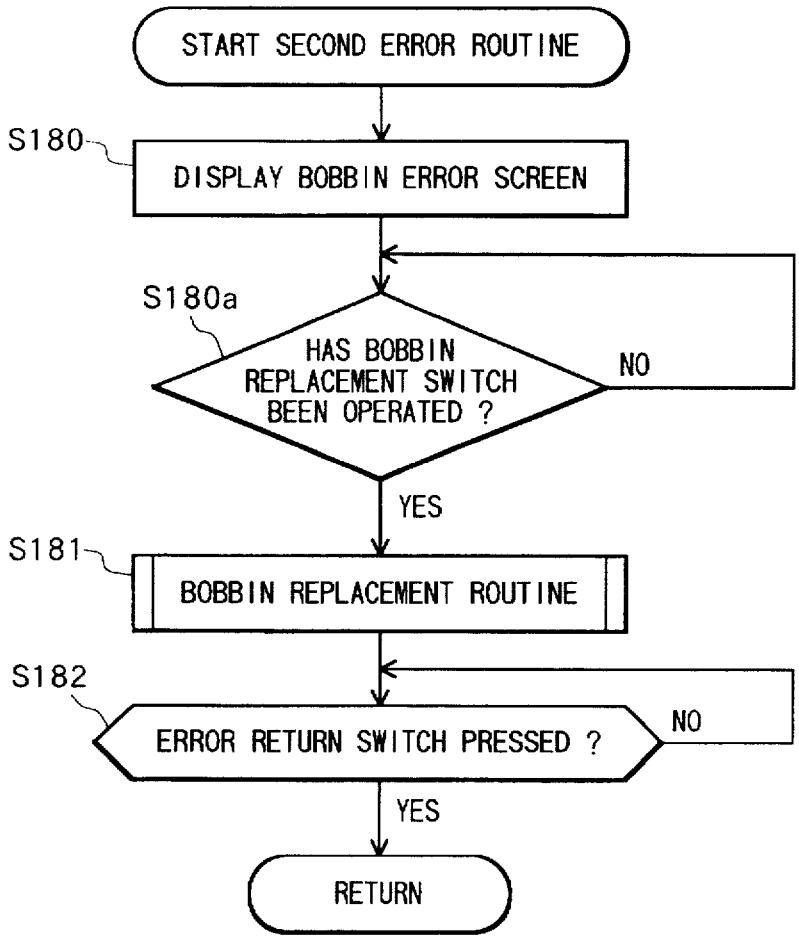
FIG. 39 is a flowchart representing a second error routine of the sewing process.
Figure 56:
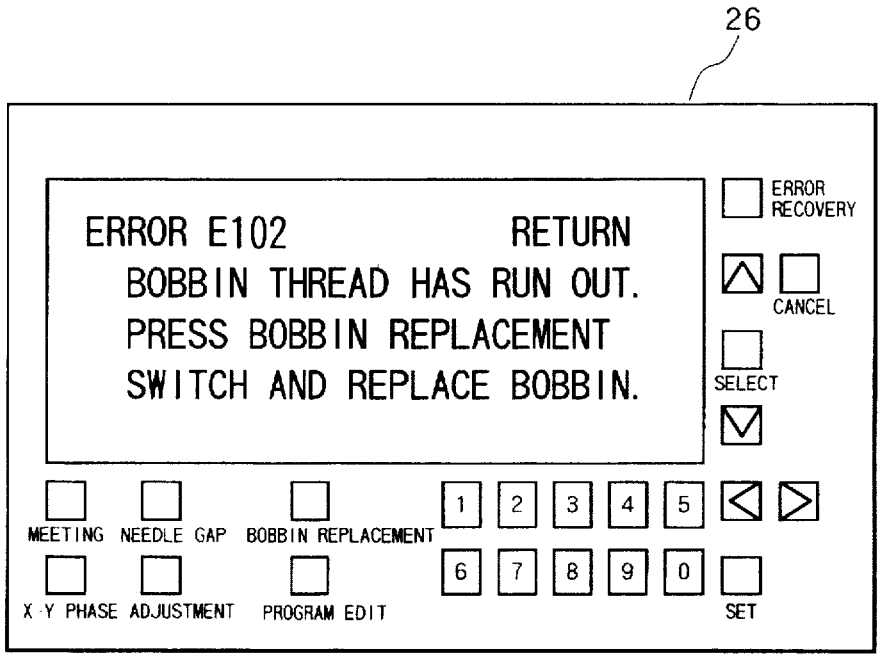
FIG. 56 is a plan view showing the operation panel displaying another example of an error display screen.
Figure 57:
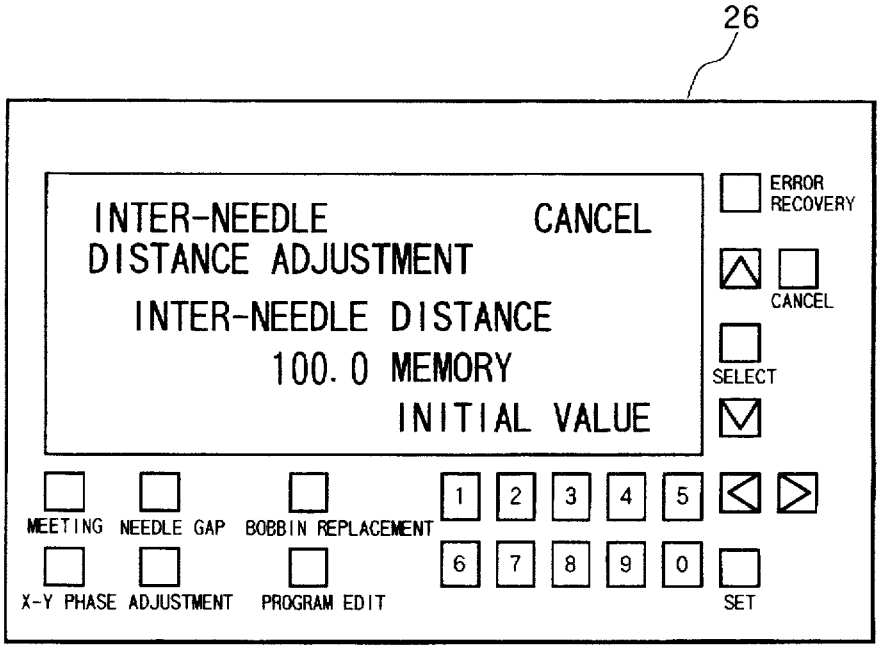
FIG. 57 is a plan view showing the operation panel displaying an example of a needle gap adjustment screen.

When the bobbin thread counter value reaches 0 (S79:YES), then a second error control routine represented by the flowchart in FIG. 39 is executed in S81. At the start of the second error routine a bobbin thread error screen is shown in FIG. 56 displayed in S80. When the bobbin replacement switch has been operated (S180*a*:YES), then the bobbin replacement routine represented by the flowchart in FIG. 31 is executed in S181 by operating the pivot frame 57. Afterward, once the error recovery switch is operated (S182:YES), then this routine is ended and the program returns.

Next, the bobbin replacement routine will be described. It should be noted that the bobbin replacement routine is executed in S24 or S181 as a result of a positive determination in either S15 or S180*a*, respectively.

At the start of the bobbin replacement routine, first, the lock valve 153 is operated in S95 to unlock the lock pin 63. Then, the predetermined stitch number is set as the bobbin thread count value in S96. When a detection signal indicating that the pivot frame 57 has been switched back to the usage position is inputted from the proximity switch 69(S97:YES), then the lock valve 153 is operated in S98 to lock the lock pin 63. Further, when the lock signal from the proximity switch 68 is inputted (S99:YES), then this routine is ended and the program routine returns to S12 of the sewing routine.

Figure 32:
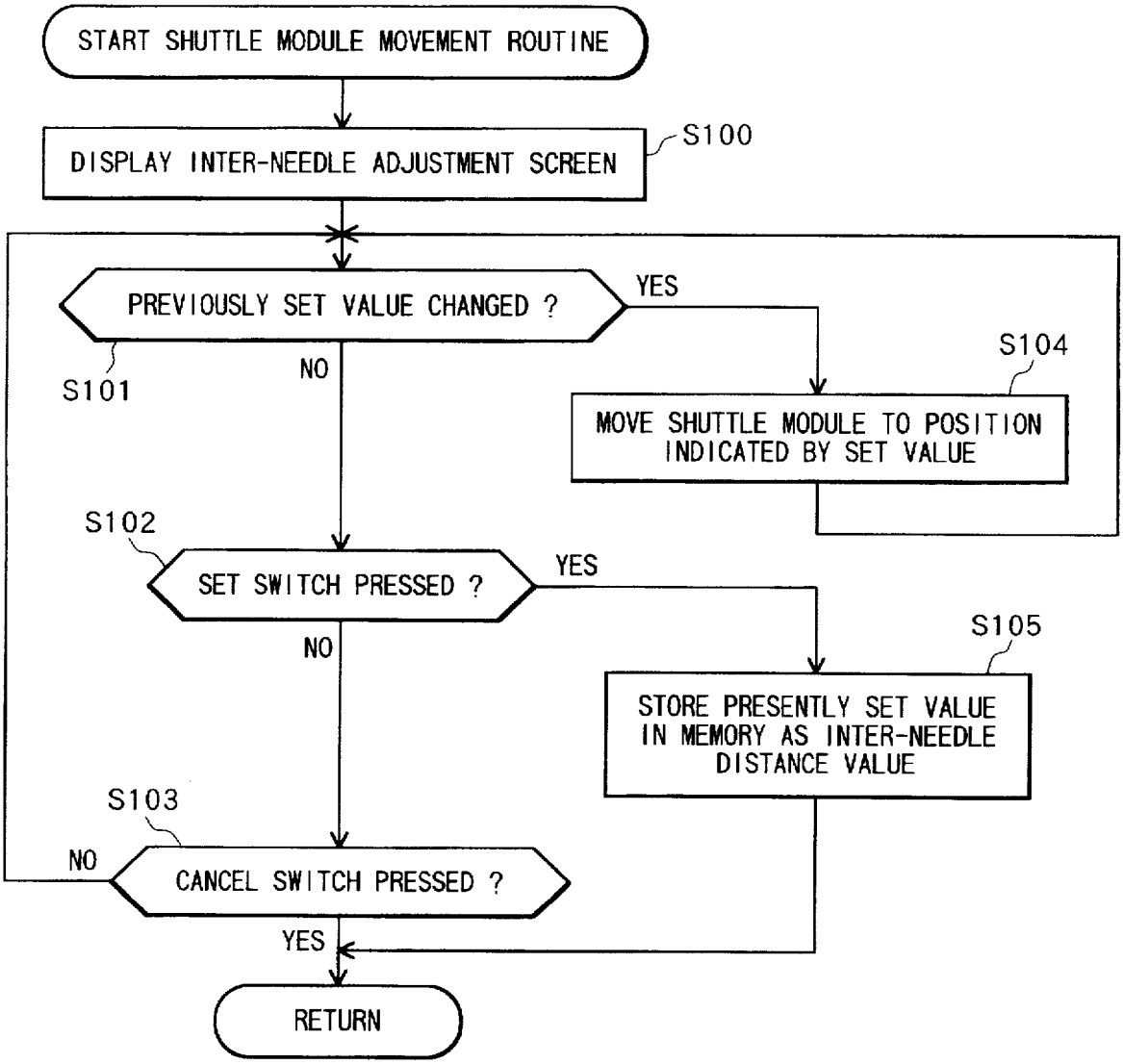
FIG. 32 is a flowchart representing a shuttle module movement routine of the sewing routine.

When the inter-needle distance adjustment switch is operated (S13 through S15:NO, S16:YES), then the shuttle module movement routine represented by the flowchart in FIG. 32 is executed in S25.

When the shuttle module movement routine is started, as shown in FIG. 32, first the inter-needle distance adjustment screen is displayed in S100. When the previously set value is changed by operations of the numeric keys (S101:YES), then the needle interval adjustment motor 70 is driven and the shuttle module 13 is moved in S104 to a position corresponding to the set value. When the set switch is operated (S101:NO, S102:YES), the set data is stored in S105 in the memory of the RAM 143 as an inter-needle distance value. Afterward, this routine is ended and the program returns to S12 of the sewing routine. Also, when a cancel switch is operated (S101 through S102:NO, S103:YES), then the program returns in the same manner.

Figure 33:
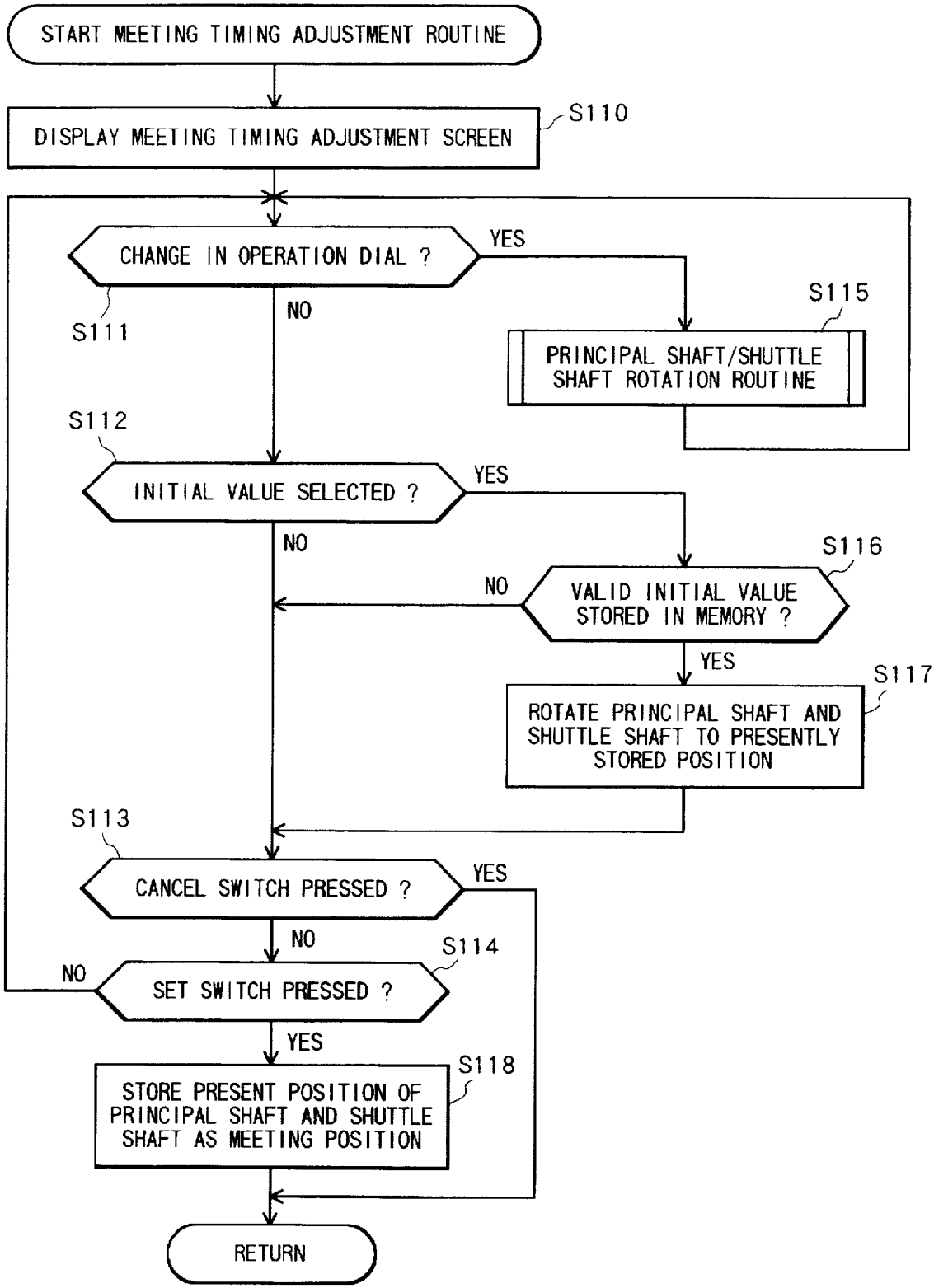
FIG. 33 is a flowchart representing a meeting timing adjustment routine of the sewing routine.

When the meeting adjustment switch is operated (S13 through S16:NO, S17:YES), then a meeting timing adjustment routine represented by the flowchart in FIG. 33 is executed in S26.

Figure 35:
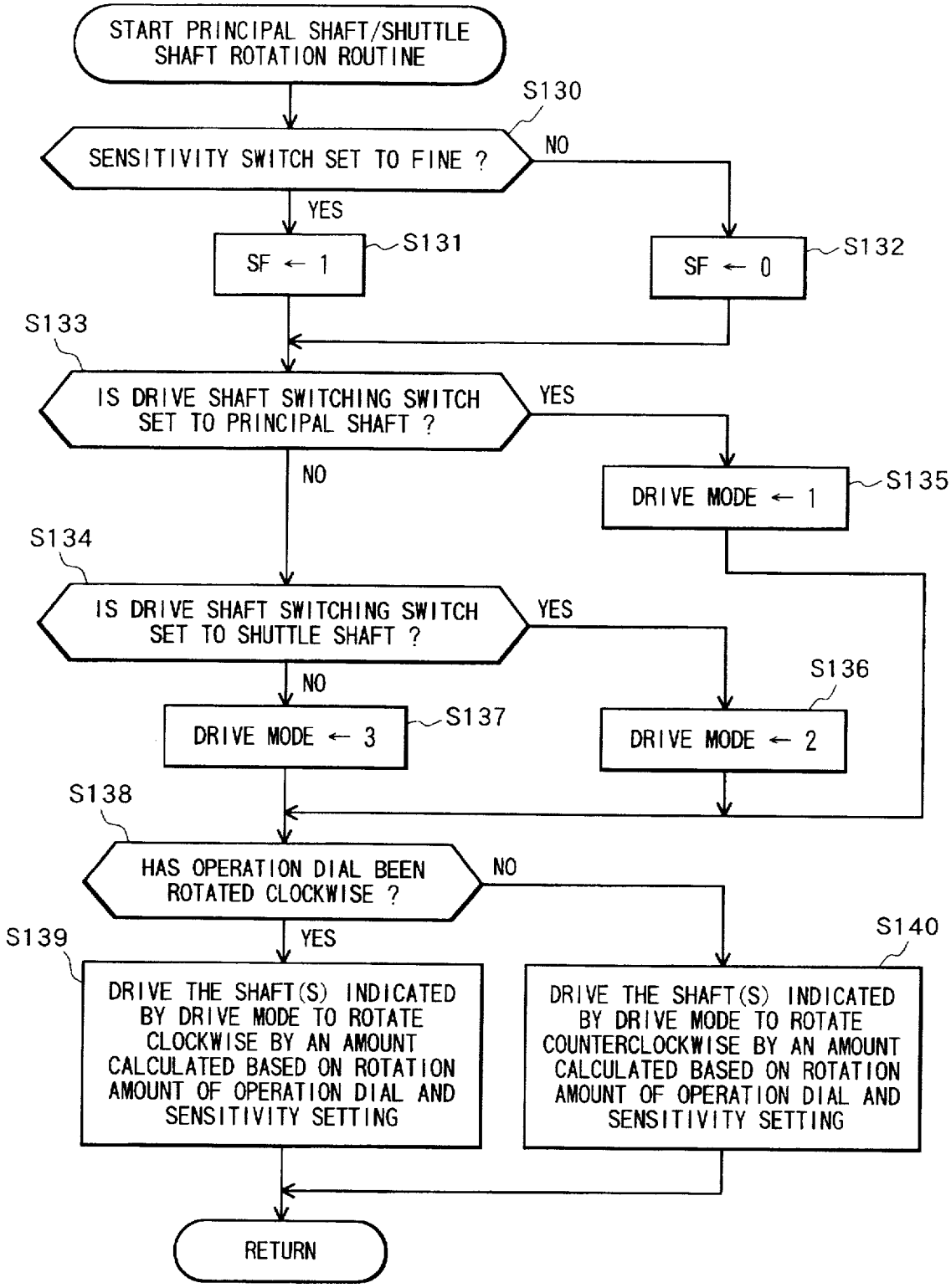
FIG. 35 is a flowchart representing a principal shaft/shuttle shaft rotation routine of the sewing routine.
Figure 58:
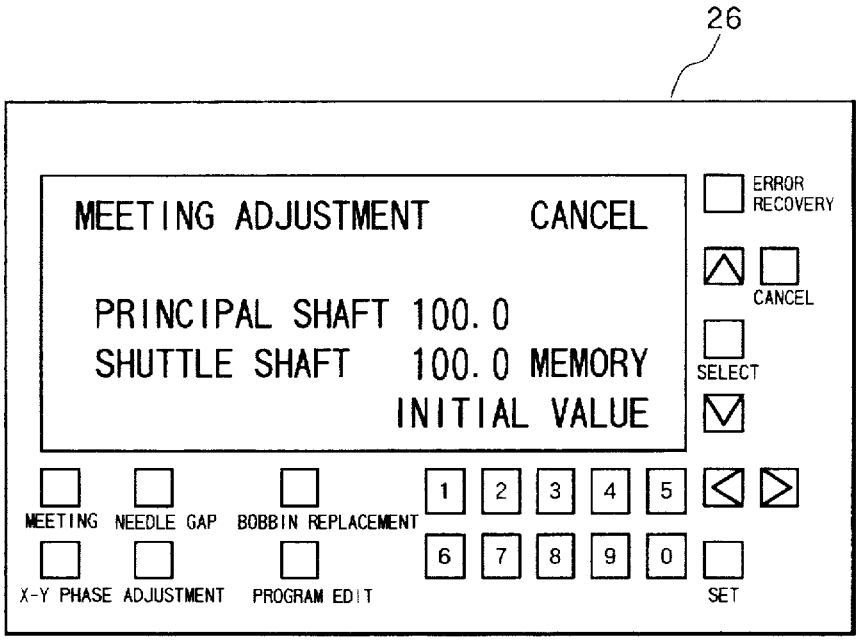
FIG. 58 is a plan view showing the operation panel displaying an example of a meeting adjustment screen.

When the meeting timing adjustment routine is started, a meeting timing adjustment screen shown in FIG. 58 is displayed in S110. When the operation dial 23*c* is operated (S111:YES), then a principal shaft/shuttle shaft rotation routine represented by the flowchart in FIG. 35 is executed in S115. At the start of the principal shaft/shuttle shaft pivot routine, when the operation sensitivity switch 23*b* is switched to fine (S130:YES), the sensitivity flag SF is set to one in S131. On the other hand, when the operation sensitivity switch 23*b* is switched to rough (S130:NO), the sensitivity flag SF is reset to zero in S132.

When the drive shaft switching switch 23*a* is switched to the principal shaft (S133:YES), then the drive mode is set to 1. On the other hand, when the drive shaft change switch 23*a* is switched to the shuttle shaft (S133:NO, S134:YES), the drive mode is set to 2. Further, when the drive shaft change switch 23*a* is switched to the main/shuttle shaft (S133 through S134:NO), then the drive motor is set to 3 in S137. When the operation dial 23*c* is rotated clockwise (S138:YES), then either or both of the principal shaft 6 and the shuttle shaft 96 depending on the drive mode, is driven to rotate clockwise in S139 by a rotational amount determined based on the setting of the sensitivity flag SF and on the rotational amount of the operation dial 23*c*. Afterward, this routine is ended and the program returns to S111 of the meeting timing adjustment routine. On the other hand, when the operation dial 23*c* is rotated counterclockwise (S138:NO), then either or both of the principal shaft 6 and the shuttle shaft 96, depending on the drive mode, is driven to rotate counterclockwise by a rotational amount determined based on the setting of the sensitivity flag SF and on the rotation amount of the operation dial 23*c* in S140.

Returning to the meeting timing adjustment routine, when the initial value is selected (S112:YES) and when a valid initial value, such as a default value, is stored in the meeting timing memory (S116:YES), then the principal shaft 6 and the shuttle shaft 96 are rotated in S117 to a position corresponding to the initial value. On the other hand, when the set switch is operated (S114:YES), the present rotational positions of the principal shaft 6 and the shuttle shaft 96 are stored in S118 in the memory of the RAM 143 as priority meeting positions. Then, this routine is ended and the program returns to S12.

Figure 34:
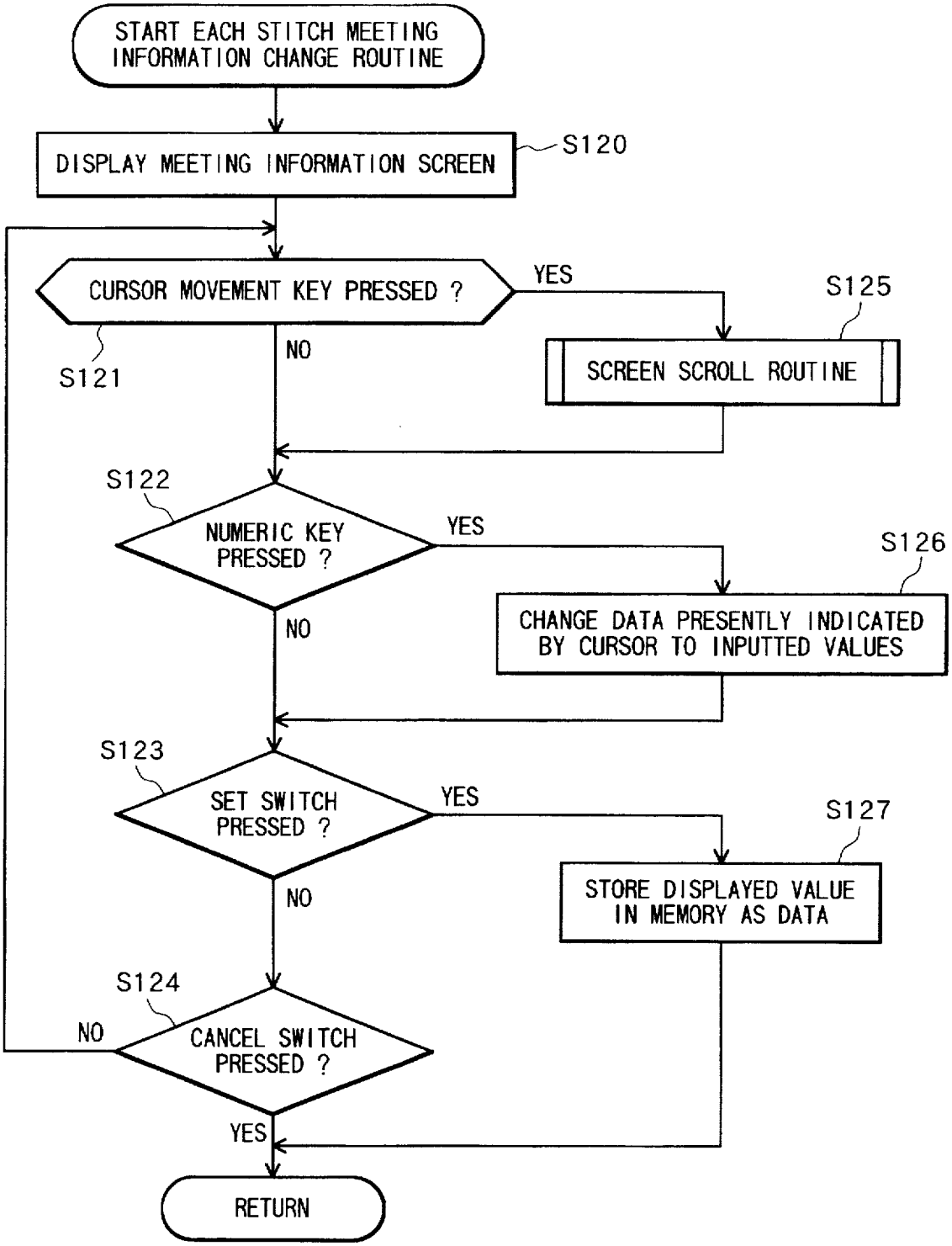
FIG. 34 is a flowchart representing an each stitch meeting information change routine of the sewing routine.
Figure 59:
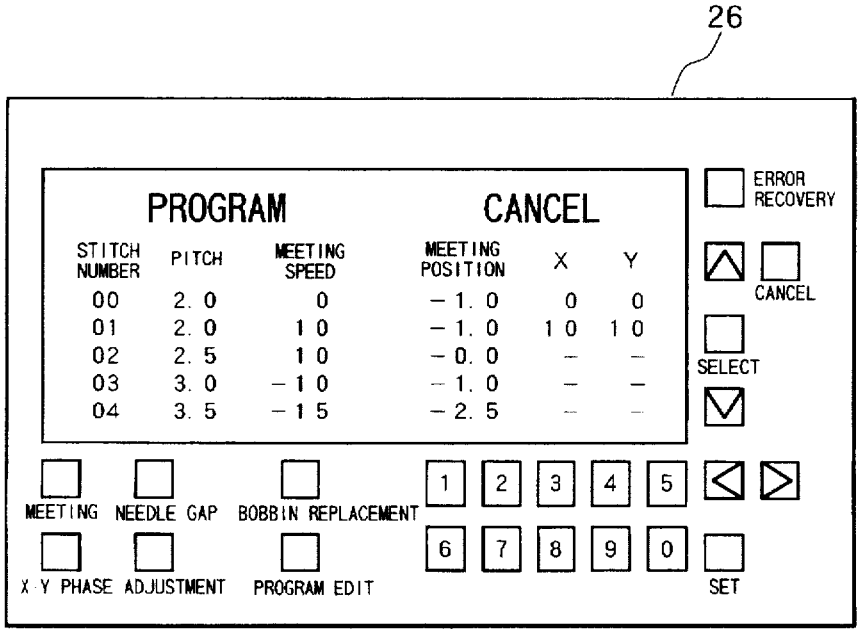
FIG. 59 is a plan view showing the operation panel displaying an example of a meeting information screen, or a program edit screen.

When the program edit switch has been operated (S13 through S17:NO, S18:YES), an each stitch meeting information change routine represented by the flowchart in FIG. 34 is executed for each stitch in S27. When the each stitch meeting information change routine is started, a meeting information screen, that is, a program edit screen shown in FIG. 59, is displayed in S120. When one of the upper, lower, left, and right cursor movement keys is operated (S121:YES), a screen scroll routine including cursor movement processes is executed in S125. When one of the numeric keys is operated (S121:NO, S122:YES), then data for the category indicated by the cursor is changed in S126 to the data inputted by the pressed numeric key. When the set switch is operated (S121 through S122:NO, S123:YES), the inputted data is stored in the meeting condition memory 143*a* in S127. Then this routine ends and the program returns to S12. On the other hand, when the cancel switch is operated (S121 through S123:NO, S124:YES), the program returns to S12 in the same manner as described above.

Figure 36:
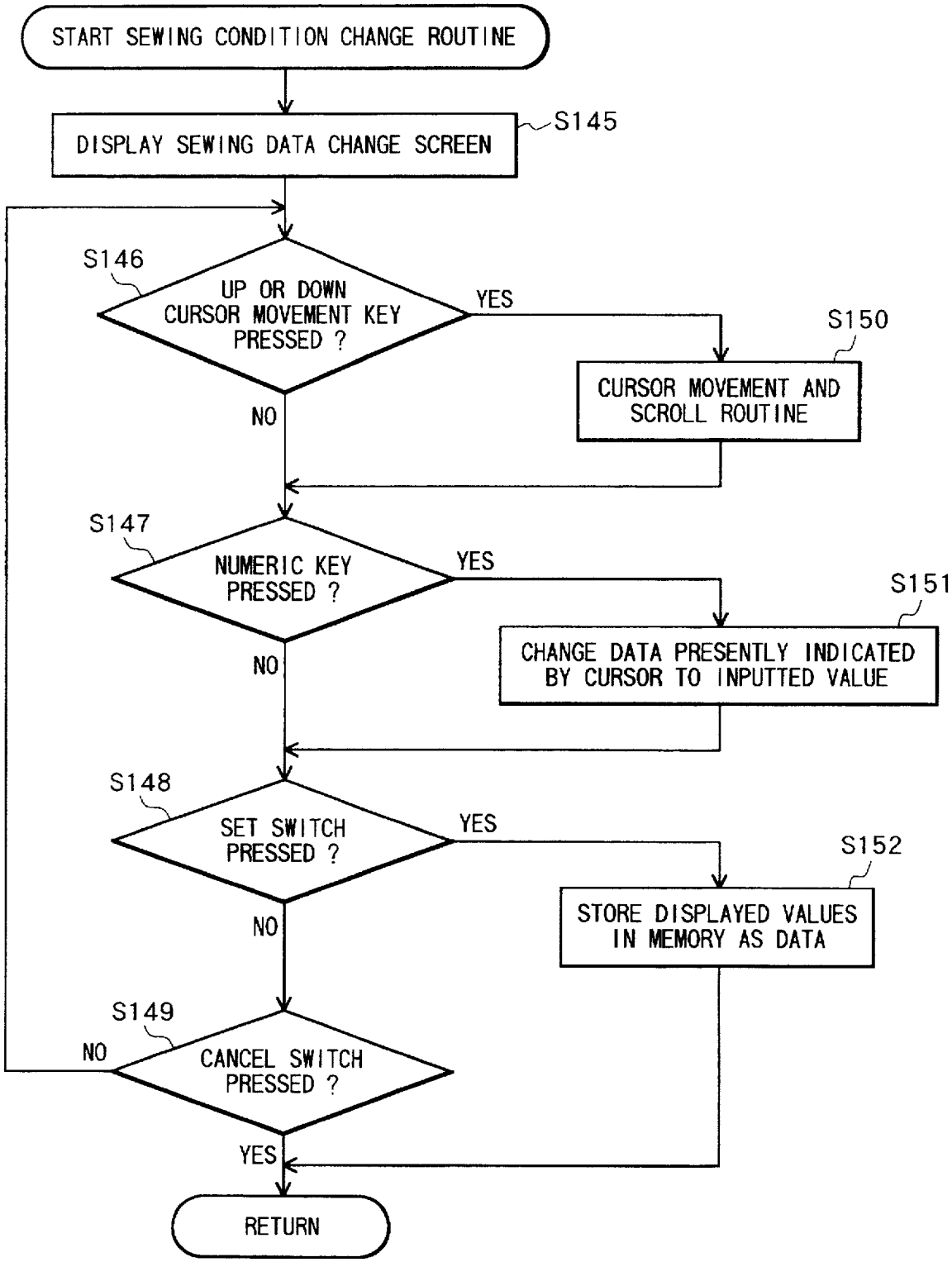
FIG. 36 is a flowchart representing a sewing condition change routine of the sewing routine.

When the operation dial 23*c* is operated (S13 through S18:NO, S19:YES), then the main/shuttle shaft rotation routine, described previously with reference to the flowchart in FIG. 35, is executed in S28, and the program returns to S12. When the selection switch is operated (S13 through S19:NO, S20:YES), the sewing condition change routine represented by the flowchart in FIG. 36 is executed in S29.

Figure 60:
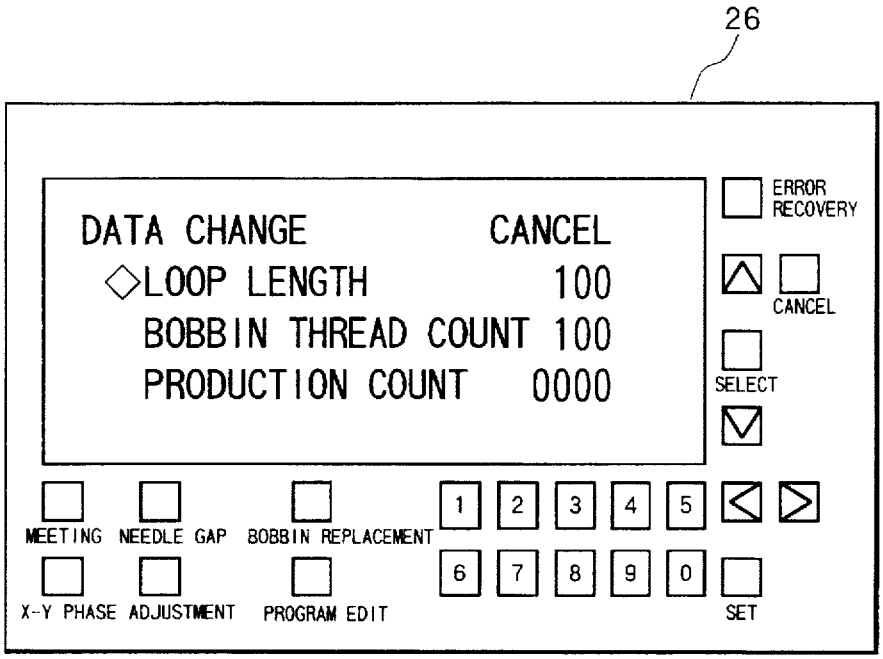
FIG. 60 is a plan view showing the operation panel displaying an example of an initial sewing data change screen.
Figure 61:
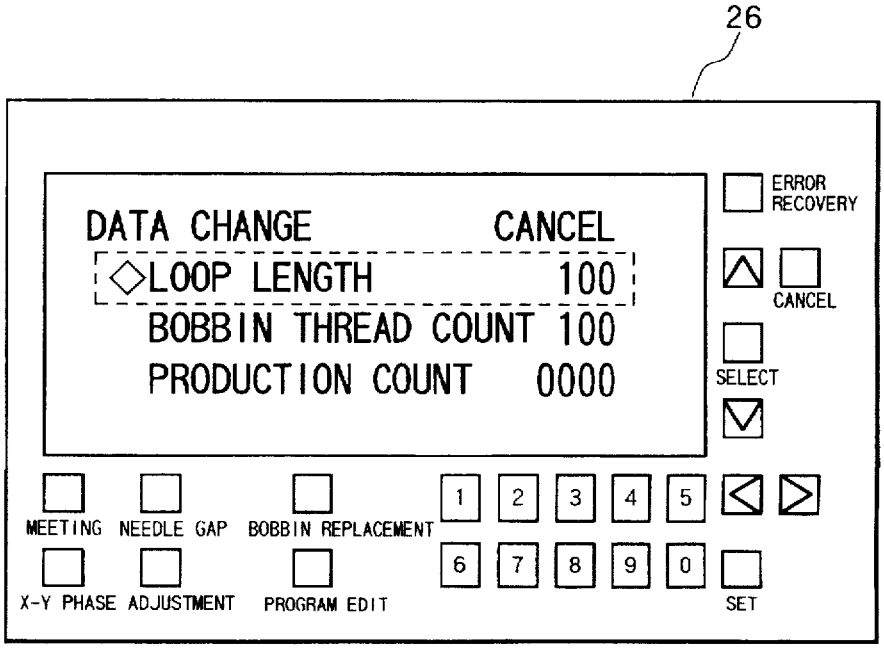
FIG. 61 is a plan view showing the operation panel displaying the sewing data change screen changed by moving a cursor.
Figure 62:
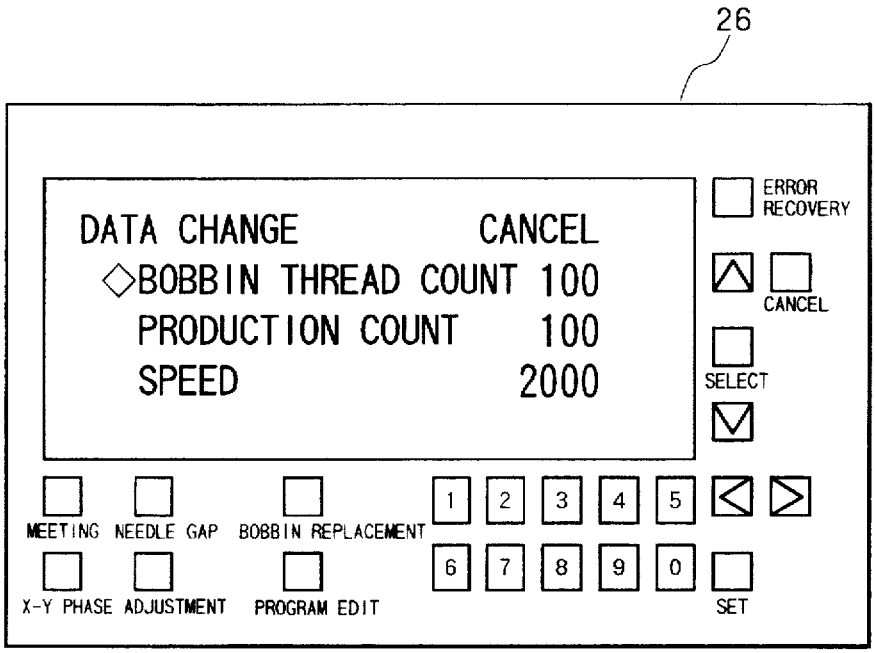
FIG. 62 is a plan view showing the operation panel displaying the sewing data change screen changed by moving a cursor.

When the sewing condition change routine is started, a sewing data change screen shown in FIG. 60 is displayed in S145. When the up or down cursor movement key is operated (S146:YES), then the cursor movement routine and the scroll routine are executed in S150 so that the screen changes as shown schematically in FIGS. 61 and 62. When a numeric key is operated (S146:NO, S147:YES), then data of the category indicated by the cursor is changed in S151 to inputted data. When the set switch is operated (S146 through S147:NO, S148:YES), then the inputted data is stored in the RAM 143 as sewing condition data in S157. Then, this routine ends and the program returns to S12. When the cancel switch is operated (S146 through S148:NO, S149:YES), the program returns to S12 in the same manner as described above.

Figure 37:
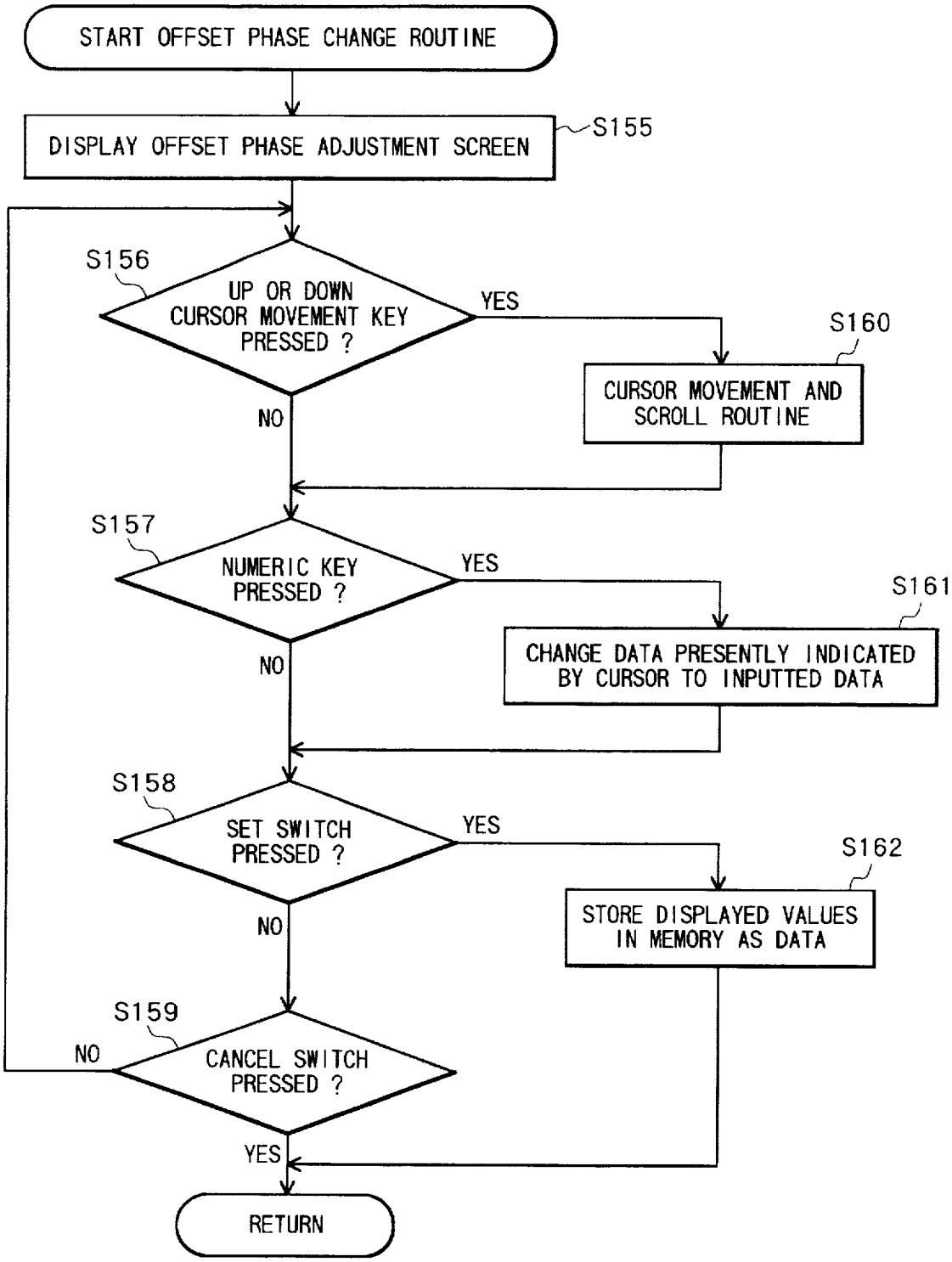
FIG. 37 is a flowchart representing an offset phase change routine of the sewing routine.

When the phase switch is operated (S13 through S20:NO, S21:YES), the offset phase change routine represented by the flowchart in FIG. 37 is executed in S30.

Figure 63:
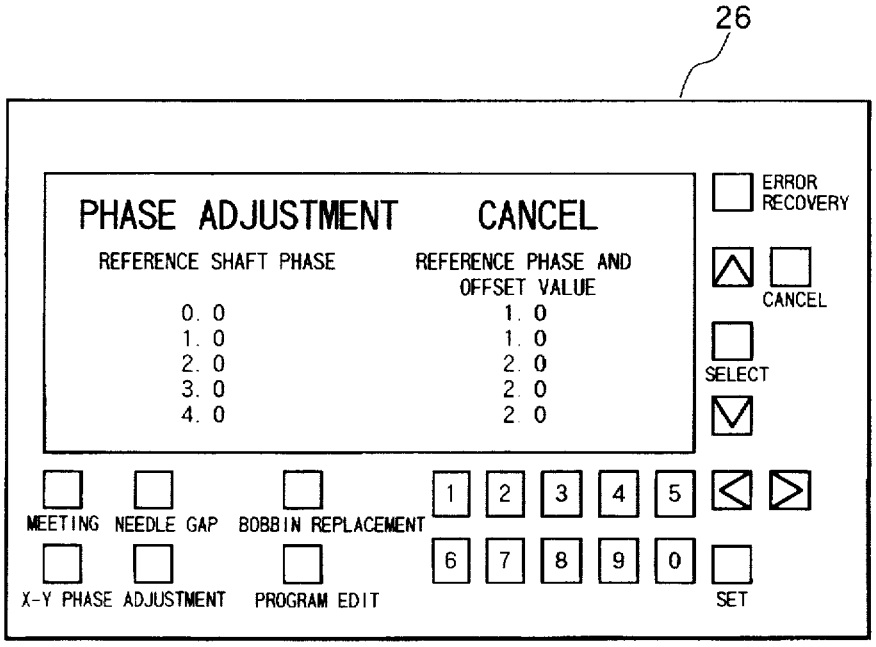
FIG. 63 is a plan view showing the operation panel displaying an example of an offset phase adjustment screen.

When the offset phase change routine is started, the offset phase adjustment screen shown in FIG. 63 is displayed in S155. When the up or down cursor movement key is operated (S156:YES), then the cursor movement routine and the scroll routine are executed in S160. When a numeric key is operated (S156:NO, S157:YES), then the data for the category indicated by the cursor is changed to the inputted data in S161. When the set switch has been operated (S156 through S157:NO, S158:YES), the data inputted and set is stored in the RAM 143 as the offset adjustment amount data in S162. Afterward, this routine ends and the program returns to S12. When the cancel switch has been operated (S156 through 158:NO, S159:YES), then the program returns to S12.

Next, an explanation will be provided for the operations of the control system including the control unit 140.

As described above, the amount that the phase offset of the oscillating shuttle 16 is offset with respect to the principal shaft 6 is adjustable for each single rotational degree using the offset adjustment amount memory 143*b* shown in FIG. 24. It should be noted that, rather than for each rotational degree, the offset amount could be adjusted for any single rotational position defined by dividing one cycle of the principal shaft 6 into equivalent parts. Therefore, the rotational speed of the oscillating shuttle 16 directly prior to or after the meeting, time, that is, when the loop seizing beak 98*a* of the oscillating shuttle 16 meets the sewing needle 11*b*, can be sped up or slowed down. As a result, the sewing status, such as tight thread or loose thread can be adjusted.

As described above, by using the meeting rotational speed data stored in the meeting condition memory 143*a*, the amount that the rotational speed of the oscillating shuttle 16 at meeting time is shifted from the reference rotational speed, which is preset for the oscillating shuttle 16 for when the loop seizing beak of the oscillating shuttle 16 meets the sewing needle 11*b*, can be adjusted. As a result, the rotational speed can be adjusted for each sewing operation for a plurality of preset number of stitches. Therefore, the rotational speed of the oscillating shuttle 16 at meeting time can be adjusted according to sewing conditions, such as the thickness of thread, the thickness of cloth, and the quality of material. The status of sewing can be adjusted accordingly. When sewing patterns or embroidery, the sewing conditions will change depending on the condition of the stitches. However, the sewing status of all the sewing operations can be adjusted by adjusting the meeting speed of the oscillating shuttle 16 for each sewing operation of a plurality of stitches. Also, the sewing status, such as tight thread and loose thread can be adjusted.

A memory is provided capable of storing, as sewing parameters, the rotational position of the oscillating shuttle 16 at meeting time for each sewing operation, the rotational speed of the oscillating shuttle 16 at meeting time for each sewing operation, and the offset adjustment amount for each rotation of the principal shaft 6. Also, an operation panel 26 is provided capable of inputting and changing the set data. Therefore, important parameters which influence the sewing status, such as the offset adjustment amount, the meeting speed, and the meeting position, can be appropriately set and the operations can be performed according to the set values.

However, because it is often desirable that the sewing parameter, such as the offset adjustment amount, the meeting speed, the meeting position, be changeable according to different sewing conditions, such as stitch patterns, upper and bobbin threads, and workpiece cloth, therefore, a plurality of sets of sewing parameter sets formed from combinations of sewing parameters are stored. Sewing operations can then be performed using the sewing parameters appropriate to sewing conditions.

By providing at least one of the sewing parameter sets in a rewritable form, then the rewritable sewing sets can be rewritten into new sewing parameter sets when a new sewing set not previously stored becomes necessary.

The relative positional relationship at any particular time between the principal shaft 6 and the shuttle drive shaft 104 can be determined when the origin position of the principal shaft 6, the origin position and the rotational angle of the sewing machine motor 7, the origin position of the shuttle drive shaft 104, and the origin position and the rotational angle of the servomotor 21 are known. Therefore, because the servomotor 21 can be controlled by fuzzy logic to rotate in synchronization with the half rotation shuttle 16 and the principal shaft 6, a flexible synchronization control is possible and precise and rapid control is possible while applying only a low burden on the calculation portion.

Because the fuzzy logic control is performed using at least one of the rotational speed of the principal shaft 6, the rotational speed of the shuttle drive shaft 104, and the phase shift angle of the shuttle drive shaft 104 with respect to the principal shaft 6, therefore, a plurality of fuzzy control rules and membership functions can be easily formed, calculation processes for this control can have reduced burden, and control can be reliably performed.

During the main/shuttle shaft initialization routine of FIG. 27, collision between the sewing needle 11*b* and the loop seizing beak 98*a* of the oscillating shuttle 16 can be prevented when the power is turned on because the needle bar 8 is moved to a needle stop position and also the oscillating shuttle 16 is stopped at a position corresponding to the needle stop position. Therefore, even if the principal shaft 6 and the shuttle shaft 96 are shifted out of synchronization by being manually rotated, the initialization routine can return the positional relationship between the principal shaft 6 and the shuttle shaft 96 back to the initial setting of a predetermined phase offset amount. Therefore, a collision between the sewing needle 11*b* and the loop seizing beak 98*a* of the oscillating shuttle 16 will not occur.

When a strikingly large synchronization shift occurs with respect to the principal shaft of the oscillating shuttle 16, the sewing needle 11*b* can be damaged by interference between the sewing needle 11*b* and the oscillating shuttle 16. By detecting the shift amount of the synchronization shift when the shift amount becomes equal to or greater than an allowable value, the sewing machine motor 7 and the shuttle drive motor 21 are stopped while maintaining the principal shaft 6 and the shuttle shaft 96 in synchronization. In this case, the needle bar 8 is stopped at a needle upper stop position and the shuttle 16 is stopped at a position corresponding to the needle upper stop position. Therefore, interference between the sewing needle 11*b* and the oscillating shuttle 16 which can be caused by synchronization shift can be reliably prevented.

When a drop of voltage to or greater than a predetermined value is detected, this includes voltage stoppage, then voltage is supplied from the emergency capacitor 160. When the sewing needle 11*b* and the oscillating shuttle 16 are in non-interference position where they will not collide, the sewing machine motor 7 and the shuttle drive motor 21 are stopped by performing braking operations. Therefore, synchronization shift which can be caused by drop in voltage and stoppage of voltage can be accurately prevented. In this case, it is desirable to stop the needle bar 8 at the needle upper stop position and the oscillating shuttle 16 at a position corresponding to the needle upper stop position.

Because the manual operation unit 23 is provided, either or both of the machine motor 7 and the shuttle motor 21 can be manually driven as desired from a position separated from the motors 7,21. Because the manual operation unit 23 is configured capable of switching between a mode for rotating the sewing machine motor 7, a mode for rotating the shuttle drive motor 21, and a mode for simultaneously driving both of the sewing machine motor 7 and the shuttle drive motor 7, therefore, the sewing machine motor 7 only can be rotated, the shuttle drive motor 21 only can be rotated, or both of the sewing machine motor 7 and the shuttle drive shaft 7 can be rotated. Because the operation sensitivity switch **23*b* of the manual operation unit 23 allows adjustment of an operation command value with respect to the unit operation amount, when one or more of the motors 6, 21** are rotated, they can be rotated roughly or finely. The operation sensitivity can be adjusted according to the objective of the user.

Next, modifications of the embodiment will be described.

Figure 18:
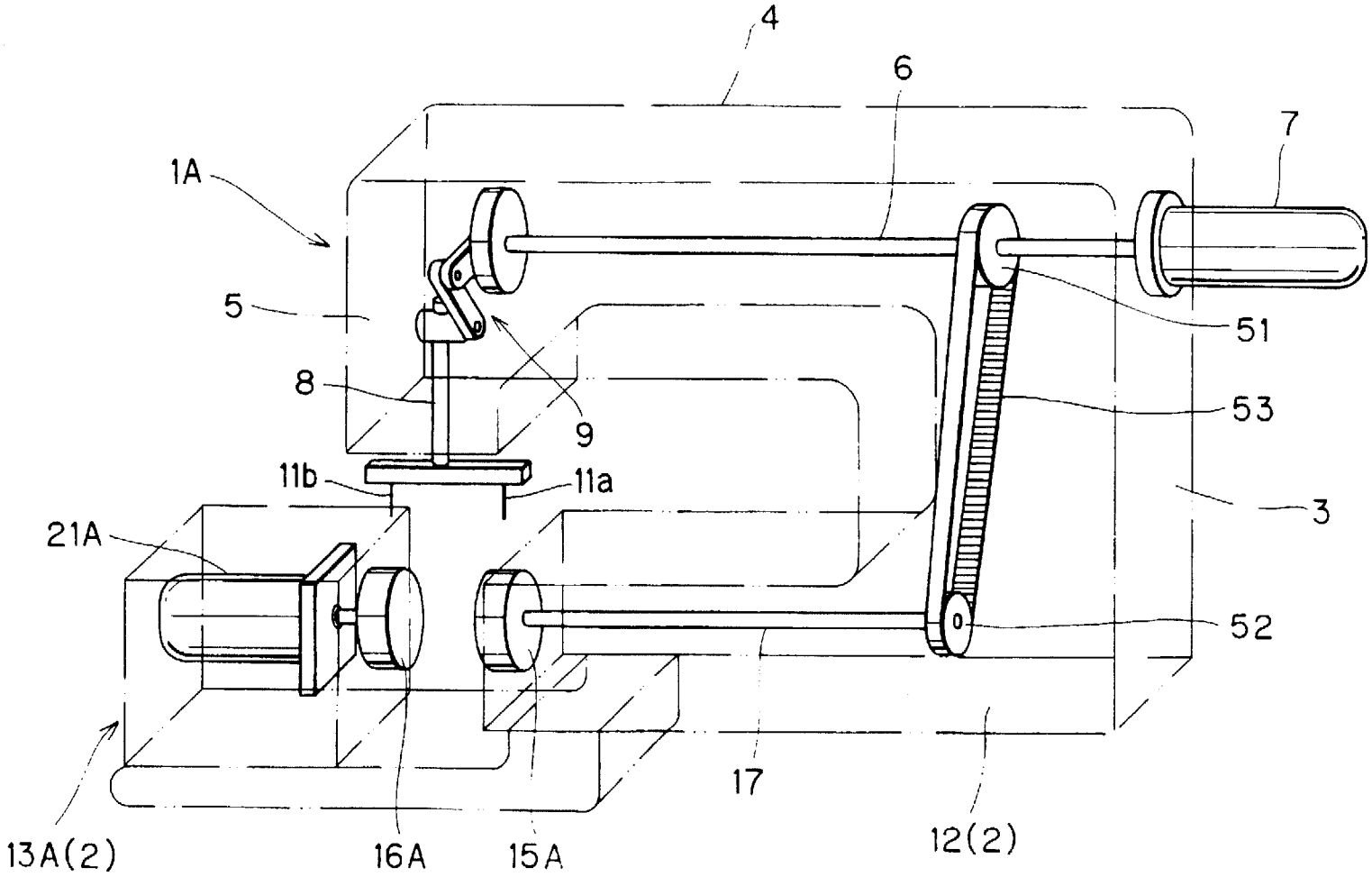
FIG. 18 is a perspective view partially in phantom schematically showing a two-needle sewing machine according to a modification of the first embodiment.

FIG. 18 is a schematic view of a two-needle sewing machine 1A according to a modification of the embodiment. The two-needle sewing machine 1A includes a pair of rotary hooks 15A, 16A. In order to drive the rotary hook 16A using the drive force of the principle shaft 6, a pulley 51 attached to the principle shaft 6 and a pulley 52 attached to the tip of the shuttle shaft 17 are connected by an endless timing belt 53 spanning therebetween. With this configuration, the principle shaft 6 and the shuttle shaft 17 are rotated at the same speed. Although a shuttle module 13A is provided with substantially the same configuration as the shuttle module 13, the shuttle module 13A includes a rotary hook 16A; a servomotor 21A for driving the rotary hook 16A independently from the principle shaft 6; and a drive transmission system for transmitting drive force of the servomotor 21A to the rotary hook 16A.

Other components of the configuration of the shuttle module 13A are substantially the same as those of the shuttle module 13. The two-needle sewing machine 1A differs from the two-needle sewing machine 1 only in that the rotary hooks 15A, 16A are used instead of the oscillating shuttles 15, 16. Therefore, the operations and the effects of the two-needle sewing machine 1A are substantially the same as those of the two-needle sewing machine 1.

Figure 19:
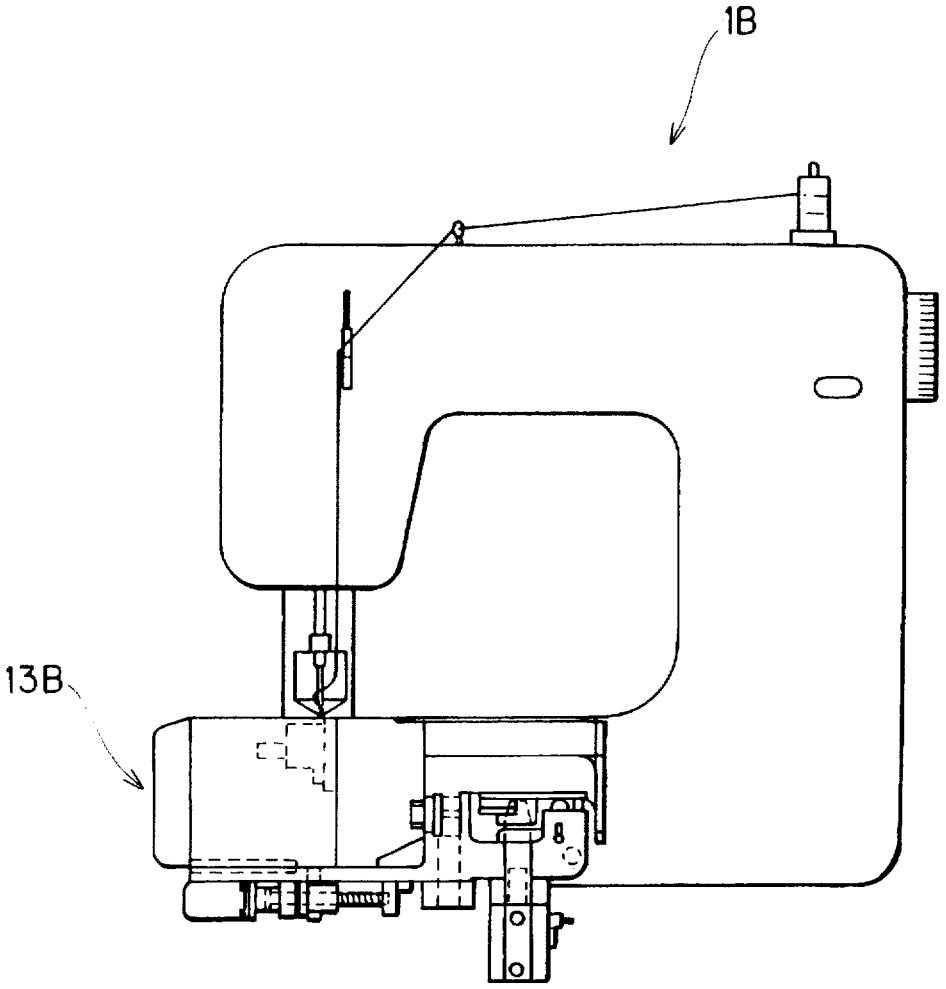
FIG. 19 is a side view showing a single-needle sewing machine according to another modification of the first embodiment.

As shown in FIG. 19, a shuttle module 13B with the same configuration as the shuttle module 13 can be provided to a bed portion of a single needle sewing machine 1B. In this case, the shuttle module 13B can be designed like the shuttle module 13 to pivot horizontally between the usage position and the retracted position.

Alternatively, the shuttle module 13B could be designed to slide in the lengthwise direction of the bed portion between the usage position and the retracted position. In this case, the slide type switching mechanism could be designed to allow switching the position of the shuttle module 13A between the usage position and the retracted position wherein the retracted position is shifted about 10 cm in front of the usage position. When the sewing machine is in use, the shuttle module 13A can be fixed in place by a screw or a bolt. In this case, sufficient space can be secured to allow a user to insert his or her hand between the shuttle module 13 and the head portion by unscrewing the screw or the bolt and switching the shuttle module 13A to its retracted position. This facilitates bobbin replacement and thread processes performed on the oscillating shuttle. The switching action of the shuttle module 13 can be performed manually or via an air cylinder or a solenoid.

Similarly, a shuttle module having the same configuration as the shuttle module 13 can be provided to each bed portion of a multi-head sewing device. For example, the present invention could be applied to a sewing machine provided with two or more thread loop shuttles operated in synchronization with two or more needles. In this case, the thread loop shuttle nearest the column portion could be connected to move with the principle shaft and the other thread loop shuttles could be combined in a unit with their respective motors in a single shuttle module detachably fixed to the bed portion of the sewing machine. In each case, the thread loop shuttle can be either a shuttle or a rotary hook.

The shuttle module 13 can be provided to each bed portion of a multi-head sewing machine to be described later. In this case, the loop taker could be a oscillating shuttle or a rotary hook.

The shuttle module 13 is only an example. A variety of modifications can be made to its configuration and to the components used therein. For example, a pulse motor can be used instead of the servomotor 21. Also, the half rotation shuttle or the rotary hook can be driven directly by a pulse motor or a servomotor.

The positional switching mechanism 55 can be designed so that the retracted position is pivoted more than 45 degrees to, for example, 90 degrees with respect to the usage position.

Although the position switching mechanism 55 is described as a pivotal type position switching mechanism, the sliding type position switching mechanism described above is also applicable. Operations can be further facilitated by employing an air cylinder or a solenoid to switch the position of the shuttle module 13. These modifications to the position switching mechanism can be applied not only to the shuttle of the sewing machine described above, but also shuttle modules provided to normal sewing machines and multi-head sewing machines. Additionally, a variety of modifications can be made to the thread cutting mechanism or to the oil supply mechanism.

Although the present invention is described in the embodiment as applied to a sewing machine using the shuttles 15, 16, the present invention could also be applied to any sewing machine using any type of loop taker, such as a looper type, a rotary hook type, or an oscillating shuttle type. An example of a looper type is described in U.S. Pat. No. 3,742,880, the disclosure of which is incorporated herein by reference. An example of a rotary hook type is described in U.S. Pat. No. 2,085,699, the disclosure of which is incorporated herein by reference. An example of an oscillating shuttle type is described in U.S. Pat. No. 3,006,298, the disclosure of which is incorporated herein by reference.

It is desirable that output torque of the shuttle drive motor 21 be adjustable. In the same manner as the meeting condition memory **143*a* shown in FIG. 23*a*, a reference value, or a default value, for the output torque of the shuttle drive motor 21** and an adjustment amount for bringing the output torque back to the reference value could be preset and stored for each sewing operation of a plurality of stitches. The output torque could be controlled for each sewing operation.

A sewing parameter set including a plurality of sewing parameters, such as the meeting speed and meeting position shown in FIG. 23, the phase offset adjustment amount shown in FIG. 24, and the above-described output torque adjustment amount could be stored in a memory preset for different sewing conditions and a variety of workpiece cloths. Synchronous control can be performed by retrieving the sewing parameter set appropriate for the present workpiece cloth and the sewing conditions. In this case, data of at least one sewing parameter set can be rewritable so that, as necessity dictates, data can be rewritten to produce a new sewing parameter set for performing synchronous control.

In the above-described embodiment, the shuttle drive motor 21 is given as an example of the controlled motor and the sewing machine motor 7 is given as an example of the motor providing reference values. However, the shuttle drive motor can be formed from an induction motor for providing reference values and the sewing machine motor can be formed from a servomotor or a pulse motor to be controlled. In this case, the principal shaft 6 and the shuttle shaft 96 are controlled to operate in synchronization as described above.

The example of fuzzy control given above can be changed as necessary. Instead of a plurality of fuzzy control rules and a plurality of membership function used during fuzzy control, a plurality of control rules determined by a predetermined rule and at least one table preset based on the plurality of control rules can be used to control the speed of the shuttle drive motor or the sewing machine motor.

Figure 64:
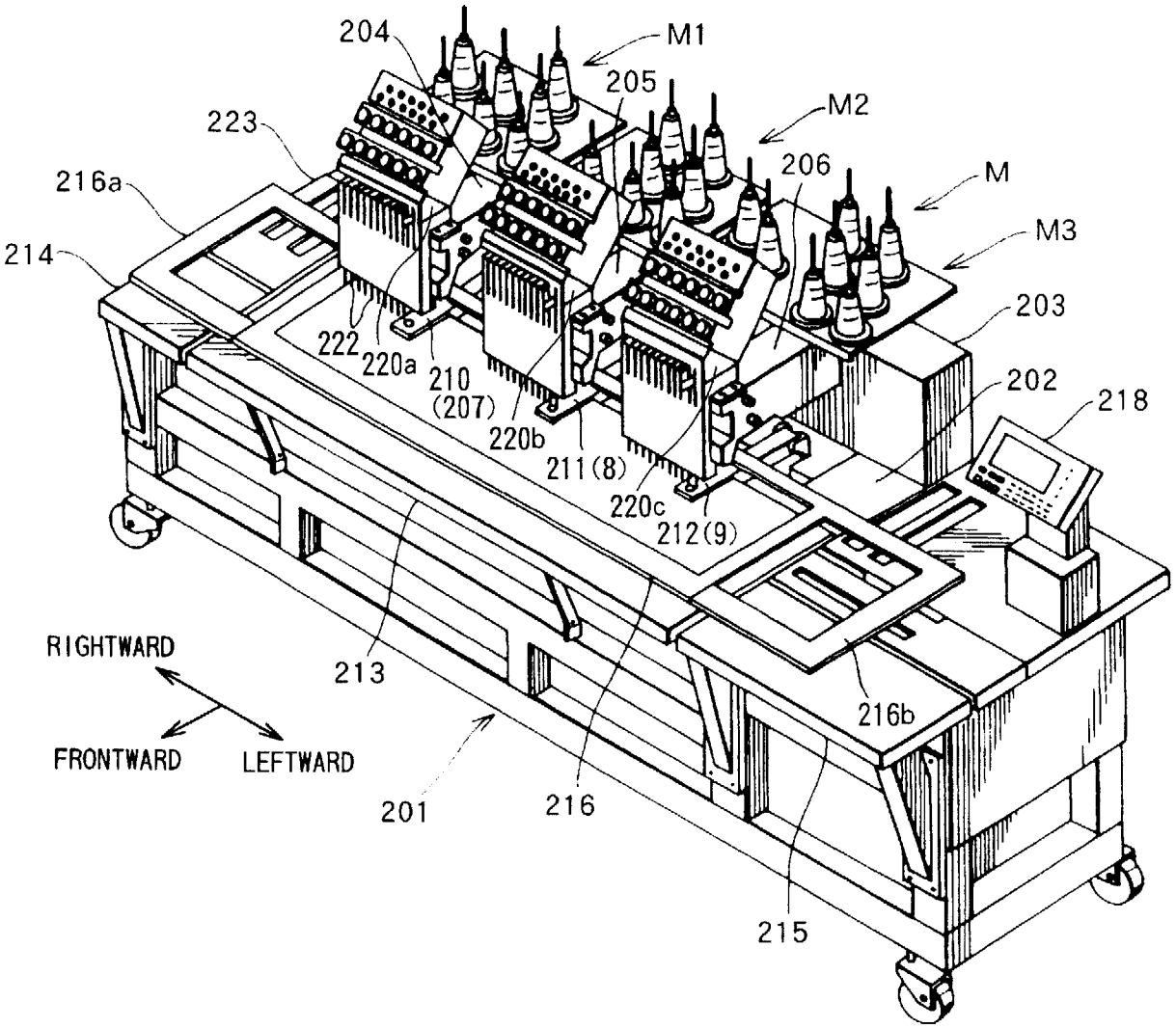
FIG. 64 is a perspective view showing a sewing device according to a second embodiment of the present invention.

Next, an explanation will be provided for a second embodiment applying the present invention to a multi-head type embroidery machine having three embroidery machines. As shown in FIG. 64, three multi-needle type embroidery machines M1 to M3 are aligned on a base frame 201. The three multi-needle type embroidery machines M1 to M3 include cylindrical head portions 207 to 209, which include at their ends independent bed units 210 to 212 detachably provided to a support frame 203. The machine support plate 202 is provided to the rear upper surface of the base frame 201. The machine support plate 202 has a substantially rectangular plate shape extending to a predetermined length horizontally, that is, rightward and leftward as shown in FIG. 64. The support frame 203 extends in the horizontal direction and is provided with an upright posture to the rear edge of the machine support plate 202. The three head portions 204 to 206 are aligned along the support frame 203 in the horizontal direction separated by a predetermined distance. The cylindrical bed portions 207 to 209 are supported on the base frame 201 at the front edge of the machine support plate 202 at positions corresponding to respective head portions 204 to 206. The bed units 210 to 212 are swingable via a pivot mechanism 270 at their rear edges and can be detached from the support frame 203.

Twelve needle bars 221 aligned along to the front edge of each head portions 204 to 206 of the embroidery machines M1 to M3 are supported movable in the vertical direction by needle bar cases 220*a* to 220*c*, respectively. Twelve levers 223 are swingably supported by each of needle bar cases 220*a* to 220*c*. Each needle bar case 220 is itself supported movable in the horizontal direction.

A horizontal operation table 213 is provided to the front side of the machine support plate 202 so as to be flush with the upper surface of the bed portions 207 to 209. A pair of side tables 214 and 215 are provided to the right and the left sides of the operation table 213 as viewed in FIG. 64. A rectangular plate-shaped movable frame 216 extends in the horizontal direction to span across the operation table 213 and the side tables 214 and 215.

A drive frame portion 216*a* is disposed at the left edge of the movable frame 216 and is driven to move in an X-axis direction, that is, in the horizontal direction, by an X-axis drive mechanism (not shown in the drawings). A drive frame portion 216*b* is disposed on the right edge of the movable frame 216. The drive frame portion 216*b* and the drive frame portion 216*a* are driven to move in a Y-axis direction, that is, frontward and backward as shown in FIG. 64, by a Y-axis drive mechanism (not shown in the drawings). With this configuration, the movable frame 216 is movable across an X-Y plane by the X-axis and Y-axis drive mechanisms, respectively driven by an X-axis and a Y-axis drive motor (not shown in the drawings). Also, an operation panel 218 for displaying messages about embroidery and for inputting a variety of commands is provided to the rear side of the side table 216*b*.

Figure 65:
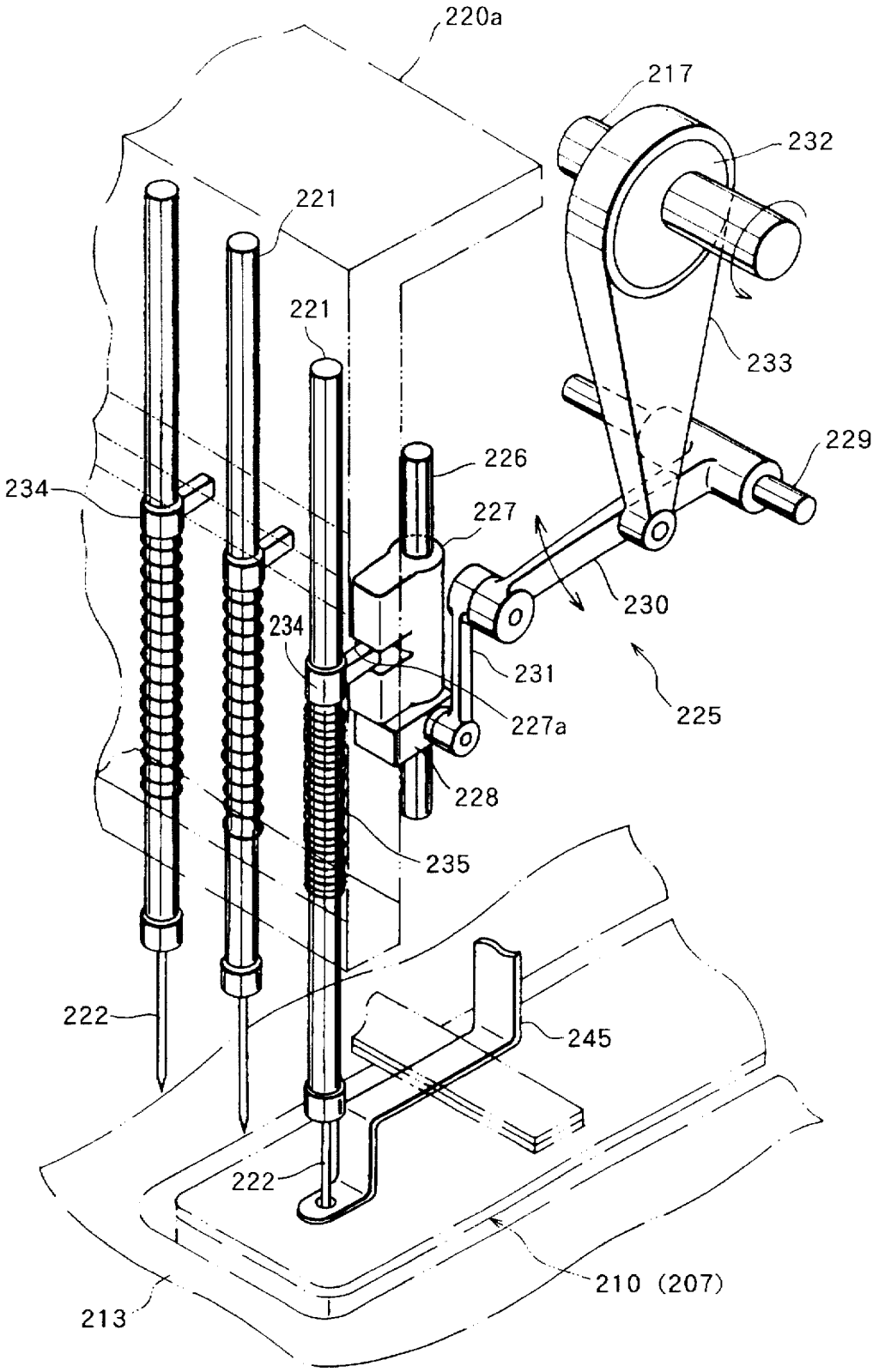
FIG. 65 is a perspective view partially in phantom showing a mechanism for driving vertical movement of needles in a head portion of the sewing device according to the second embodiment.

Next, an explanation for one of a plurality of needle bar vertical drive mechanisms 25 for driving the needle bar 221 up and down will be provided while referring to FIG. 65.

Figure 66:
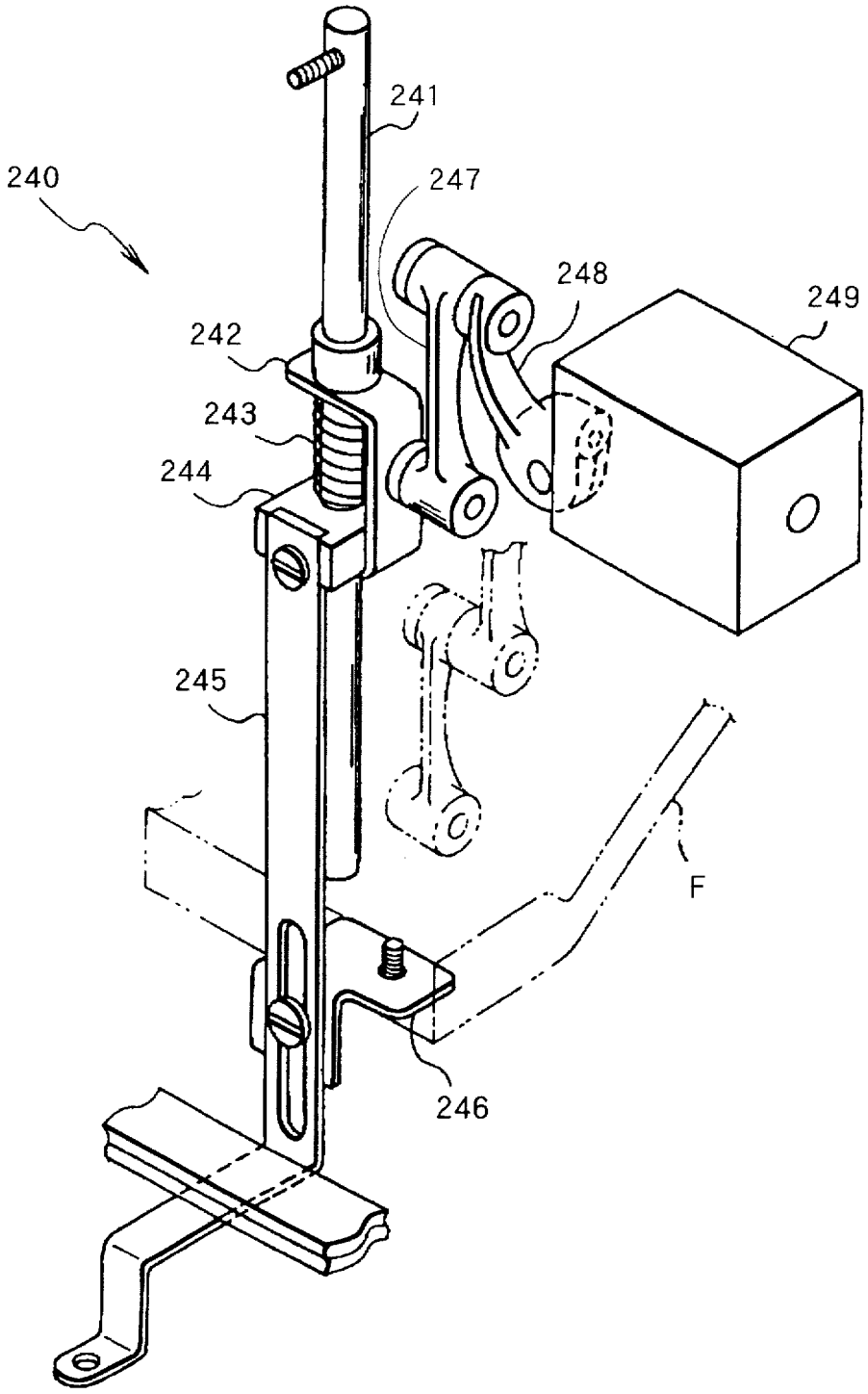
FIG. 66 is a plan view showing a presser foot drive mechanism for vertically moving a presser foot of the sewing device according to the second embodiment.

A base needle bar 226 extending in the vertical direction is provided on the tip of each head portion 204 to 206 for each needle bar 221. Each base needle bar 226 is fixed at its upper and lower ends to a frame F as shown in FIG. 66. Each base needle bar 226 is inserted into a cylindrical vertical motion member 227 having an engagement groove 227*a* connected to a connecting pin 234 (to be described later). A needle bar holder 228 near the lower end of each vertical motion member 227 is integrally formed with each base needle bar 226. The needle bar holder 228 is connected to a link 231, which is connected to a swing lever 230 swingably supported by a support shaft 229.

An eccentric cam 232 is fixed to a machine principal shaft 217, which is disposed to extend horizontally through each head portion 204 to 206. An eccentric lever 233 supported on the eccentric cam 232 is connectedly at its lower end to the swing lever 230.

Also, a sewing needle 222 is provided at the lower tip portion of each of the 212 needle bars 221. The connecting pin 234 is fixed to the needle bar 221 at its center in its height direction. A compression spring 235 wound around the needle bar 221 is disposed between the connecting pin 234 and a needle bar support frame at the lower edge of the needle case 220. The needle bar 221 is constantly urged into an upper needle position by the compression spring 235. Further, the connecting pin 234 confronting the vertical motion member 227 can be selectively engaged in the engagement groove 227*a* of the vertical motion member 227.

The sewing machine principal shaft 217 is rotated in a predetermined rotation direction by rotational drive of a machine motor (not shown in the drawings). Corresponding operation of the eccentric lever 238 and the swing lever 230 drives the vertical motion member 227 up and down, thereby driving the needle bar 221 up and down via the connecting pin 234.

The vertical motion member 227 is capable of switching from a connecting position shown in FIG. 65 to and a connecting retracted position (not shown in the drawings) by rotating the vertical motion member 227 about 90 degrees using a needle bar connecting motor (not shown in the drawings). When the needle bar connecting motor drives the vertical motion member 227 to switch from the connecting position to the retracted position, the needle bar 221 is moved upward by urging force of the compression spring 235 in what is called a jump operation.

Next, an explanation for a presser foot drive mechanism 240 for vertically moving a presser foot 345 in 81 accordance with sewing operations will be provided while referring to FIG. 66. A support shaft 241 with an upright posture is disposed to the rear side of the base needle bar 226. A vertical motion frame 242 having a reversed C-shape when viewed from the front slidingly supports the support shaft 241. A foot pressure spring 243, formed from a compression spring, and a slide block 244 are slidably fitted on the support shaft 241 to the interior of the vertical motion frame 242. The upper end of the presser foot 45 is fixed to the slide block 244. The lower end of the presser foot 245 is supported movable in the vertical direction by a guide plate 246 of the frame F.

On the other hand, the vertical motion frame 242 is connected to a foot presser drive motor 249 via two links 247 and 248. When a sewing operation is started, the link 248 is driven to rotate by the presser foot drive motor 249. As a result, the two links 247 and 348 are moved downward into the posture shown by a two-dot chain line. This moves the vertical motion frame 242 and the presser foot 245 downward so that the lower edge of the presser foot 245 presses the workpiece cloth. At this time, the spring force of the presser foot spring 243 generates pressure at the presser foot 245 and also absorbs the differences in height of the presser foot 245 generated by different thickness workpiece cloths. When the sewing operation is finished, the link 248 is driven to rotate to a waiting position shown by the solid line in FIG. 66 so that the movable frame 216 can move.

Next, an explanation for the bed units 10 to 12 will be provided while referring to FIGS. 67 to 71. Because the three bed units 210 to 212 have the same configuration, the leftmost bed unit 210 will be explained as a representative example.

The bed unit 210 includes a bed case 250 substantially U-shape in cross section and extending in the frontward and rearward directions. The bed case 250 is swingably supported at its rear edge portion on the base frame 201 via a pivot mechanism 270. A shuttle module 253 is detachably fixed to the front end of the bed case 250. The upper side of the bed case 250 is covered with a needle plate 251 at its front portion and with a cover plate 252 near the base frame 201. The cover plate 252 is connected to the needle plate 251.

Figure 70:
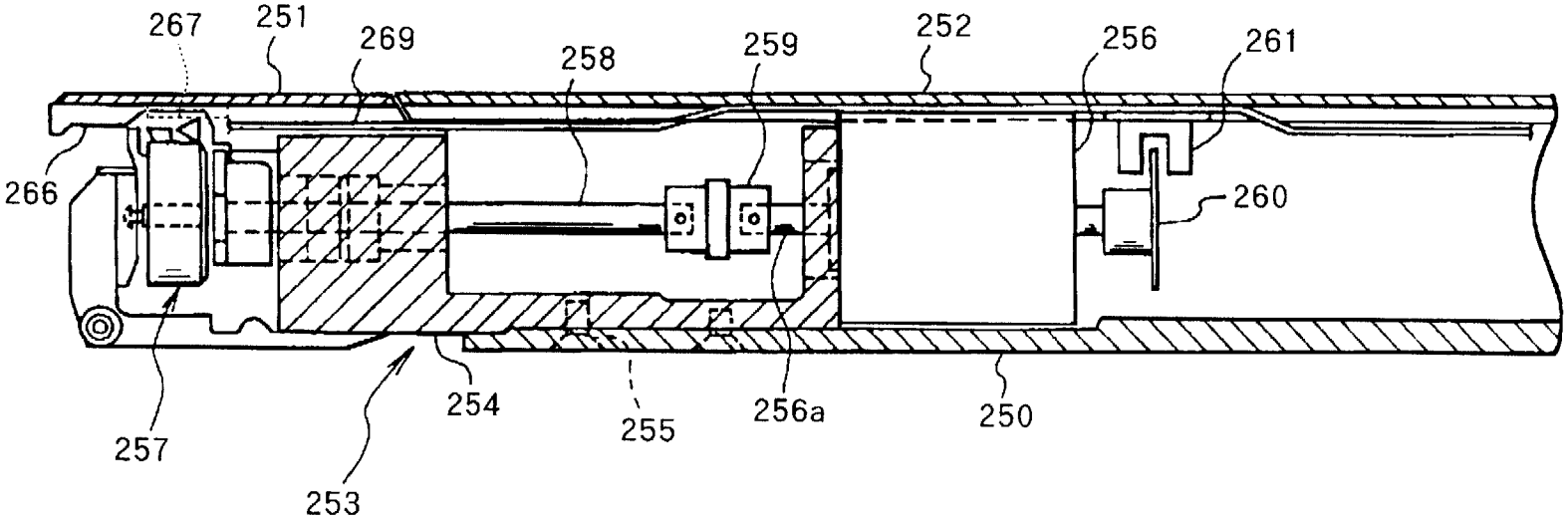
FIG. 70 is a cross-sectional view showing details of the bed unit.

Next, an explanation for the shuttle module 53 will be provided with reference to FIG. 70. An attachment block 254 is detachably fixed to the front edge portion of the bed case 250 by a screw 255. A shuttle drive motor 256 formed from a pulse motor is attached to the rear tip of the attachment block 254. A rotary hook 257 for taking a thread loop is provided to the front tip of the attachment block 254. A shuttle drive shaft 258 fixed to the rotary hook 257 extends rearward through the inside of the attachment block 254 to the shuttle drive motor 256 where a coupling 259 connects it to a drive shaft 256*a* of the shuttle drive motor 256. Further, a disc encoder 260 is attached to the drive shaft 256*a* at the end opposite that attached to the coupling 259. A photosensor 261 for optically detecting a plurality of slits formed in the disc encoder 260 is fixed to the interior wall of the cover plate 252. The shuttle drive motor 256 drives the shuttle drive shaft 258 to rotate so that the rotary hook 257 is driven in a predetermined rotational direction.

Figure 69:
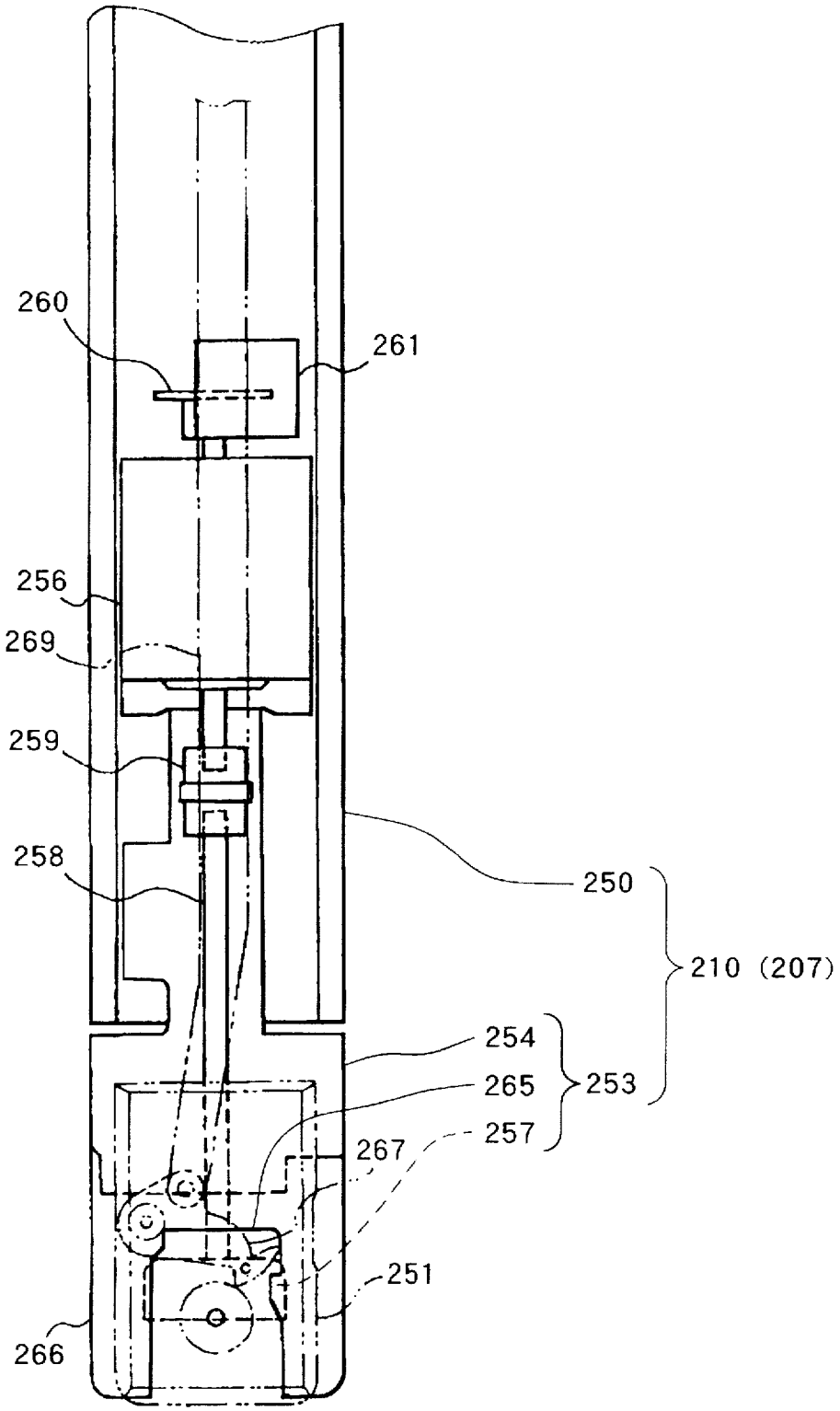
FIG. 69 is a plan view partially in phantom showing the bed unit with the cover plate removed.

Next, a brief explanation for a thread cut mechanism 265 provided in the attachment block 54 will be provided with reference to FIG. 69. A fixing plate 266 fixed to the attachment block 254 extends over the rotary hook 257. A movable blade 267 is rotatably supported by the fixing plate 266. A fixed blade (not shown in the drawings) for cutting the needle thread and the bobbin thread in association with the movable blade 267 is attached under the needle plate 251, which is provided to the right upper side, when viewed in FIG. 69, of the fixing plate 266. Further, a thread cutting operation lever 269 connected to the movable blade 267 extends backward inside the bed case 250. Forward movement of the thread cut operation lever 269 rotates the movable blade 267 in the clockwise direction and brings the needle thread and bobbin thread together. Then, rearward movement of the thread cut operation lever 269 rotates the movable blade 267 in the counterclockwise direction and cuts the needle thread and the bobbin thread at the same time by cooperation of the movable blade 267 and the fixed blade.

To detach the shuttle module 253 from the bed portion 210, first the operator removes the cover plate 252. Then the operator unscrews the screw 255, thereby disconnecting the attachment block 254 from the bed case 250. The user can then easily remove the attachment block 254, the cutting mechanism, the shuttle 257, the drive motor 256, and the like from the bed case 250 by lifting the shuttle module 253 upward. As shown in FIG. 70, the disc encoder 260 can be removed from the photosensor 261 by lifting the shuttle end upward and pivoting the system around the motor 256 to lower the disc encoder 260 and pull it out from the photosensor 261.

Next, an explanation for the pivot mechanism 270 for switching the position of the bed unit 210 between a horizontal usage position and a retracted position, in which the bed unit 210 is swung downward from the usage position, will be provided while referring FIGS. 67 to 68 and FIGS. 71 to 72. Again, because three bed units 210 to 312 have the same configuration, the pivot mechanism 270 provided to the leftmost bed unit 210 will be explained as a representative example.

Figure 71:
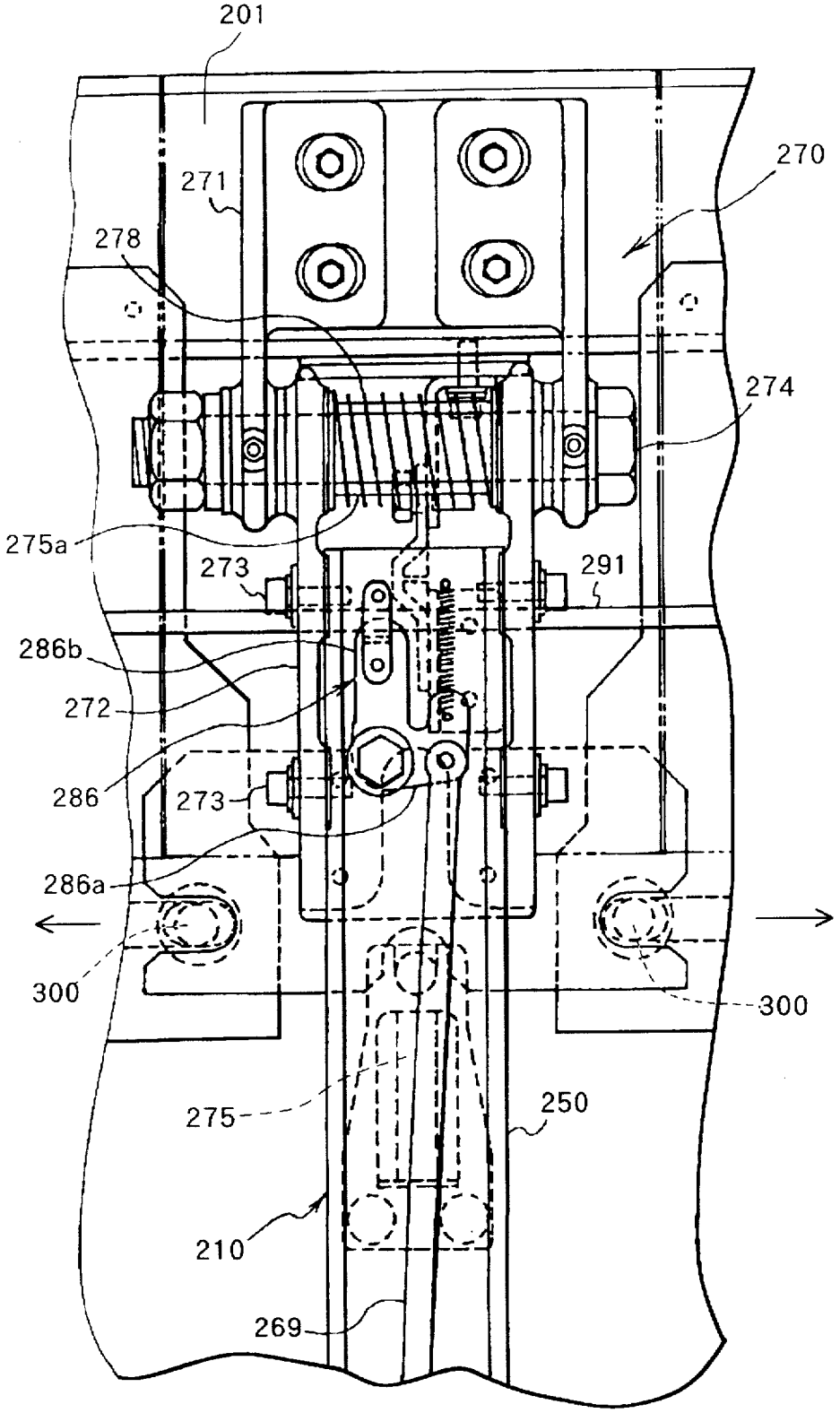
FIG. 71 is a magnified view showing essential portions of a pivot mechanism for switching the bed unit between the usage position and the retracted position.
Figure 72:
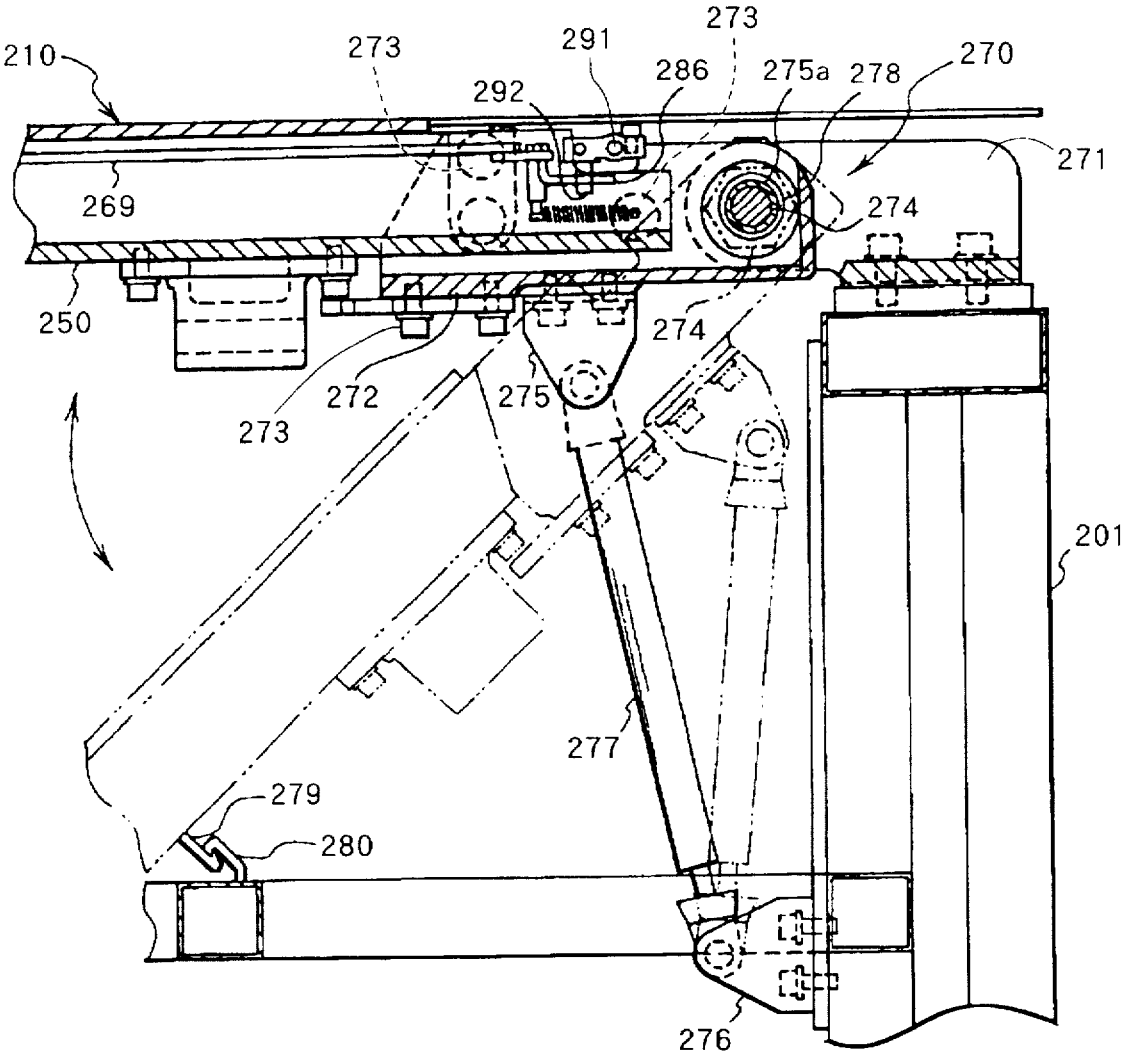
FIG. 72 is a magnified side view partially in cross section showing essential portions of the pivot mechanism.

As best shown in FIGS. 71 and 72, the base of a support bracket 271 is bolted to the base frame 201. On the other hand, the base of the U-shaped bed case 250 at its rear end is fixed by bolts 273 to a connecting bracket 272 also having a substantially U shape in cross section. The rear edge portion of the connecting bracket 272 is supported by the support bracket 271 vertically swingable around a support bolt 274. In other words, the base of the bed unit 210 is supported swingable around a horizontal shaft at right angles to the length direction of the bed portion 204. An air damper 277 is bolted to the lower edge of the connecting bracket 272 and a lower edge of the base frame 201 via a pair of supports brackets 275, 276. A sleeve 275*a* is provided around the support bolt 274 in the support bracket 271. A swing urging spring 278 for urging the bed unit 210 to rotate into the usage position is wound around the sleeve 275*a*.

With this configuration, the bed unit 210 is normally maintained in the horizontal usage position shown by a solid line in FIG. 72 by the strong elasticity of the air damper 277. However, when the bed unit 210 is not in use, the front edge portion of the bed unit 210 is swung downward to the retracted position at substantially 45 degrees as shown by two-dot line in FIGS. 68 and 72. At this point, a hook 279 attached to the bed case 250 engages with an engagement member 280 of the base frame 201 and is fixed in the retracted position. When the hook 279 is released from the holding member 280 by operating a release lever (not shown in the drawings), the bed unit 210 is switched back to it usage position by resilience of the air damper 277. To detach the bed unit 10 from the support frame 203, the operator needs only unscrew the support bolts 274, pull bolts 300 to the sides as indicated by arrows in FIG. 71, and lowering the bed unit 210 downward.

Figure 67:
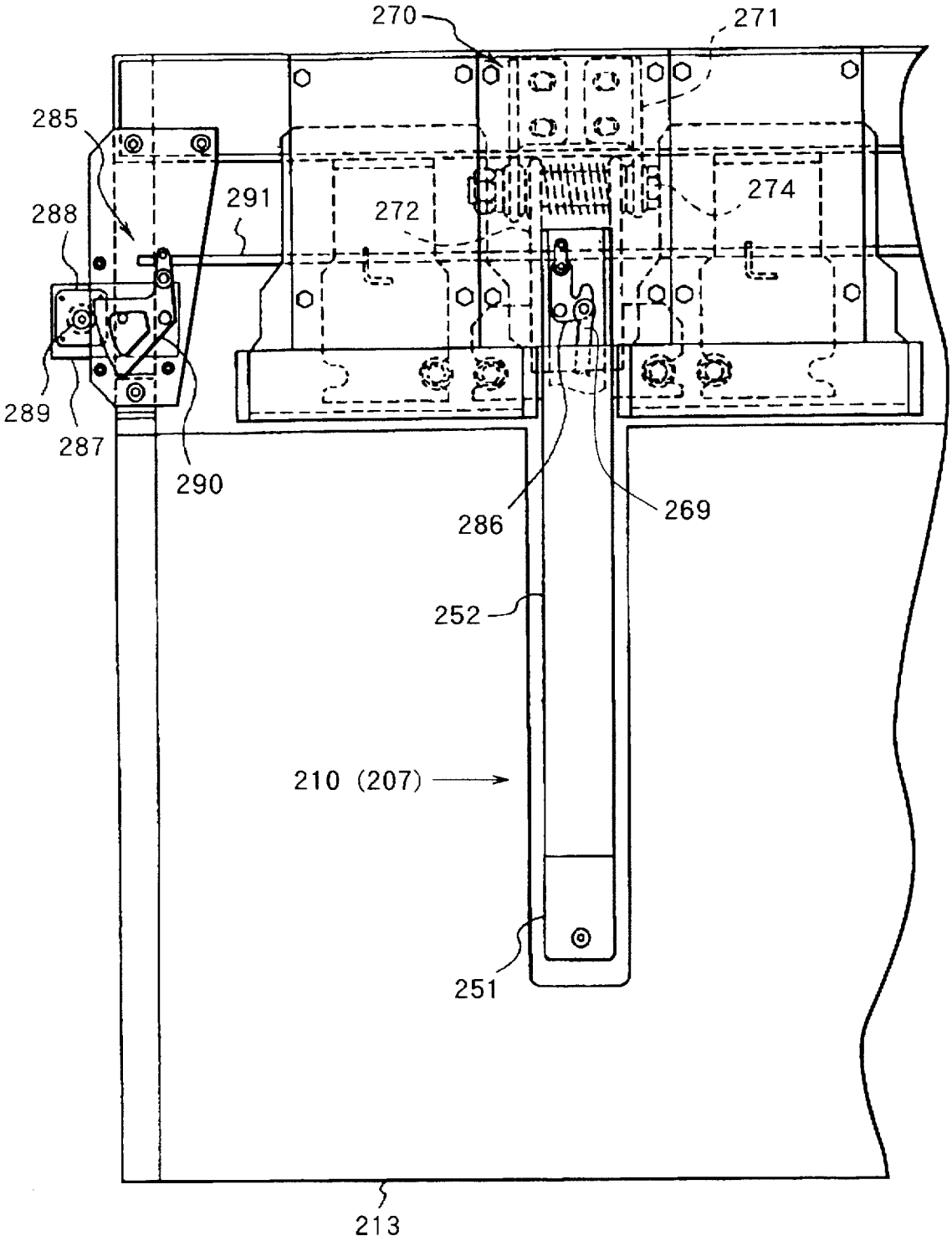
FIG. 67 is a plan view partially in phantom showing a work table and a bed unit detachably provided to the work table.
Figure 68:
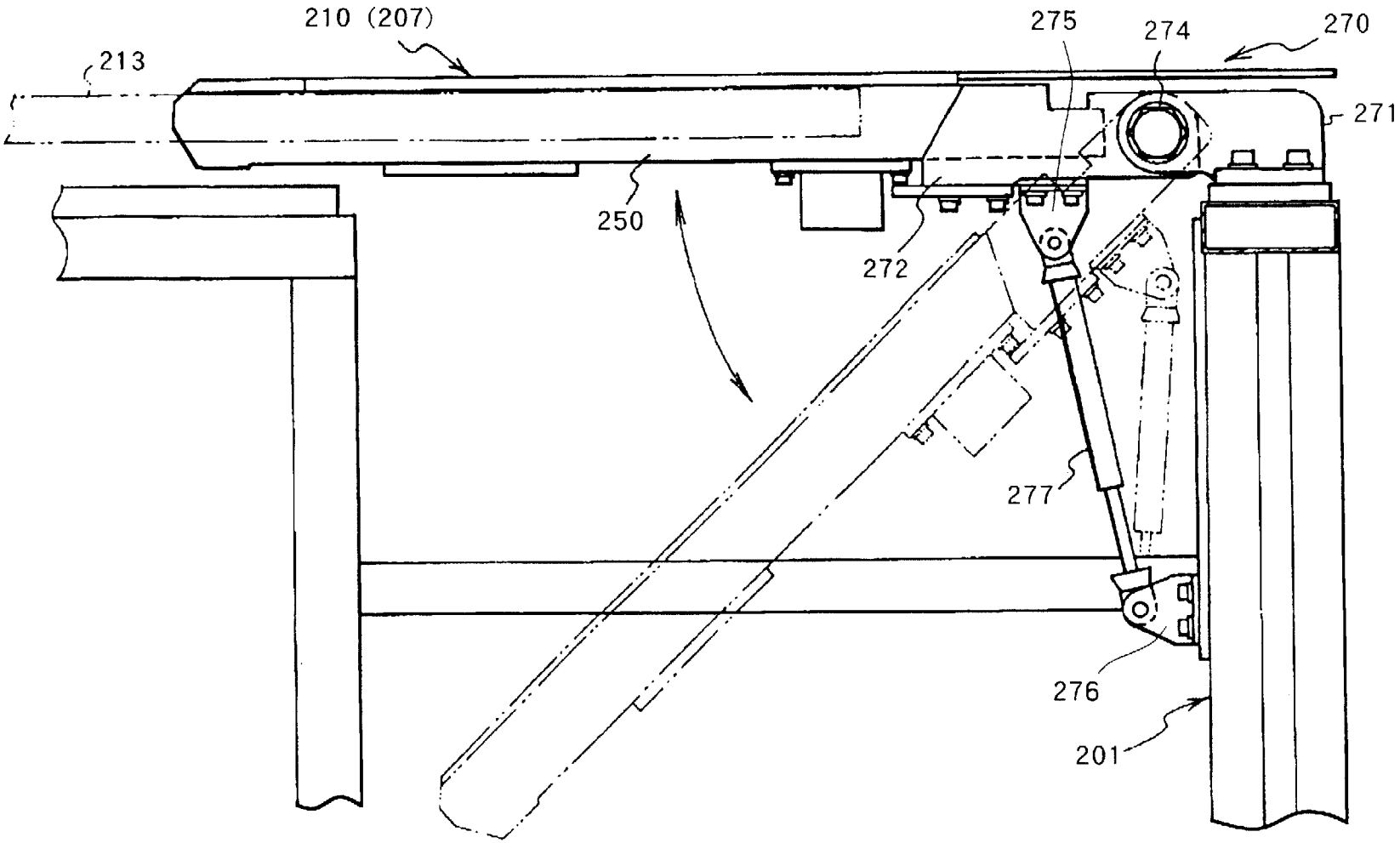
FIG. 68 is a side view showing the bed unit in a usage position (solid line) and a retracted position (two-dot chain line) with respect to the work table.

Next, an explanation for a thread cut drive mechanism 285 for operating the thread cut mechanism 265 provided to the bed unit 210 will be provided while referring FIGS. 67 and 71 to 72.

As shown in FIG. 67, a rotation plate 286 is fixed horizontally rotatable to the rear edge portion of the bed case 250. The rear edge of a thread cut operation lever 26*a*is connected to a slave portion 286*a* (see FIG. 71) of the rotation plate 286. On the left edge portion of the frame 201, a thread cut motor 288 is attached to an attachment plate 287 fixed to the base frame 201. Also, a swing member 290 meshingly engaged with a drive gear 89 of the thread cut motor 288 is rotatably supported by the attachment plate 287. Further, the left edge portion of a horizontally extending thread cut operation shaft 291 is connected to the tip of the swing member 290. A pin member 292 is attached to the thread cut operation shaft 291 at a position corresponding to a drive portion 86*b* of the rotation plate 286. A pin of a pin member 292 is held in a slot formed in the drive portion 286*b* of the rotation plate 286.

With this configuration, the swing member 290 is rotated in the clockwise direction to a predetermined angle by the rotation of the thread cut motor 288 in the counterclockwise direction. The rotation plate 286 is then rotated in the clockwise direction via the rightward movement of the thread cut operation shaft 291, which moves the thread cut operation lever 269 forward. Afterward, the rotation plate 286 is rotated in the counterclockwise direction via the leftward movement of the thread cut operation shaft 291 by the rotation of the thread cut motor 288 in the clockwise direction. As a result, the needle thread and the bobbin thread are cut simultaneously by the thread cut mechanism 265 described above.

Figure 73:
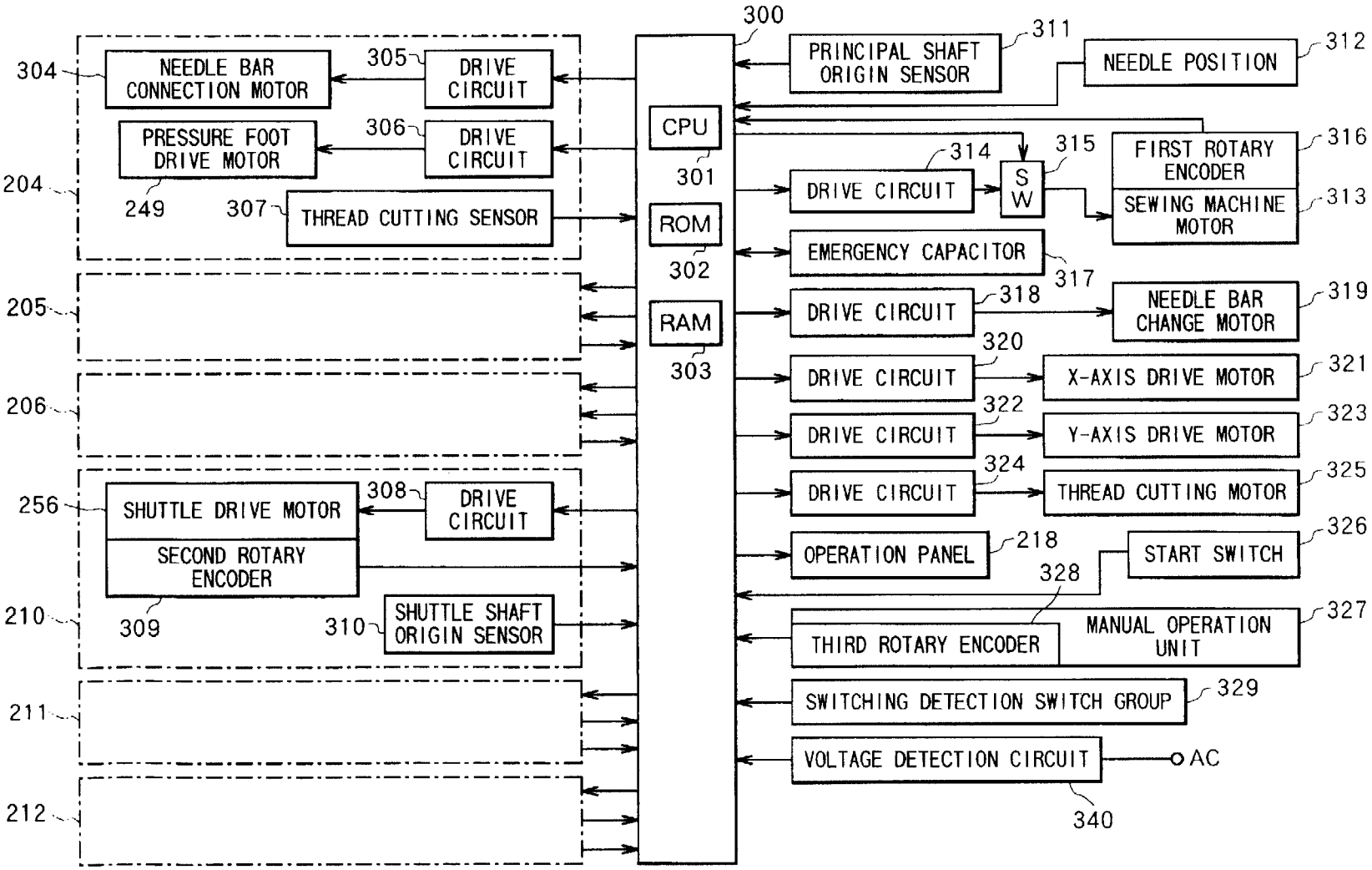
FIG. 73 is a block diagram schematically showing a control system according to the second embodiment.

Next, the control system of the multi-head type embroidery sewing machine M will be described based on the block diagram shown in FIG. 73.

A control unit 300 is configured basically the same as the control unit 140 of the two-needle sewing machine 1 and has a microcomputer in the input interface (not shown in the drawings) and the output interface (not shown in the drawings). The microcomputer includes a CPU 301, a ROM 302, and a RAM 303 and is connected to the input interface and the output interface via the bus such as a data bus for transmitting data to the microcomputer.

Components of the head portion 204, such as a drive circuit 305 for driving the needle bar connection motor 304, a drive circuit 306 for driving the pressure foot drive motor 249, and a thread cutting sensor 307 are connected to the control unit 300. Components of the other bed portions 205, 206 are connected in the same manner. Components of the bed unit 210, such as a drive circuit 308 for driving the shuttle drive motor 256, the second rotary encoder 309 including the disc encoder 260 and the photosensor 261, and the shuttle shaft origin sensor 310 are connected to the control unit 300. Components of the other bed units 211, 212 are connected to the control unit 300 in the same manner.

The control unit 300 is also connected to various other components are also connected to including a principal shaft origin sensor 311, a needle position sensor 312, a drive circuit 314 for driving the sewing machine motor 313 via a switch 315, a first rotary encoder 316 provided to a sewing machine motor 313, an emergency capacitor 317, a drive circuit 318 for driving the needle bar change motor 319, a drive circuit 320 for driving the X axis drive motor 321, a drive circuit 322 for driving the Y axis drive motor 323, a drive circuit 324 for driving the thread cutting motor 325, the operation panel 318, the start switch 326, the third rotary encoder 328 in the manual operation unit 327, a switching detection switch groove 329 for detecting whether or not each of the bed units 210 to 212 are in the usage position, and a voltage detection circuit 340 for detecting voltage of a power source.

The first rotary encoder 316 of the present embodiment outputs a rotary signal in the same manner as the first rotary encoder 157 of the previous embodiment. The rotary signal from the first rotary encoder 316 of the present embodiment includes a Z-phase signal and an A-phase signal. The A-phase signal is a clock pulse signal outputted in accordance with rotation of the sewing machine motor 313. The Z-phase signal serves as a motor origin signal outputted with each rotation of the sewing machine motor 313. The Z-phase signal is a pulse signal. The second rotary encoder 309 of the present embodiment outputs a rotary signal in the same manner an the rotary encoder 163 described in the previous embodiment. The rotary signal from the second rotary encoder 309 includes the A-phase signal and the Z-phase signal. The A-phase signal is a clock pulse signal outputted in accordance with rotation of the shuttle drive motor 256. The Z-phase signal, which is a pulse signal, serves as a motor origin signal outputted with each rotation of the shuttle drive motor 256. Further, the electrical components, such as those indicated by the numbers 218, 311 through 312, and 326 through 340, output signals in the same manner as components 26, 155 through 156, and 144, 23, 145, 164, and the like having similar roles in the control system of the previous embodiment.

Figure 74:
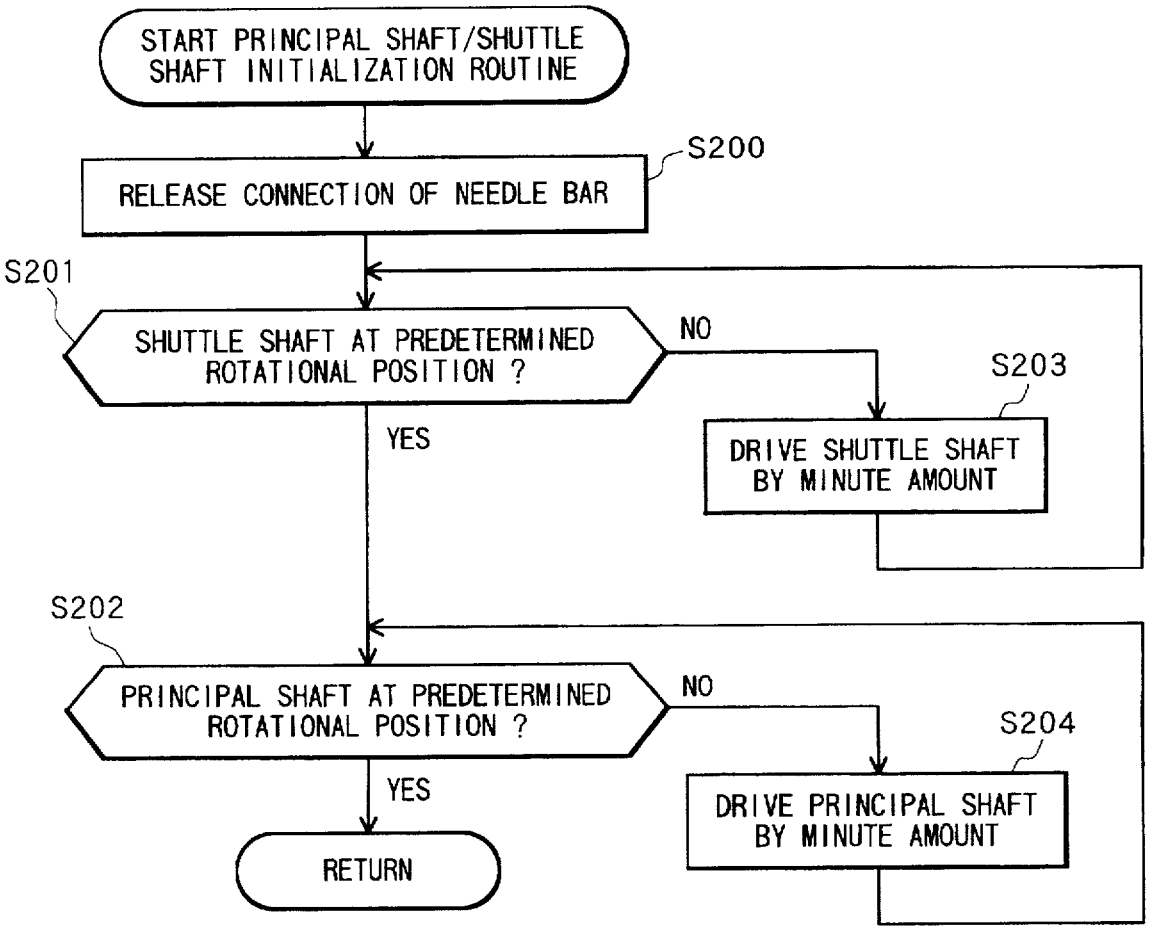
FIG. 74 is a flowchart representing a principal shaft/shuttle shaft initialization routine of the control system according to the second embodiment.

The multi-head embroidery sewing machine M is controlled by the control unit 300 basically in the same manner as described in the previous embodiment. Differences in the principal shaft/shuttle shaft initialization routine will be explained while referring to the flowchart shown in the FIG. 74. When the initialization routine starts, the needle bar connection motor 304 is driven and a connection release operation for the needle bar 221 is executed in S200. That is to say, at this time, the needle bar 221 jumps to its upper dead center position. When the shuttle shaft 258 is not at a predetermined rotational position, for example, the shuttle shaft 258 is not at a position corresponding to the upper dead center position of the needle bar 221 (S201:NO), then the shuttle drive motor 256 is driven repeatedly in S203 until S201 results in a positive determination. When the shuttle shaft 258 is rotated to its predetermined rotational position (S201:YES), then the principal shaft 217 is driven in S204 to rotate into a predetermined rotational position, for example, wherein the needle bar 221 is at its upper dead center position, until S202 results in a positive determination. When the principal shaft 217 is rotated into its predetermined rotational position (S202:YES), then this routine is ended and the program returns to the main routine.

Figure 75:
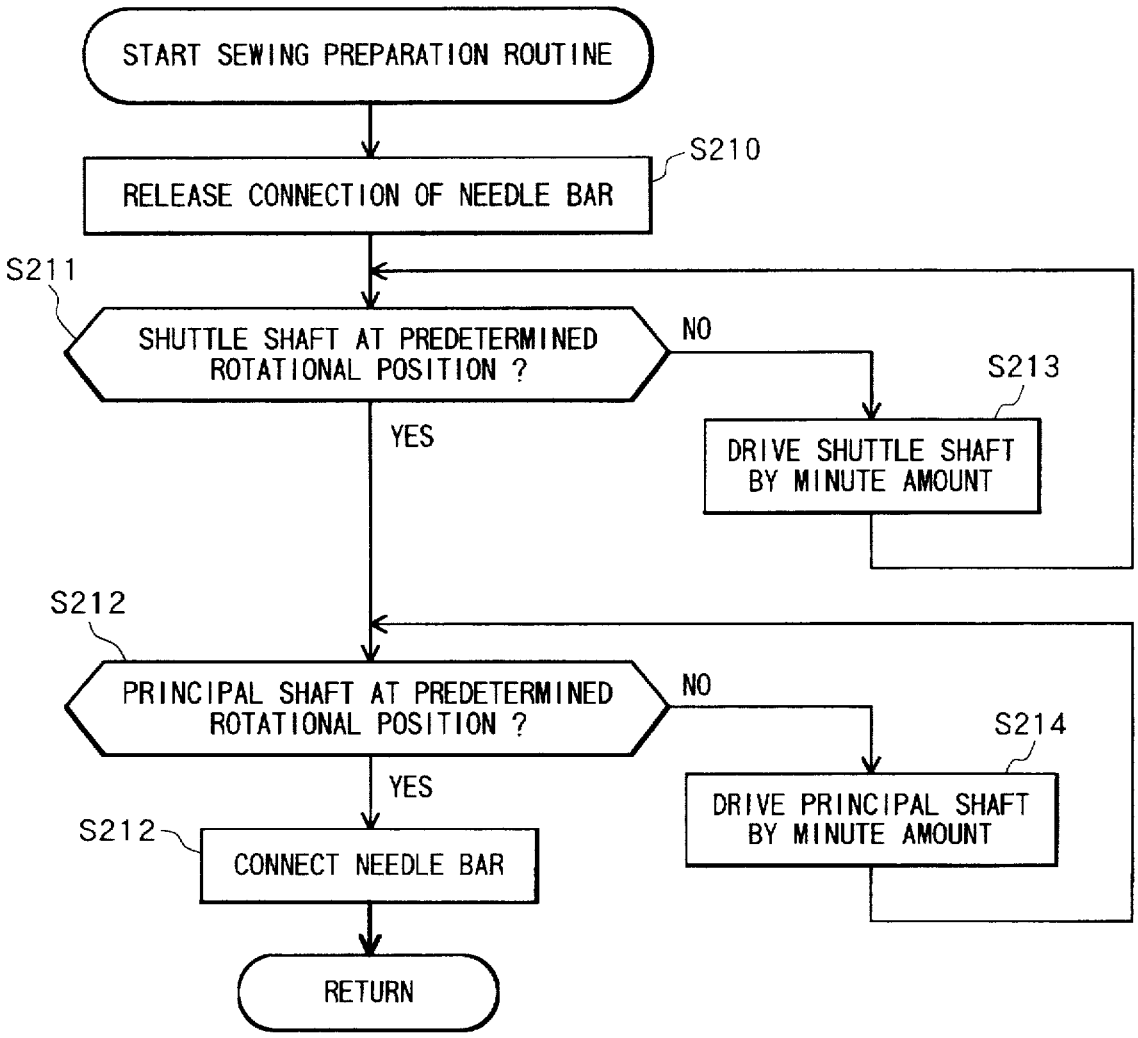
FIG. 75 is a flowchart representing a sewing preparation routine of the control system according to the second embodiment.

Next, an explanation will be provided for a sewing preparation routine executed in preparation for start of the sewing start routine will be explained while referring to the flowchart shown in FIG. 75.

First, the needle bar connection motor 304 is driven and connection release operations are executed on the needle bar 221 in S210. At this time, the needle bar 221 jumps to its upper dead center position. When the shuttle shaft 258 is not at a predetermined position, for example, not at a position corresponding to the upper dead center position of the needle bar 221 (S211:NO), then the shuttle drive motor 256 is driven in S213 until the shuttle shaft 258 is rotated into its predetermined rotational position so that S211 also results in a positive determination. When the shuttle shaft 258 is rotated into its predetermined rotational position (S211:YES), then the sewing machine motor 313 is driven in S214 until the shuttle shaft 217 is rotated into a predetermined rotational position, for example, when the needle bar 221 is at its upper dead center position, so that S212 results in positive determination. When the principal shaft 217 is rotated into its predetermined rotational position (S212:YES), the needle bar connection motor 204 is driven and connection operations for the needle bar 221 are executed in S215. Then, this routine is ended and the program returns to the main routine.

Figure 76:
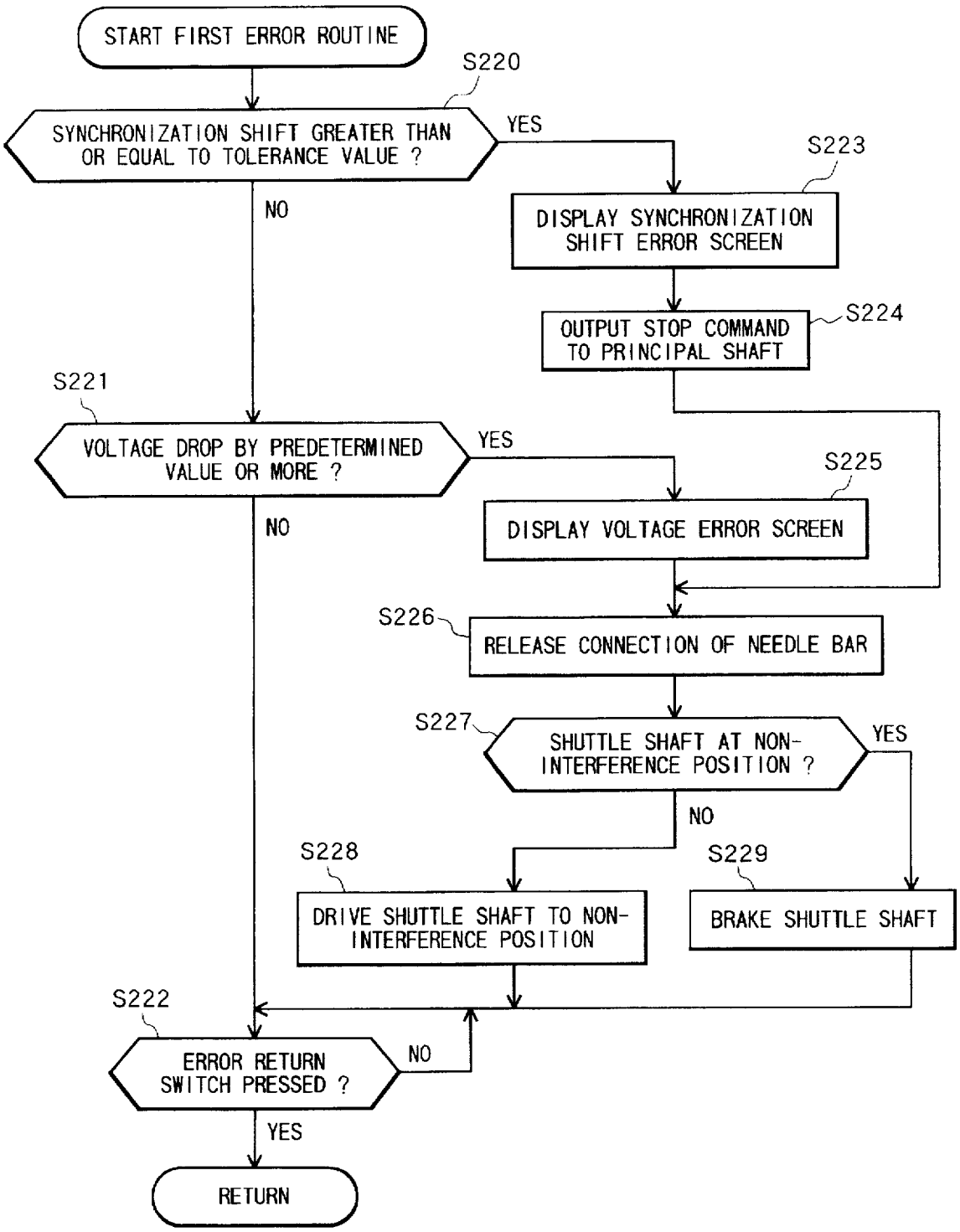
FIG. 76 is a flowchart representing a first error routine of the control system according to the second embodiment.

Next, an error routine executed when a shift amount of the shuttle shaft 258 equals or exceeds the tolerance value or when the power source voltage drops by or more than a predetermined value will be explained with reference to the flowchart shown in FIG. 76.

When an error is generated, the first error routine is started. First, a synchronization shift error screen is displayed in S223. Then, a stop command for stopping the rotation of the principal shaft 217 is outputted in S224. Next, as described previously, the connection release operation for the needle shaft 221 is executed in S226. Next, when the sewing needle 222 and the loop seizing beak of the rotary hook 255 are at a non-interference position where they will not collide (S227:YES), then braking operations are performed in S229 for stopping the shuttle drive motor 256 in order to stop the shuttle shaft 258. Afterward, when the error recovery switch is operated (S222:YES), this routine is ended and the program returns to the main routine.

On the other hand, when the sewing needle 222 and the loop seizing beak are in a position where they might possibly collide (S227:NO), then the shuttle drive motor 256 is driven to rotate the shuttle shaft 258 to a non-interference position in S228. When it is determined based on the voltage signal from the voltage detection circuit 340 that the power source voltage has dropped by or greater than a predetermined value (S220:NO, S221:YES), then a voltage drop error screen is displayed on the display in S225 while power is supplied from the emergency capacitor 317. Then in the same way, S226 through S229 are executed. Afterward, when the error recovery switch is operated (S222:YES), then this routine is ended and the program returns to the main routine.

The shuttle module 251 achieves the same effects and operations as the shuttle module 30 described in the previous embodiment. Further, the connection pin 234 of the needle bar 215 and the vertical movement port member 227 are disengaged when power is turned on so that the needle bar 215 jumps to its needle upper stop position. Therefore, even if the synchronization shift is generated by manual operations, the loop seizing beak of the rotary hook 257 will not collide with the sewing needle 222. Also, an initialization routine for synchronizing the sewing needle 215 and the rotary hook 257 when power is turned on can be simplified.

We claim:

1. A sewing machine comprising:

a head portion including a needle bar that mounts a needle threaded with a needle thread;

a principal shaft;

a sewing machine motor for driving the needle bar via the principal shaft;

a bed portion including a loop taker for taking a thread loop of the needle thread in cooperative operation with the needle;

a loop taker drive shaft connected to move in association with the loop taker;

a driver including a drive motor that drives the loop taker drive shaft independently of the principal shaft;

a first detector that detects an origin position of the principal shaft and a rotational angle of the sewing machine motor and outputs a first detection signal accordingly;

a second detector that detects an origin position of the loop taker drive shaft and a rotational angle of the drive motor and outputs a second detection signal accordingly; and a synchronization controller that controls at least one of the drive motor and the sewing machine motor based on the first detection signal from the first detector and the second detection signal from the second detector so that the loop taker and the principal shaft rotate in synchronization.

2. A sewing machine as claimed in claim 1, wherein:

the first detector further detects a reference position and a rotational angle of the sewing machine motor and outputs the first detection signal accordingly; and the second detector further detects a reference position and a rotational angle of the drive motor and outputs the second detection signal accordingly.

3. A sewing machine as claimed in claim 2, wherein the first detector includes:

a first origin sensor that detects the origin position of the principal shaft; and a first encoder that detects the reference position and the rotational angle of the sewing machine motor.

4. A sewing machine as claimed in claim 3, wherein the second detector includes:

a second origin sensor that detects the origin position of the loop taker drive shaft; and a second encoder that detects the reference position and the rotational angle of the drive motor.

5. A sewing machine as claimed in claim 4, wherein the drive motor is at least one of a servo motor and a pulse motor and wherein the synchronization controller controls the drive motor.

6. A sewing machine as claimed in claim 5, wherein the synchronization controller controls based on the detection signals from the first and second origin sensors and from the first and second encoders, the drive motor controls relative phase between the principal shaft and the loop taker drive shaft.

7. A sewing machine as claimed in claim 1, further comprising a manual operation unit that enables selective manual rotation of the sewing machine motor and the loop taker drive motor.

8. A sewing machine as claimed in claim 7, wherein the manual operation unit can be switched between a mode for rotating the sewing machine motor only, a mode for rotating the loop taker drive motor only, and a mode for rotating both the sewing machine motor and the loop taker drive motor.

9. A sewing machine as claimed in claim 8 wherein the manual operation unit includes:

a rotating device that rotates a selected at least one of the sewing machine motor and the loop taker drive motor by an amount corresponding to a movement of the the rotating device; and a sensitivity switching device that sets a degree at which movement of the rotating device is translated into rotation of the selected at least one of the sewing machine motor and the loop taker drive motor.

10. A sewing machine as claimed in claim 7 wherein the synchronization controller controls the sewing machine motor and the loop taker drive motor to rotate to bring the loop taker and the needle into a non-interference position before each new sewing process.

11. A sewing machine as claimed in claim 1 wherein the synchronization controller determines an amount of shift from synchronization between the loop taker and the principal shaft based on the first and second detection signals and, when the determined amount of shift exceeds an allowable value, controls the loop taker drive motor and the sewing machine motor to stop in synchronization.

12. A sewing machine as claimed in claim 11, wherein when the determined amount of shift exceeds an allowable value, the synchronization controller controls the loop taker drive motor and the sewing machine motor to stop at positions where the loop taker and the needle are in non-interference positions with respect to each other.

13. A sewing machine as claimed in claim 2, wherein the synchronization controller controls the at least one of the loop taker drive motor and the sewing machine motor using fuzzy logic.

14. A sewing machine as claimed in claim 13, wherein the synchronization controller controls the at least one of the loop taker drive motor and the sewing machine motor based on at least one of:

a rotational speed of the principal shaft as determined based on the first detection signal;

a rotational speed of the loop taker drive shaft as determined based on the second detection signal; and a phase shift angle of the loop taker drive shaft with respect to the principal shaft as determined based on the first and second detection signals.

15. A sewing machine as claimed in claim 1, further comprising:

a power detector device that detects drops in power supplied to the sewing machine; and a capacitor that supplies power to the sewing machine when the power detector device detects a drop in power equal to or greater than a predetermined value.

16. A sewing machine as claimed in claim 15, wherein, when the power detector device detects a drop in power equal to or greater than the predetermined value, the synchronization controller controls the sewing machine motor and the loop taker drive motor to stop in synchronization and at a non-interference position where the loop taker and the needle do not interfere with each other.

17. A sewing machine comprising:

a head portion including a bar needle for mounting a needle threaded with a needle thread;

a principal shaft;

a sewing machine motor for driving the needle bar via the principal shaft;

a bed portion including a loop taker for taking a thread loop of the needle thread in cooperative operation with the needle;

a loop taker drive shaft connected to move in association with the loop taker;

means for driving the loop taker drive shaft independently of the principal shaft the means including a drive motor;

first means for detecting an origin position of the principal shaft and a rotation angle of the sewing machine motor and outputting a first detection signal accordingly;

second means for detecting an origin position of the loop taker drive shaft and a rotational angle of the drive means and outputting a second detection signal accordingly; and means for controlling at least one of the drive motor and the sewing machine motor based on the first detection signal and the second detection signal so that the loop taker and the principal shaft rotate in synchronization.

* * * * *